US007163782B2

(12) United States Patent
Goto

(10) Patent No.: US 7,163,782 B2
(45) **Date of Patent: *Jan. 16, 2007**

(54) PHOTOTHERMOGRAPHIC IMAGING MATERIAL

(75) Inventor: Narito Goto, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 195 days.

This patent is subject to a terminal disclaimer.

(21) Appl. No.: 10/806,841

(22) Filed: Mar. 23, 2004

(65) Prior Publication Data

US 2004/0229175 A1 Nov. 18, 2004

(30) Foreign Application Priority Data

Mar. 27, 2003 (JP) ..... 2003-089350
Mar. 27, 2003 (JP) ..... 2003-089351

(51) Int. Cl.
*G03C 5/00* (2006.01)
*G03C 1/498* (2006.01)

(52) U.S. Cl. ..... 430/332; 430/218; 430/224; 430/243; 430/531; 430/600; 430/603; 430/617; 430/631; 430/619

(58) Field of Classification Search ..... 430/332, 430/619, 617, 631, 531, 567, 224, 218, 243, 430/603, 600
See application file for complete search history.

(56) References Cited

U.S. PATENT DOCUMENTS 4,021,240 A * 5/1977 Cerquone et al. ..... 430/203
5,330,864 A * 7/1994 Biavasco et al. ..... 430/619
2002/0102502 A1* 8/2002 Fukui et al. ..... 430/350
2004/0106074 A1* 6/2004 Kashiwagi et al. ..... 430/350
2004/0115569 A1* 6/2004 Kashiwagi et al. ..... 430/336

* cited by examiner

*Primary Examiner*—Thorl Chea
(74) *Attorney, Agent, or Firm*—Lucas & Mercanti, LLP

(57) ABSTRACT

A photothermographic imaging material including an organic silver salt, a binder, a reducing agent, coupler and a main developing agent which forms coloring images by reacting with the coupler, those which are on a support wherein the reducing agent comprises a compound represented by the following Formula (1), the coupler is a compound represented by the following Formula (CP1) and sum of maximum density of colorant images at maximum absorption wavelength formed by the coupler and the main developing agent is 0.01 or more and 0.50 or less Formula (1)

Formula (CP1)

11 Claims, 1 Drawing Sheet

PHOTOTHERMOGRAPHIC IMAGING MATERIAL

BACKGROUND OF THE INVENTION

1. Field of the Invention

The present invention relates to a photothermographic imaging material, and particularly to a photothermographic imaging material with high density which is excellent in light radiated image stability, silver color tone and the like, and to a method for forming an image by using the same.

2. Description of Related Art

In the fields of medical care and print plate making, waste solutions involved in wet processings of image formation materials have been problematic in terms of working property, and reduction of processing waste solutions has been strongly desired in the light of environmental preservation and saving space in late years. As a result, a photothermographic imaging material has been put to practical use and has rapidly become common.

A thermographic imaging material (hereinafter, simply referred to as a thermographic material or a photoconductive material) itself has proposed for long. For example, U.S. Pat. Nos. 3,152,904 and 3,457,07 are disclosed.

This photothermographic material is processed by a thermal development apparatus which adds stable heat to the photothermographic material to form the image, typically called a thermal developing apparatus. As mentioned above, in conjunction with the recent rapid prevalence, this thermal developing apparatus has been supplied in the market in large quantities. In the meanwhile, there has been problematic in that slipping property between the imaging material and a transport roller or processing members of the thermal developing apparatus changes, and transport failure and density unevenness occur. Also there has been problematic in that the density of the photothermographic imaging material varies with time. It has been found that these phenomena noticeably occur in the photothermographic imaging materials where image exposure is performed by laser light and subsequently the image is formed by thermal development.

Also recently, downsizing of laser imagers and acceleration of processings have been required. Therefore property improvement of the photothermographic imaging materials becomes essential.

For downsizing the thermal development processing apparatus, it is more advantageous to use a heat drum mode than to use a horizontal transport mode, but there has been problematic in that powder drop off, density unevenness and roller mark easily occur at the thermal development processing. Also, even when the rapid processing is carried out, to obtain sufficient density of the photothermographic imaging material, it is effective to enhance covering power by increasing coloring point numbers using silver halide with smaller average particle size as shown in JP Tokukaihei-11-295844A and JP Tokukaihei-11-352627A, to use reducing agents with high activity having secondary or tertiary alkyl groups (see JP-A-2001-209145), and to use development accelerators such as hydrazine compounds and vinyl compounds.

However, when these technologies were used, there was problematic in that density changes (printout property) with time after the thermal development processing became large and the silver color tone became extremely different (took on a yellow tinge) compared to wet type X-ray films in earlier technology. Additionally, a new problem where the color tone takes on a red tinge at high density areas with density of 2.0 or more has occurred when those with smaller average particle size are used as the silver halide.

JP Tokukai 2001-133925A discloses a technique for improving a printout property. Also, JP Tokukaihei-11-231460A, JP Tokukai-2002-169249A and JP Tokukaihei-11-288057A disclose technique for regulating silver color tone.

SUMMARY OF THE INVENTION

The present invention has been made in view of the above problems. That is, an object of the present invention is to provide a photothermographic imaging material with high density which is excellent in light radiated image stability and silver color tone, and to a method for forming an image. Also, the object of the present invention is to further provide a photothermographic imaging material which is excellent in image storage stability in storage at high temperature or excellent in film transportability and environmental suitability if necessary.

The present inventors has studied about methods of obtaining images having desirable color tone by preventing that color tone becomes excessively yellowish when a reducing agent used has high activity and images become excessively reddish especially in a high density part having the density of 2.0 or more. As a result, the inventors has found that the above problems are dissolved by the usage of coupler represented by the Formula (CP1) and main developing agent which forms coloring images by reacting with the coupler. Furthermore, the inventors has found out that fine control of color tone can be performed by combination usage of the above coupler and the compounds represented by the Formula (YA) and combination usage and regulation of mixing ratio of developing agent having high activity represented by the Formula (1) and one having comparative low activity represented by the Formula (2). Thus the present invention has been achieved.

The above-described object of the present invention is accomplished by the following configurations.

(1) According to the first aspect, photothermographic imaging material comprise an organic silver salt, a binder, a reducing agent, coupler and a main developing agent which forms coloring images by reacting with the coupler, those which are on a support wherein:

the reducing agent comprises a compound represented by the following Formula (1), the coupler is a compound represented by the following Formula (CP1) and sum of maximum density of colorant images at maximum absorption wavelength formed by coupler and main developing agent is 0.01 or more and 0.50 or less;

Formula (1)

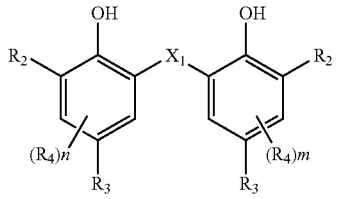

wherein the $X_1$ represents chalcogen atom or —$CHR_1$— (the $R_1$ represents hydrogen, halogen, alkyl group, alkenyl group, aryl group or heterocyclic group) and the $R_2$ represents alkyl group, the two $R_2$s can be either same or different, and at least one of them is secondary or tertiary alkyl group, the $R_3$ represents hydrogen atom or a group which can be a substituent on a benzene ring, the $R_4$ represents a group which can be a substituent on a benzene ring, the m and the n represent integer of 0 to 2 respectively; and Formula (CP1)

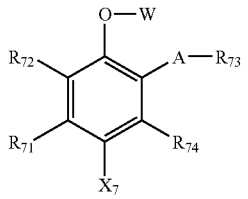

wherein the $R_{71}$ is hydrogen atom, halogen atom, substituted or unsubstituted alkyl, alkoxy and —NHCO—R group (the R represents an alkyl, aryl or heterocyclic group), the A represents —NHCO—, —CONH— or —NHCONH— group, and the $R_{73}$ represents a substituted or unsubstituted alkyl, aryl or heterocyclic group, and the -A-$R_{73}$ may be a hydrogen atom, the W represents a hydrogen atom or —CONH—$R_{75}$, —CO—$R_{75}$ or —CO—O—$R_{75}$ group (the $R_{75}$ represents a substituted or unsubstituted alkyl, aryl or heterocyclic group.), and the $R_{72}$ and the $R_{74}$ represent hydrogen atoms, halogen atoms, a substituted or unsubstituted alkyl, alkenyl, alkoxy, carbamoyl or nitrile groups, and the $X_7$ represents a hydrogen atom or a group which can be eliminated by oxidation coupling reaction with main developing agent.

(2) The reducing agent may further comprise a compound represented by the following Formula (2).

Formula (2)

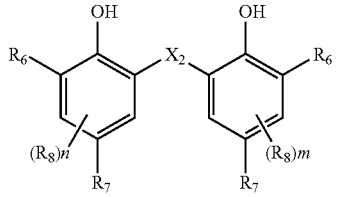

wherein the $X_2$ represents chalcogen atom or —$CHR_5$— (the $R_5$ represents hydrogen, halogen, alkyl group, alkenyl group, aryl group or heterocyclic group) and the $R_6$ represents alkyl group. The two $R_6$s can be either same or different, but are not secondary or tertiary alkyl group, the $R_7$ represents hydrogen atom or a group which can a substituent on a benzene ring, $R_8$ represents a group which can be a substituent on a benzene ring, and the m and the n represent integer of 0 to 2 respectively.

(3) The mass ratio between the compound represented by the Formula (1) and the compound represented by the Formula (2) is preferably 5:95 to 45:55.

(4) The material may further comprise a compound represented by the following Formula (YA) in a side of a face having an image forming layer.

Formula (YA)

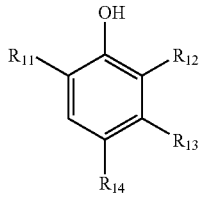

Wherein the $R_{11}$ represents a substituted or unsubstituted alkyl group, the $R_{12}$ represents hydrogen atom or substituted or unsubstituted alkyl or acylamino groups, the $R_{11}$ and the $R_{12}$ are not 2-hydroxyphenylmethyl group, the $R_{13}$ represents hydrogen atom or substituted or unsubstituted alkyl group, and the $R_{14}$ represents a group capable of being substituent on a benzene ring.

(5) An image obtained by thermal development in developing temperature at 123° C. and developing time for 13.5 seconds may have an average gradation of 2.0 to 4.0 at an optical density under diffused light in a range of 0.25 to 2.5 on a characteristic curve shown on rectangular coordinates where Y axis is diffuse density and X axis is common logarithm exposure amount and unit lengths of the X axis and the Y axis are equal.

(6) The material may comprise at least one silver saving agent selected from a vinyl compound, a hydrazine derivative, a silane compound and a quaternary onium salt in a side of a face having an image forming layer.

(7) The binder may have a glass transition temperature (Tg) of 70 to 150° C.

(8) The material may further comprise a compound represented by the following formula (SF); and $$(Rf\text{-}(L)_{n1}\text{-})_p\text{-}(Y)_{m1}\text{-}(A)_q \quad (SF)$$

wherein the Rf represents a substituent having fluorine atom, the L represents a bivalent linkage group containing no fluorine atom, the Y represents a linkage group having (p+q) valency, and the A represents an anion group or an anion salt group. The $m_1$ and the $n_1$ represent an integer of 0 or 1 respectively, the p and the q represent an integer of 1 to 3 respectively, and when the q is 1, at least one of the $n_1$ and the $m_1$ is not 0.

(9) The silver halide may comprise silver halide particles having mean particle size of 10 to 50 nm.

(10) The silver halide may further comprise silver halide particles having mean particle size of 55 to 100 nm.

(11) The silver halide may comprise silver halide particles which are chemically sensitized by a chalcogen compound.

(12) The content of silver in an image forming layer is preferably from 0.3 to 1.5 g/$m^2$.

(13) The value of Rz(E)/Rz(B) is preferably 0.1 or more and 0.7 or less where average roughness of 10 points at outermost surface at a side of an image forming layer with interleaving the support is rendered the Rz(E) and the average roughness of 10 points at outermost surface at an opposite side of the image forming layer with interleaving the support is rendered the Rz(B).

(14) The value of Lb/Le is preferably 2.0 or more and 10 or less where mean particle size of matting agent having maximum mean particle size contained in a layer at a side of an image forming layer with interleaving the support is rendered the Le (μm) and the mean particle size of a matting agent having the maximum mean particle size contained in a layer at an opposite side of the image forming layer with interleaving the support is rendered the Lb (μm).

Further, the present inventors has studied about methods of obtaining images having desirable color tone by preventing that color tone becomes excessively yellowish when a reducing agent used has high activity and images become excessively reddish especially in a high density part having the density of 2.0 or more. As a result, the inventors has found that the above problems are dissolved by the usage of following compounds.

(1) Compound represented by the Formula (YA), coupler and main developing agent which forms coloring images by reacting with the coupler.

(2) Compound represented by the Formula (YA) and cyan leuco dye.

Furthermore, the inventors has found that combination usage and regulation of mixing ratio of developing agent having high activity represented by the Formula (1) and one having comparative low activity represented by the Formula (2). Thus the present invention has been achieved.

The present invention is accomplished by the following configurations.

(15) According to the second aspect, a photothermographic imaging material comprising an organic silver salt, a binder, a reducing agent, a coupler, a main developing agent which forms coloring images by reacting with the coupler, and a compound represented by the following Formula (YA) those which are on a support wherein sum of maximum density of a colorant images at maximum absorption wavelength formed by the coupler and the main developing agent is 0.01 or more and 0.50 or less; and Formula (YA)

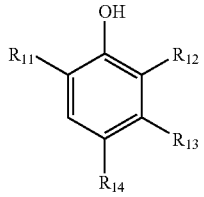

wherein the $R_{11}$ represents a substituted or unsubstituted alkyl group, the $R_{12}$ represents hydrogen atom or substituted or unsubstituted alkyl or acylamino groups, the $R_{11}$ and the $R_{12}$ are not 2-hydroxyphenylmethyl group, the $R_{13}$ represents hydrogen atom or substituted or unsubstituted alkyl group, and the $R_{14}$ represents a group capable of being substituent on a benzene ring.

(16) The coupler is preferably a compound represented by the following formula (CP2), and Formula (CP2)

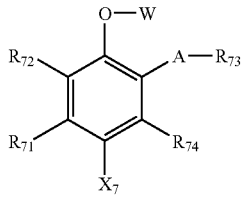

wherein the $R_{71}$ and the $R_{72}$ are hydrogen atoms, halogen atoms, substituted or unsubstituted alkyl, alkenyl, alkoxy and —NHCO—R groups (the R represents an alkyl, aryl or heterocyclic group), or the $R_{71}$ and the $R_{72}$ are the groups which are bound one another to form an aliphatic hydrocarbon ring, aromatic hydrocarbon ring or heterocycle, the A represents —NHCO—, —CONH— or —NHCONH— group, and the $R_{73}$ represents a substituted or unsubstituted alkyl, aryl or heterocyclic group, the -A-$R_{73}$ may be a hydrogen atom, the W represents a hydrogen atom or —CONH—$R_{75}$, —CO—$R_{75}$ or —CO—O—$R_{75}$ group (the $R_{75}$ represents a substituted or unsubstituted alkyl, aryl or heterocyclic group.), and the $R_{74}$ represents a hydrogen atom, halogen atom, a substituted or unsubstituted alkyl, alkoxy, carbamoyl or nitrile group, and the $X_7$ represents a hydrogen atom or a group which can be eliminated by oxidation coupling reaction with main developing agent.

(17) According to the third aspect, a photothermographic imaging material comprising a organic silver salt, a silver halide, a binder, a reducing agent, a cyan leuco dye and a compound represented by the following general formula (YA); and Formula (YA)

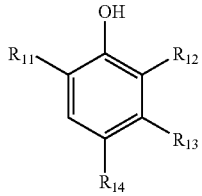

wherein the $R_{11}$ represents a substituted or unsubstituted alkyl group, the $R_{12}$ represents hydrogen atom or substituted or unsubstituted alkyl or acylamino groups, the $R_{11}$ and the $R_{12}$ are not 2-hydroxyphenylmethyl group, the $R_{13}$ represents hydrogen atom or substituted or unsubstituted alkyl group, and the $R_{14}$ represents a group capable of being substituent on a benzene ring.

(18) The reducing agent may comprise a compound represented by the following Formula (1); and Formula (1)

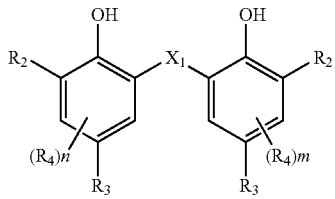

wherein the $X_1$ represents chalcogen atom or —$CHR_1$— (the $R_1$ represents hydrogen, halogen, alkyl group, alkenyl group, aryl group or heterocyclic group) and the $R_2$ represents alkyl group, the two $R_2$s can be either same or different, and at least one of them is secondary or tertiary alkyl group, the $R_3$ represents hydrogen atom or a group which can be a substituent on a benzene ring, the $R_4$ represents a group which can be a substituent on a benzene ring, the m and the n represent integer of 0 to 2 respectively.

(19) The reducing agent may further comprise a compound represented by the following Formula (2); and Formula (2)

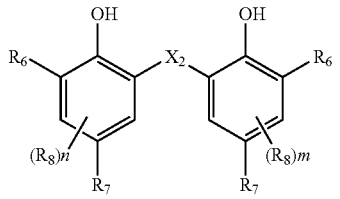

wherein the $X_2$ represents chalcogen atom or —$CHR_5$— (the $R_5$ represents hydrogen, halogen, alkyl group, alkenyl group, aryl group or heterocyclic group) and the $R_6$ represents alkyl group. The two $R_6$s can be either same or different, but are not secondary or tertiary alkyl group, the $R_7$ represents hydrogen atom or a group which can a substituent on a benzene ring, $R_8$ represents a group which can be a substituent on a benzene ring, and the m and the n represent integer of 0 to 2 respectively.

(20) The mass ratio between the compound represented by the Formula (1) and the compound represented by the Formula (2) is preferably 5:95 to 45:55.

(21) An image obtained by thermal development in developing temperature at 123° C. and developing time for 13.5 seconds may have an average gradation of 2.0 to 4.0 at an optical density under diffused light of 0.25 to 2.5 on a characteristic curve shown on rectangular coordinates where Y axis is diffuse density and X axis is common logarithm exposure amount and unit lengths of the X axis and the Y axis are equal.

(22) The material may comprise at least one silver saving agent selected from a vinyl compound, a hydrazine derivative, a silane compound and a quaternary onium salt in a side of a face having an image forming layer.

(23) The binder may have a glass transition temperature (Tg) of 70 to 150° C.

(24) The material may further comprise a compound represented by the following Formula (SF); and $$(Rf\text{-}(L)_{n1}\text{-})_p\text{-}(Y)_{m1}\text{-}(A)_q \qquad \text{(SF)}$$

wherein the Rf represents a substituent having fluorine atom, the L represents a bivalent linkage group containing no fluorine atom, the Y represents a linkage group having (p+q) valency, and the A represents an anion group or an anion salt group. The $m_1$ and the $n_1$ represent an integer of 0 or 1 respectively, the p and the q represent an integer of 1 to 3 respectively, and when the q is 1, at least one of the $n_1$ and the $m_1$ is not 0.

(25) The silver halide may comprise silver halide particles having mean particle size of 10 to 50 nm.

(26) The silver halide may further comprise silver halide particles having mean particle size of 55 to 100 nm.

(27) The silver halide may comprise silver halide particles which are chemically sensitized by a chalcogen compound.

(28) The content of silver in an image forming layer is from 0.3 to 1.5 g/m$^2$.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DESCRIPTION OF THE PREFERRED EMBODIMENTS

Figure 1:
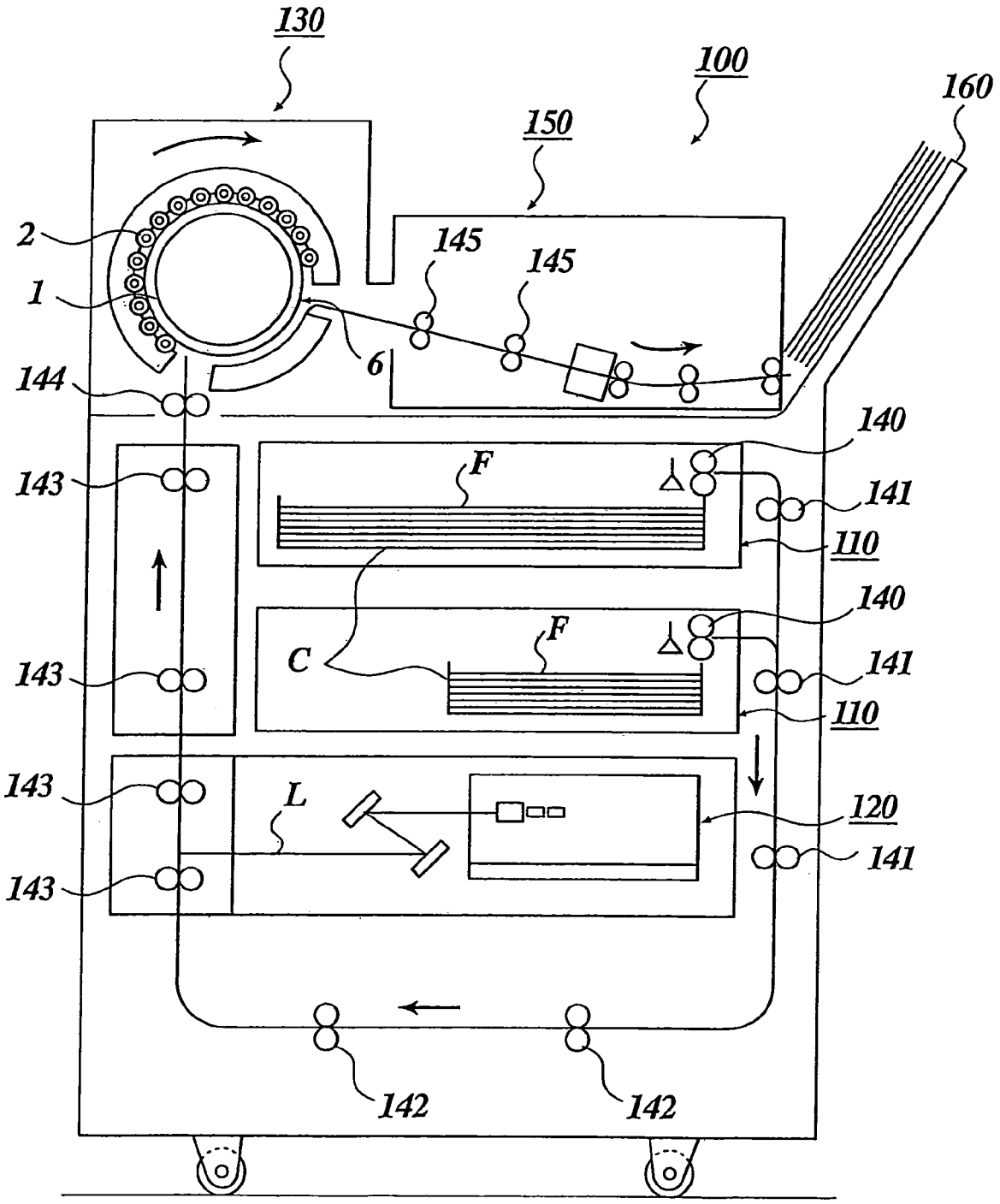
FIG. 1 is a view showing an example of a thermal development apparatus for processing a photothermographic imaging material of the present invention.

Hereinafter, present invention will be described in detail.

According to the configuration of above-described (1) to (6) and (15) to (22) enables to obtain a photothermographic imaging material having high density and superior light radiated image stability and further having improved silver color tone can be obtained can be obtained.

According to the configuration of above (7), image stability in storage at high temperature can be improved.

According to the configuration of above (8), carrying property of film and environmental property (reduction of accumulation property in vivo) can be improved.

In the above (9), mean particle size of silver halide is preferably from 10 to 50 nm. Further, 10 to 35 nm is more preferable. When the mean particle size is less than 10 nm, reduction of image density and deterioration of light irradiation image stability occur. When the mean particle size is more than 50 nm, decrease of image density occurs.

According to the configuration of above (23), image stability in storage at high temperature can be improved.

According to the configuration of above (24), carrying property of film and environmental property (reduction of accumulation property in vivo) can be improved.

In the above (25), mean particle size of the silver halide is 10 to 50 nm, and more preferably 10 to 35 nm. When mean particle size of the silver halide is less than 10 nm, decrease of image density and light deterioration of radiated image stability may occur. When it is more than 50 nm, decrease of image density may occur.

Here, the "mean particle size" in the invention is defined as follows. When the silver halide has shapes of so called normal crystal such as cube and octahedron, length of the edge is rendered as mean particle size, and when the silver halide has a shape of tabular particle, the mean particle size is calculated from a diameter of a circle image which has same area of projected area of main surface. When the silver halide has a shapes of non-normal crystal such as globular particle shape, rod-like shape and the like, diameter of the sphere having same volume of the silver halide particle is rendered as mean particle size. The measurement is performed using electron microscope, and the mean particle size is calculated from measured values of 300 particles.

In the above (12), two types of silver halide particles having mean particle sizes of 55 to 100 nm and 10 to 50 nm respectively are used in combination. By the combination usage of silver halides, gradation is easily controlled, and it become possible to improve image density and to improve (reduce) the decrease of the image density in time elapse. The proportion (mass ratio) between two types of silver halides having mean particle size of 10 to 50 nm and 55 to 100 nm respectively is preferably 95:5 to 50:50, and more preferably from 90:10 to 60:40.

Next, the components of the present invention will be explained.

[Organic Silver Salts]

As for the organic silver salts as silver ion supplying source for silver image formation, preferred are silver salts of organic acids and hetero organic acids, especially in these salts, silver salts of long chain (from 10 to 30, preferably from 15 to 25 carbons) aliphatic carboxylic acids, and silver salts of nitrogen-containing heterocyclic compounds. Also preferred are organic or inorganic complexes described in Research Disclosure (hereinafter, also referred to as RD) 17029 and 29963 such as those where ligands have values of 4.0 to 10.0 as a total stability constant for silver ions. Examples of these suitable silver salts include the followings.

Silver salts of organic acids, e.g., silver salts of gallic acid, oxalic acid, behenic acid, stearic acid, arachidic acid, palmitic acid, lauric acid, etc.; carboxyalkylthio urea salts of silver, e.g., silver salts of 1-(3-carboxypropyl) thiourea, 1-(3-carboxypropyl)-3,3-dimethyl thiourea; silver salts or silver complexes of polymer reaction product of aldehyde with hydroxy-substituted aromatic carboxylic acid, e.g., silver salts or silver complexes of the reaction product of aldehydes (formaldehyde, acetaldehyde, butylaldehyde, etc.) with hydroxy-substituted acids (e.g., salicylic acid, benzoic acid, 3,5-hydroxybenzoic acid); silver salts or silver complexes of thiones, e.g., silver salts or silver complexes of 3(2-carboxyethyl)-4-hydroxymethyl-4-thiazoline-2-thione, and 3-carboxymethyl-4-thiazoline-2-thione, etc.; complexes or salts of silver with nitrogen acid selected from imidazole, pyrazole, urazole, 1,2,4-thiazole and 1H-tetrazole, 3-amino-5-benzylthio-1,2,4-triazole and benzotriazole; silver salts of saccharine, 5-chlorosalicylaldoxime, and the like; silver mercaptides and the like.

Among them, especially preferable silver salts include the silver salts of long chain (from 10 to 30, preferably from 15 to 25 carbons) aliphatic carboxylic acids such as silver behenate, silver arachidate and silver stearate.

Also, in the invention, it is preferred that two or more organic silver salts are mixed in terms of increasing development performance and forming silver images with high density and high contrast, and for example, it is preferable to prepare by mixing a silver ion solution to a mixture of two or more organic acids.

An organic silver salt can be obtained by mixing a water soluble silver compound and a compound which forms complex with the silver, and preferably used are a normal mixing method, a reverse mixing method, a simultaneous mixing method, a controlled double jet method as described in JP-A-9-127643, and the like. For example, an alkali metallic salt (e.g., sodium hydroxide, potassium hydroxide, etc.) is added to an organic acid to make an organic acid alkali metallic salt soap (e.g., sodium behenate, sodium arachidate, etc.), and subsequently crystal of an organic silver salt is made by mixing silver nitrate with the soap. At that time, silver halide grains may be mixed.

It is possible to use various shapes of the above organic silver salt according to the present invention, but tabular particles are preferable. Especially, preferred are the particles which are tabular organic silver salt particles with an aspect ratio of 3 or more and where the average value of an acicular ratio of the tabular organic silver salt particles measured from a major plane direction is from 1.1 or more and less than 10.0 in order to increase a filling rate in a photosensitive layer by reducing shape anisotropy of nearly parallel opposed two faces (major planes) having maximum area. Besides, more preferable acicular ratio is from 1.1 or more and less than 5.0.

Here, tabular organic silver salt particles with the aspect ratio of 3 or more represents that the tabular organic silver salt particles occupy 50% or more of the number of whole organic silver salt particles. Further, in the organic silver salt according to the present invention, the tabular organic silver salt particles with the aspect ratio of 3 or more occupy preferably 60% or more, more preferably 70% or more (number), and especially preferably 80% or more (number) of the number of whole organic silver salt particles.

Tabular particles with the aspect ratio of 3 or more are the particles where a ratio of a particle size to a thickness, so-called the aspect ratio (abbreviated as AR) represented by the following formula is 3 or more.

$$AR = \text{Particle size } (\mu m)/\text{Thickness } (\mu m)$$

The aspect ratio of the tabular organic silver salt particles is preferably from 3 to 20, and more preferably from 3 to 10. The reasons are that the organic silver salt particles are easily close-packed when the aspect ratio is too low whereas when the aspect ratio is too high, then the organic silver salt particles are easily overlapped and light scattering and the like easily occur because the particles are easily dispersed in a clung state, resulting in reduction of clear feeling of imaging materials. Thus, the range described above is preferable.

The average values of particle sizes, average thickness, and acicular rates can be obtained by the methods described in the paragraphs [0031] to [0047] of JP Tokukai-2002-287299A.

The method where the organic silver salt particles having the above shape are obtained is not especially limited, but effective are that a mixing state at the formation of the organic acid alkali metallic salt soap and/or a mixing state at the addition of silver nitrate to the soap are kept well and that a rate of silver nitrate which reacts with the soap is made optical.

It is preferred that the tabular organic silver salt particles according to the present invention are predispersed with a binder and surfactants if necessary and subsequently dispersed/pulverized by a media dispersing machine or a high pressure homogenizer. For the above predispersion, it is possible to use common mixers such as anchor type and propeller type, a high-speed rotation centrifuging radiation type mixer (dissolver) and a high-speed rotation shearing type mixer (homo mixer).

Also, as the above media dispersing machine, it is possible to use rolling mills such as a ball mill, planetary ball mill and vibrating ball mill, media mixing mills such as a bead mill and attritor, and the others such as a basket mill, and as high pressure homogenizers, it is possible to use various types such as a type of conflicting to walls and plugs, a type where a liquid is divided into two and then the liquids are crashed at a high-speed and a type of passing through thin orifices.

As ceramics used for ceramics beads used upon media dispersion, preferred are those described in the paragraph [0051] of the above JP Tokukai-2002-287299A. Yttrium stabilized zirconia and zirconia toughened alumina (hereinafter these zirconia-containing ceramics are abbreviated as zirconia) are especially preferably used from the reason that impurity production due to friction with beads and a dispersing machine upon the dispersion is low.

In the apparatuses used upon dispersing the tabular organic silver salt particles, as materials of members to which the organic silver salt particles contact, it is preferable to use ceramics such as zirconia, alumina, silicon nitride and boron nitride, or diamond, and among others it is preferable to use zirconia.

When the above dispersion is carried out, it is preferred that the binder is added at a concentration of 0.1 to 10% of the organic silver salt by mass, and it is preferred that liquid temperature is less than 45° C. throughout from predispersion to main dispersion. A preferable operating condition of the main dispersion includes the condition of 29.42 MPa to 98.06 MPa and two times or more of operations when the high pressure homogenizer is used as the dispersion means as the preferable operating condition. Also when the media dispersing machine is used as the dispersing means, the condition where a peripheral velocity is from 6 m/second to 13 m/second is included as the preferable condition.

Also, the preferable mode in the photothermographic imaging materials in the invention is made by coating the organic silver salt having the characteristics that the rate of the organic silver salt particles which exhibit a projected area of less than 0.025 $\mu m^2$ when a sectional face perpendicular to the support face of the material is observed by the electron microscope is 70% or more of whole projected areas and the rate of the particles which exhibit the projected area of 0.2 $\mu m^2$ or more is 10% or less of whole projected areas of the organic silver salt particles, and further a photosensitive emulsion containing the photosensitive silver halide. In such a case, it is possible to obtain the state where agglomeration of the organic silver salt particles is low and the particles are distributed evenly in the photosensitive emulsion.

The conditions to make the photosensitive emulsion having such characteristics are not especially limited, but include that the mixing state at the formation of organic acid alkali metallic salt soap and/or the mixing state at the addition of silver nitrate to the soap are kept well, that the rate of silver nitrate which reacts to the soap is made optical, dispersing by the media dispersing machine or the high pressure homogenizer for dispersion/pulverization, that the use amount of binder (concentration) is made from 0.1 to 10% of the organic silver salt by mass at that time, agitating at the peripheral velocity of 2.0 m/second or more using the dissolver at the preparation of solution, in addition to that the temperature is less than 45° C. throughout from dry to the termination of main dispersion as the preferable conditions.

For the projected area of the organic silver salt particle having the certain projected area value as the above and a percentage thereof occupying in the whole projected area, as is described in the description to obtain the average thickness of the tabular particles described above, places corresponding to the organic silver salt particles are extracted by the method using TEM (transmission electron microscope). Specifically, they can be obtained by the method described in the paragraphs of [0057] to [0059] of JP Tokukai-2002-287299A.

It is preferred that the organic silver salt particles used in the invention are monodisperse particles, preferable monodisperse degree is from 1 to 30%, and the image with high density is obtained by making the monodisperse particles in this range. The monodisperse degree herein is defined by the following formula.

Monodisperse degree={(Standard deviation of particle sizes)/(Mean value of particle sizes)}×100

The mean particle size (circle corresponding diameter) of the organic silver salt described above is preferably from 0.01 to 0.3 μm, and more preferably from 0.02 to 0.2 μm. Besides, the mean particle size (diameter of corresponding circle) represents the diameter of a circle which has the same area as each particle image observed by the electron microscope.

To prevent devitrification of the imaging materials in the present invention, it is preferred that the total amount of silver halide and organic silver salt is from 0.3 g to 1.5 g per 1 $m^2$ in terms of the silver amount. The preferable images are obtained when used as medical images by making this range. When it is less than 0.3 g per 1 $m^2$, the image density is reduced in some cases. Also when it is more than 1.5 g per 1 $m^2$, sensitivity reduction occurs at printing to PS plates in some cases.

[Silver Halide]

Described is silver halide according to the present invention (hereinafter also referred to as photosensitive silver halide grains or silver halide grains). Besides, the silver halide according to the present invention is referred to the silver halide crystalline particles treated and manufactured to be capable of originally absorbing light as an inherent nature of the silver halide crystal or capable of absorbing visual light or infrared light by artificial physicochemical methods, and such that physicochemical changes occur in the silver halide crystal or on the surface of the crystal when light is absorbed in any area of the light wavelength range from the ultraviolet light area to the infrared light area.

The silver halide grains per se used for the present invention can be prepared as the silver halide particle emulsion (also referred to as silver halide emulsion) using the well-known methods. That is, any of an acid method, neutral method, ammonia method and the like may be used, and also as the method to react a soluble silver salt with a soluble halogen salt, any of an one side mixing method, a simultaneous mixing method and the combination thereof may be used, but among the above methods, so-called controlled double jet method is preferable where the silver halide grains are prepared with controlling the formation condition.

A halogen composition of the photosensitive silver halide is not especially limited, and may be any of silver chloride, silver chloride bromide, silver chloride iodide bromide, silver bromide, silver iodide bromide and silver iodide.

The particle formation is typically divided into two stages, silver halide seed particle (nucleus) generation and particle growth, may be performed by the method where they are performed simultaneously and continuously or the method where the nucleus (seed particle) formation and the particle growth are separated. The controlled double jet method where the particle formation is carried out by controlling pAg, pH which are the particle formation condition is preferable because the particle shape and size can be controlled. For example, when the method where the nucleus generation and the particle growth are separately carried out is performed, first a silver salt aqueous solution and a halide aqueous solution are mixed evenly and rapidly in a gelatin aqueous solution to generate the nucleus (seed particle) (nucleus generation step), and subsequently the silver halide grains are prepared by a particle growth step where the particles are grown with supplying the silver salt aqueous solution and the halide aqueous solution under controlled pAg and pH. The desired silver halide photographic emulsion can be obtained by eliminating unnecessary salts by a desalting step. The desalting step includes the desalting method known in the art such as a noodle method, flocculation method, ultrafiltration method and electric dialysis method after the particle formation.

It is preferred that particle sizes of the silver halide grains are monodisperse. The monodisperse herein is referred to those where a coefficient of variation of the particle sizes obtained by the following formula is 30% or less. Preferably the coefficient of variation of the particle sizes is 20% or less and more preferably 15% or less.

Coefficient of variation of particle sizes %=(Standard deviation of particle sizes/Mean value of particle sizes)×100

Shapes of the silver halide grains can include a regular hexahedron, octahedron, 14-hedron particles, tabular particles, spherical particles, stick particles, potato-shaped particles and the like, but in these, preferred are regular hexahedron, octahedron, 14-hedron, and tabular silver halide grains.

When the tabular silver halide grains are used, the average aspect ratio is preferably 1.5 to 100, and more preferably 2 to 50. These are described in U.S. Pat. Nos. 5,264,337, 5,314,798 and 5,320,958, and the target tabular particles can be readily obtained. Additionally, particles where corners of the silver halide grains uproll can be preferably used.

Crystal habits of external surfaces of the used silver halide grains are not especially limited, but it is preferred to use the silver halide grains having the crystal habit compatible for the selectivity at a high rate when a sensitizing dye having the crystal habit (face) selectivity is used in absorption reaction of the sensitizing dye onto the surface of the silver halide grains. For example, when the sensitizing dye which is selectively absorbed to crystal face with mirror index [100] is used, it is preferred that a occupying rate of the [100] face is high on the external surface of the silver halide grains, and this rate is preferably 50% or more, more preferably 70% or more, and especially preferably 80% or more. Besides, the rate of mirror index [100] face can be obtained by T. Tani, J. Imaging Sci., 29, 165 (1985) where absorption dependency of [111] face and [100] face is utilized in the absorption of sensitizing dye.

It is preferred that the silver halide grains used in the invention are prepared by using low molecular weight gelatin with the average molecular weight of 50,000 or less. In particular, the low molecular weight gelatin is preferably used at the nucleus formation of the silver halide grains. The low molecular weight gelatin is preferably one with the average molecular weight of 50,000 or less, preferably from 2,000 to 40,000, and especially preferably from 5,000 to 25,000. The average molecular weight of gelatin can be measured by gel filtration chromatography. The low molecular weight gelatin can be obtained by enzymatically decomposing by adding gelatinase to an aqueous solution of gelatin with the average molecular weight of about 100,000 usually used, by hydrolyzing by adding an acid or an alkali to the solution, by thermally decomposing by heating in air or under pressure, by decomposing by sonication or by combining these methods.

A concentration of dispersion medium at the nucleus formation is preferably 5% by mass, and it is preferable to perform at the low concentration of 0.05 to 3.0% by mass.

Further, it is preferred that the compound represented by the following Formula is used for the silver halide grains at the particle formation.

$$YO(CH_2CH_2O)_m(CH(CH_3)CH_2O)_p(CH_2CH_2O)_nY$$

In the formula, Y represents a hydrogen atom, —$SO_3M$ or —CO—B—COOM, M represents a hydrogen atom, an alkali metal atom, an ammonium group or an ammonium group substituted with an alkyl group of 5 or less carbon atoms, B represents a chain or a cyclic group which forms an organic dibasic acid, m and n represent from 0 to 50, respectively, and p represents from 1 to 100.

The polyethyleneoxide compound represented by the above Formula is preferably used as a defoaming agent for remarkable effervescence when photographic emulsion raw materials are stirred and moved such as a step where a gelatin aqueous solution is produced, a step where a water soluble halide and a water soluble silver salt are added to the gelatin solution and a step where the photographic emulsion is coated on the support, upon producing the materials in the invention, and the technology using as the defoaming agent is described, for example, in JP Sho-44-9497A. The polyethyleneoxide compound represented by the above Formula also works as the defoaming agent at the nucleus formation.

The compound represented by the above Formula is preferably used at 1% or less by mass based on the silver, and more preferably is used at from 0.01 to 0.1% by mass.

For the condition at the nucleus formation, it is possible to refer to the method described in the paragraphs of [0079] to [0082] of JP Tokukai-2002-287299A.

The silver halide grains used for the present invention may be added to an image formation layer by any methods, and at that time, it is preferred that the silver halide grains are positioned to come close to reducible silver source (organic silver salt).

It is preferred that the silver halide grains are precedently prepared and added to a solution for the preparation of organic silver salt particles in terms of production control because the preparation step of silver halide and the preparation step of organic silver salt particles can be separately treated. But, as described in British Patent No. 1,447,454, the silver halide grains can be produced nearly simultaneously with the production of organic silver salt particles by coexisting a halogen ingredient such as halide ions with the organic silver salt formation ingredients and inpouring the silver ions thereto when the organic silver salt particles are prepared.

Also, it is possible to prepare the silver halide grains by making a halogen-containing compound act to the organic silver salt and by conversion of the organic silver salt. That is, it is possible to make the silver halide forming ingredients act to a solution or dispersion of precedently prepared organic silver salt or a sheet material comprising the organic silver salt and to convert a part of the organic silver salt into photosensitive silver halide.

As silver halide forming ingredients, there are inorganic halogen compounds, onium halides, halogenated hydrocarbons, N-halogen compounds and the other halogen-containing compounds, and specific examples thereof are described in the paragraph [0086] of JP Tokukai-2002-287299A.

This way, the silver halide can be also prepared by converting a part of or whole silver in the organic acid silver salt into the silver halide by the reaction of the organic acid silver salt with halogen ions. And, the silver halide grains manufactured by converting a part of these organic silver salts may be combined with the separately prepared silver halide.

For these silver halide grains, both the silver halide grains separately prepared and the silver halide grains by the conversion of organic silver salt are preferably used at from 0.001 to 0.7 mol for 1 mol of the organic silver salt, and more preferably used at from 0.03 to 0.5 mol.

It is preferred that the silver halide contains ions of transition metal belonging to 6 to 11 Groups in the periodic table of elements. As the above metals, preferred are W, Fe, Co, Ni, Cu, Ru, Rh, Pd, Re, Os, Ir, Pt and Au. These may be used alone, or two or more of the same type or different type metallic complexes may be combined. These metallic ions may be obtained by introducing the metallic salt in the silver halide, and can be introduced into the silver halide in a metallic complex or complex ion form. A content is preferably in the range of $1\times10^{-9}$ mol to $1\times10^{-2}$ mol, and more preferably from $1\times10^{-8}$ to $1\times10^{-4}$. In the present invention, the transit metallic complex or complex ion is preferably one represented by the following Formula.

$[ML_6]^m$

In the formula, M represents a transit metal selected from the elements of Groups 6 to 11 in the periodic table of elements, L represents a ligand, and m represents 0, -, 2-, 3- or 4-. Specific examples of the ligand represented by L include halogen ion (fluorine ion, chlorine ion, bromine ion and iodine ion), cyanide, cyanate, thiocyanate, selenocyanate, tellurocyanate, ligands of azide and aquo, nitrosyl, thionitrosyl and the like, and preferably are aquo, nitrosyl and thionitrosyl. When the aquo ligand is present, it is preferable to occupy one or two of the ligands. L may be the same or different.

It is preferred that the compound which provides these metallic ions or complex ions is added at the silver halide particle formation and incorporated in the silver halide grains, and it may be added at any stage of the preparation of silver halide grains, i.e., before and after the nucleus formation, growth, physical maturation, and chemical sensitization, but it is preferable to add at the stage of nucleus formation, growth or physical maturation, it is more preferable to add at the stage of nucleus formation or growth, and in particular preferably it is added at the stage of nucleus formation. When added, the compound may be added by dividing in several times. Further, it can be evenly contained in the silver halide grains; and can be contained by possessing a distribution in the particle as described in JP Tokukaisho-63-29603A, JP Tokukaihei-2-306236A, JP Tokukaihei-3-167545A, JP Tokukaihei-4-76534A, JP Tokukaihei-6-110146A and J Tokukaihei-5-273683A.

These metallic compounds can be added by dissolving in water or an appropriate solvent (e.g., alcohols, ethers, glycols, ketones, esters, amides).

As for the method for introducing metal ion to silver halide, for example, there are the method where an aqueous solution of powder of the metallic compound or an aqueous solution in which the metallic compound and sodium chloride, potassium chloride are dissolved together has been added in a water soluble silver salt solution during the particle formation or a water soluble halide solution, or the method where the metallic compound is added as the third aqueous solution when the silver salt aqueous solution and the halide aqueous solution are simultaneously mixed to prepare the silver halide particle by a three solution simultaneous mixing method, the method where an aqueous solution of a required amount of the metallic compound is put in a reactor during the particle formation, or the method where the other silver halide grains in which the metallic ions or complex ions have been precedently doped are added to dissolve at the preparation of the silver halide. Especially, the method where the aqueous solution of powder of the metallic compound or the aqueous solution in which the metallic compound and sodium chloride, potassium chloride are dissolved together is added to the halide aqueous solution is preferable.

When added on the particle surface, the aqueous solution of the required amount of metallic compound can be put in the reactor immediately after the particle formation, during or at the end of the physical maturation, or at the chemical maturation.

Separately prepared photosensitive silver halide grains can be desalted by the desalting methods known in the art such as the noodle method, flocculation method, ultrafiltration method and electric dialysis method, but can be also used without desalting.

Chemical sensitization can be given to the silver halide grains. For example, by the methods disclosed in JP Tokukai-2001-249428A, JP Tokukai-2001-249426A and JP Tokukai-2000-112057A, a chemical sensitization center (chemical sensitization nucleus) can be formed and imparted using the compound having chalcogen atoms such as sulfur or the noble metal compound which releases noble metal ions such as gold ions. In the present invention, it is especially preferred that the chemical sensitization by the above compound having the chalcogen atom and the chemical sensitization using the noble metal compound are combined.

Also in the invention, the photosensitive silver halide is preferred to be chemically sensitized by the compound having the chalcogen atom shown below. It is preferred that these compounds having the chalcogen atom useful as an organic sensitizer are the compounds having a group capable of being absorbed to the silver halide and an unstable chalcogen atomic site.

As these organic sensitizer, it is possible to use the organic sensitizers having various structures disclosed in JP Tokukaisho-60-150046A, JP Tokukaihei-4-109240A and JP Tokukaihei-11-218874A, and among them, it is preferred that the sensitizer is at least one type of the compounds having the structure where the chalcogen atom is bound to a carbon atom or phosphorus atom by a double bond. Especially preferred are the compounds of the Formula (1-1) and the Formula (1-2) disclosed in JP Tokukaihei-2002-250984A.

An use amount of the chalcogen atom-containing compound as the organic sensitizer varies depending on the chalcogen compound used, the silver halide grains used and a reaction environment upon giving the chemical sensitization, is preferably from $1\times10^{-8}$ to $1\times10^{-2}$ mol, and more preferably from $1\times10^{-7}$ to $1\times10^{-3}$ mol. The chemical sensitization environment of the present invention is not especially limited, but it is preferred that chalcogen sensitization is given using the organic sensitizer having the chalcogen atom in the presence of the compound capable of vanishing or reducing in size chalcogenated silver or silver nucleus on the photosensitive silver halide grains, or in coexistence of an oxidizing agent capable of oxidizing the silver nucleus. As the sensitization condition, pAg is preferably from 6 to 11 (more preferably from 7 to 10), pH is preferably from 4 to 10 (more preferably from 5 to 8), and it is preferred that the sensitization is given at the temperature of 30° C. or below.

Therefore in the thermographic imaging material of the invention, it is preferred that the chemical sensitization is given to the photosensitive silver halide at the temperature of 30° C. or below using the chalcogen atom-containing organic sensitizer in the coexistence of the oxidizing agent capable of oxidizing silver nuclei on the particles, ant that used is a photosensitive silver halide emulsion which is mixed with the organic silver salt, dispersed, dehydrated and dried.

Also, it is preferred that the chemical sensitization using these organic sensitizers is carried out in the presence of a spectral sensitizing dye or a heteroatom-containing compound having absorbability to the silver halide grains. Dispersion of chemical sensitization center nuclei can be prevented, and high sensitivity and low photographic fog can be achieved by performing the chemical sensitization in the presence of the compound having the absorbability to the silver halide.

The spectral sensitizing dye used in the present invention is described below, but the heteroatom-containing compounds having the adsorbability to the silver halide include nitrogen-containing heterocyclic compounds described in JP Tokukaihei-3-24537A.

In the nitrogen-containing heterocyclic compounds used for the present invention, heterocyclic rings can include pyrazole ring, pyrimidine ring, 1,2,4-triazole ring, 1,2,3-triazole ring, 1,3,4-thiaziazole ring, 1,2,3-thiaziazole ring, 1,2,4-thiaziazole ring, 1,2,5-thiaziazole ring, 1,2,3,4-tetrazole ring, pyridazine ring, 1,2,3-triazine ring, rings where two to three of these rings are bound, e.g., triazolotriazole ring, diazaindene ring, triazaindene ring, pentaazaindene ring and the like. It is possible to apply the heterocyclic rings where a monocyclic heterocyclic ring and an aromatic ring is condensed, such as phthalazine ring, benzimidazole ring, indazole ring, and benzothiazole ring. Among them, preferred are azaindene rings, and more preferable are azaindene compounds having a hydroxyl group as a substituent, e.g., hydroxytriazaindene, hydroxytetraazaindene, hydroxypentaazaindene compounds and the like.

The heterocyclic ring may have substituents other than the hydroxyl group. It may have, for example, alkyl, alkylthio, amino, hydroxyamino, alkylamino, dialkylamino, arylamino, carboxyl, alkoxycarbonyl groups, halogen atoms, cyano group and the like as the substituents.

The addition amount of the heterocyclic compound containing them varies in the wide range depending on the sizes and composition of silver halide grains and the other conditions, and the approximate amount is in the range of $1\times10^{-6}$ mol to 1 mol as the amount per mol of the silver halide, and preferably in the range of $1\times10^{-4}$ mol to $1\times10^{-1}$ mol. The noble metal sensitization can be given to the silver halide grains by utilizing the compound which releases noble metal ions such as gold ions as described above. For example, as the gold sensitizer, it is possible to use aurichloride salts and organic gold compounds.

Also, reducing sensitization methods can be used in addition to the above sensitization methods. As specific compounds for the reducing sensitization, it is possible to use ascorbic acid, thiourea dioxide, stannous chloride, hydrazine derivatives, boron compounds, silane compounds, polyamine compounds and the like. Also, the reducing sensitization can be carried out by maturing with retaining pH of the photographic emulsion to 7 or more or pAg of the same to 8.2 or less, respectively.

The silver halide given the chemical sensitization in the invention may be those formed in the presence of the organic silver salt, those formed in the absence of the organic silver salt, or those where both are mixed.

It is preferred that the spectral sensitization is given to the photosensitive silver halide grains by making spectral sensitizing dye absorb. As the spectral sensitizing dye, it is possible to use cyanine dye, merocyanine dye, complex cyanine dye, complex merocyanine dye, holopolar cyanine dye, styryl dye, hemicyanine dye, oxonol dye, hemioxonol dye and the like. For example, it is possible to use the sensitizing dyes described in JP Tokukaisho-63-159841A, JP Tokukaisho-60-140335A, JP Tokukaisho-63-231437A, JP Tokukaisho-63-259651A, JP Tokukaisho-63-304242A, JP Tokukaisho-63-15245A and U.S. Pat. Nos. 4,639,414, 4,740,455, 4,741,966, 4,751,175, 4,835,096. The useful sensitizing dyes used for the present invention are for example described in the references described or cited in RD17643IV-A section (December in 1978, page 23) and RD18431 X section (August in 1978, page 437). Especially it is preferable to use the sensitizing dye having spectral sensitivity suitable for spectral property of various laser imager and scanner light sources. For example, preferably used are the compounds described in JP Tokukaihei-9-34078A, JP Tokukaihei-9-54409A and JP Tokukaihei-9-80679A.

Useful cyanine dyes are, for example, the cyanine dyes having basic nuclei such as thiazoline nucleus, oxazoline nucleus, pyrroline nucleus, pyridine nucleus, oxazole nucleus, thiazole nucleus, selenazole nucleus and imidazole nucleus. Useful merocyanine dyes and preferable ones include acidic nuclei such as thiohydantoin nucleus, rhodanine nucleus, oxazolidine dione nucleus, thiazolinedione nucleus, barbituric acid nucleus, thiazolinone nucleus, malononitrile nucleus and pyrazolone nucleus in addition to the above basic nuclei. In the invention, it is preferable to use the sensitizing dye especially having spectral responsivity in an infrared area. In the present invention, infrared spectral sensitizing dyes preferably used include the infrared spectral sensitizing dyes disclosed, for example, in U.S. Pat. Nos. 4,536,473, 4,515,888 and 4,959,294.

Concerning the infrared spectral sensitizing dyes used in the invention, especially preferred are long chain polymethine dyes characterized in that a sulfinyl group is substituted on a benzene ring of a benzazole ring. The above infrared spectral sensitizing dyes can be readily synthesized by the method, for example, described in F. M. Harmer, The Chemistry of Heterocyclic Compounds, Vol. 18, The Cyanine Dyes and Related Compounds (edited by A. Weissberger, published by Interscience, New York, 1964).

An addition time of these infrared spectral sensitizing dyes may be anytime after the preparation of the silver halide, and for example, they can be added by adding in a solvent or in so-called solid dispersion state by dispersing in a particulate form, to the photosensitive photographic emulsion containing the silver halide grains or the silver halide grains/organic silver salt particles. Also, as is the case with the heteroatom-containing compound having the absorbability to the silver halide grains, prior to the chemical sensitization, after adding to the silver halide grains and making absorb thereto, the chemical sensitization can be also given. This can prevent the dispersion of chemical sensitization center nuclei and can achieve high sensitivity and low photographic fog.

The above infrared spectral sensitizing dyes may be used alone or in combination thereof, and the combination of sensitizing dyes is often used especially for the purpose of supersensitization.

In the photographic emulsion containing the silver halide grains or the organic silver salt particles used in the invention, along with the sensitizing dye, a dye which per se has no spectral sensitizing action or a substance which does not substantially absorb visible light and which expresses a supersensitizing effect is included in the photographic emulsion, and this may perform supersensitization of the silver halide grains.

Useful sensitizing dyes, the combination of dyes which exhibit the supersensitization and the substance exhibiting the supersensitization are described in RD 17643 (issued in December, 1978) page 23 IV J section, or JP-B-9-2550, JP-B-43-4933, JP-A-59-19032, JP-A-59-192242, JP-A-5-341432 and JP-A-2001-83659. In the present invention, as the supersensitizers, preferred are heterocyclic aromatic mercapto compounds represented by the following Formula or mercapto derivative compounds.

Ar—SM

In the formula, M is a hydrogen atom or an alkali metal atom, Ar is a heterocyclic aromatic ring or heterocyclic condensed aromatic ring having one or more nitrogen, oxygen, selenium, or tellurium atoms. Preferable heterocyclic aromatic rings or heterocyclic condensed aromatic rings include benzimidazole, naphthimidazole, benzothiazole, naphthothiazole, benzoxazole, naphthoxazole, benzoselenazole, benzotellurazole, imidazole, oxazole, pyrazole, triazole, triazine, pyrimidine, pyridazine, pyrazine, pyridine, purine, quinoline, or quinazoline or the like. However, the other heterocyclic aromatic rings are included.

Besides, the present invention also includes mercapto derivative compounds which substantially produce the above mercapto compounds when contained in the dispersion of the organic acid silver salt or silver halide particle emulsion. Especially, preferable examples include the mercapto derivative compounds represented by the following Formula.

Ar—S—S—Ar

In the formula, Ar is the same as defined in the case of the mercapto compounds represented by the above Formula.

The above heterocyclic condensed aromatic ring or condensed aromatic ring, for example, can have a substituent selected from the group consisting of halogen atoms (e.g., chloride, bromine, iodine), hydroxyl, amino, carboxyl, alkyl groups (e.g., those having one or more carbon atoms, preferably from 1 to 4 carbon atoms), and alkoxy groups (e.g., those having one or more carbon atoms, preferably from 1 to 4 carbon atoms).

In the invention, as the Supersensitizer, it is possible to use macrocyclic compounds comprising the compound represented by the Formula (1) disclosed in JP-A-2001-330918 and heteroatoms, in addition to the above Supersensitizers.

It is preferable to use the Supersensitizer at the range of 0.001 to 1.0 mol per 1 mol of the silver in a photographic emulsion layer comprising the organic silver salt and silver halide grains. It is especially preferable to use at the range of 0.01 to 0.5 mol per 1 mol of the silver.

[Reducing Agent]

In the invention, as the reducing agent (silver ion reducing agent), especially as at least one type of the reducing agents, the compound represented by the above Formula (1) is used alone or in combination with the other reducing agent having a different chemical structure. By the use of these reducing agents with high activity, it is possible to obtain the photothermographic imaging material with high density which is excellent in light radiated image stability.

Formula (1)

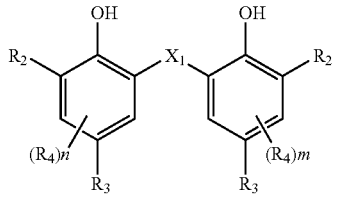

In the formula, $X_1$ represents chalcogen atom or —$CHR_1$— ($R_1$ represents hydrogen, halogen, alkyl group, alkenyl group, aryl group or heterocyclic group) and $R_2$ represents alkyl group. The two $R_2$s can be either same or different, and at least one of them is secondary or tertiary alkyl group. $R_3$ represents hydrogen atom or a group which can be a substituent on a benzene ring. $R_4$ represents a group which can be a substituent on a benzene ring. m and n represent integer of 0 to 2 respectively.

Further in the invention, it is preferable that the compound which is represented by following Formula (2) is used in combination with the compound represented by Formula (1) in order to obtain preferable color tone.

Formula (2)

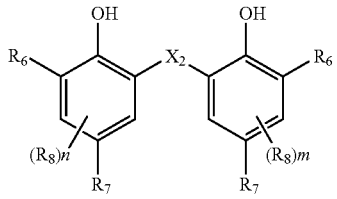

In the formula, $X_2$ represents chalcogen atom or —$CHR_5$— ($R_5$ represents hydrogen, halogen, alkyl group, alkenyl group, aryl group or heterocyclic group) and $R_6$ represents alkyl group. The two $R_6$s can be either same or different, but are not secondary or tertiary alkyl group. $R_7$ represents hydrogen atom or a group which can a substituent on a benzene ring. $R_8$ represents a group which can be a substituent on a benzene ring. m and n represent integer of 0 to 2 respectively.

As for the ratio of combination usage between the compounds represented by Formula (1) and Formula (2), the ratio (mass of the compound represented by Formula (1)): (mass of the compound represented by Formula (2)) is preferably 5:95 to 45:55, more preferably 10:90 to 40:60.

The chalcogen atom represented by $X_1$ in the Formula (1) includes sulfur atom, selenium atom and tellurium atom, and preferably sulfur atom. The halogen atom represented by $R_1$ in —$CHR_1$— includes fluorine atom, chlorine atom and bromine atom. As the alkyl group, preferred is alkyl group with 1 to 20 carbon atoms, which is substituted or not substituted. Concrete examples of the alkyl group include methyl, ethyl, propyl, buthyl, hexyl, heptyl groups and the like. The alkenyl group includes, for example, vinyl, allyl, butenyl, hexenyl, hexadienyl, ethenyl-2-propenyl, 3-butenyl, 1-methyl-3-propenyl, 3-pentenyl, 1-methyl-3-butenyl groups and the like. The aryl group includes, for example, benzene, naphthalene rings and the like. The heterocyclic group includes, for example, thiophene, furan, imidazole, pyrazole, pyrrole and the like.

These groups may have substituents, and the substituents specifically include halogen atoms (fluorine atom, chlorine atom, bromine atom, etc.), alkyl groups (methyl group, ethyl group, propyl group, butyl group, pentyl group, i-pentyl group, 2-ethylhexyl group, octyl group, decyl group, etc.), cyclohexyl groups (cyclohexyl group, cycloheptyl group, etc.), alkenyl groups (ethenyl-2-propenyl group, 3-butenyl group, 1-methyl-3-propenyl group, 3-pentenyl group, 1-methyl-3-butenyl group, etc.), cycloalkenyl groups (1-cycloalkenyl group, 2-cycloalkenyl group, etc.), alkynyl groups (ethynyl group, 1-propinyl group, etc.), alkoxy groups (methoxy group, ethoxy group, propoxy group, etc.), alkylcarbonyloxy groups (acetyloxy group, etc.), alkylthio groups (methylthio group, trifluoromethylthio group, etc.), carboxyl groups, alkylcarbonylamino groups (acetylamino group, etc.), ureido groups (methylaminocarbonylamino group, etc.), alkylsulfonylamino groups (methanesulfonylamino group, etc.), alkylsulfonyl groups (methanesulfonyl group, trifluoromethanesulfonyl group, etc.), carbamoyl groups (carbamoyl group, N,N-dimethylcarbamoyl group, N-morpholinocarbamoyl group, etc.), sulfamoyl groups (sulfamoyl group, N,N-dimethylsulfamoyl group, morpholinosulfamoyl group, etc.), trifluoromethyl groups, hydroxyl groups, nitro groups, cyano groups, alkylsulfonamide groups (methanesulfonamide group, butanesulfonamide group, etc.), amino group, alkylamino groups (N,N-dimethylamino group, N,N-diethylamino group, etc.), sulfo group, phosphono group, sulfite group, sulfino groups, alkylsulfonylaminocarbonyl groups (methanesulfonylaminocarbonyl group, ethanesulfonylaminocarbonyl group, etc.), alkylcarbonylaminosulfonyl groups (acetoamidesulfonyl group, methoxyacetoamidesulfonyl group, etc.), alkynylaminocarbonyl groups (acetoamidecarbonyl group, methoxyacetoamidecarbonyl group, etc.), alkylsulfinylaminocarbonyl groups (methanesulfinylaminocarbonyl group, ethanesulfinylaminocarbonyl group, etc.) and the like. Also when the substituents are two or more, they may be the same or different. The especially preferable substituents are alkyl groups.

$R_2$ represent alkyl groups. Concretely the alkyl groups are preferably those with 1 to 20 carbons, which are substituted or unsubstituted, and specifically include methyl groups, ethyl groups, propyl groups, i-propyl groups, butyl groups, i-butyl groups, t-butyl groups, t-pentyl groups, t-octyl groups, cyclohexyl groups, cyclopentyl groups, 1-methylcyclohexyl groups, 1-methylcyclopropyl group and the like. The two $R_2$s may be the same or different, but preferably at least one is a secondary or tertiary alkyl group.

The substituents of the alkyl groups are not especially limited, and include, for example, aryl groups, hydroxyl groups, alkoxy groups, aryloxy groups, alkylthio groups, arylthio groups, acylamino groups, sulfonamide groups, sulfonyl groups, phosphoryl groups, acyl groups, carbamoyl groups, ester group, halogen atoms and the like.

And the substituent may form a saturated ring together with $(R_4)_n$ and $(R_4)_m$.

Both $R_2$ are preferably secondary or tertiary alkyl groups, and 2 to 20 carbons are preferable. They are more preferably tertiary alkyl groups, still preferably t-butyl, t-pentyl, 1-methylcyclohexyl, and most preferably t-butyl.

$R_3$ represents a group capable of being substituted on a benzene ring. The groups capable of being substituted on the benzene ring include, for example, halogen atoms such as fluorine, chlorine and bromine, alkyl, aryl, cycloalkyl, alkenyl, cycloalkenyl, alkynyl, amino, acyl, acyloxy, acylamino, sulfonylamino, sulfamoyl, carbamoyl, alkylthio, sulfonyl, alkylsulfonyl, sulfinyl, cyano, heterocyclic groups and the like.

The groups capable of being substituted on the benzene ring represented by $R_3$ preferably includes methyl, ethyl, i-propyl, t-butyl, cyclohexyl, 1-methylcyclohexyl, 2-hydroxyethyl and the like. More preferably $R_3$ is methyl or 2-hydroxyethyl.

These groups may further have substituents, and as the substituents, the substituents included the groups which $R_1$ includes given in the description of $R_1$ can be used.

$R_3$ is preferably the alkyl group with 1 to 20 carbons having hydroxyl group or the precursor group thereof, and more preferably the alkyl group with 1 to 5 carbons. Most preferably, it is 2-hydroxyethyl. In the most preferable combination of $R_2$ and $R_3$, $R_2$ is tertiary alkyl group (t-butyl, 1-methylcyclohexyl, etc.) and $R_3$ is primary alkyl group having hydroxyl group or the precursor group thereof (2-hydroxyethyl, etc.). Two $R_2$s and Two $R_3$s may be the same or different.

$R_4$ represents a group capable of being substituted on benzene ring, and specifically can include alkyl groups with 1 to 25 carbons (for example, methyl group, ethyl group, propyl group, i-propyl group, t-butyl group, pentyl group, hexyl group, cyclohexyl group, etc.), alkyl halide groups (trifluoromethyl group, perfluorooctyl group, etc.), cycloalkyl groups (cyclohexyl group, cyclopentyl group, etc.), alkynyl groups (propargyl group, etc.), glycidyl groups, acrylate groups, methacrylate groups, aryl groups (phenyl group, etc.), heterocyclic groups (pyridyl group, thiazolyl group, oxazolyl group, imidazolyl group, furyl group, pyrrolyl group, pyrazinyl group, pyrimidinyl group, pyridazinyl group, selenazolyl group, suliforanyl group, piperidinyl group, pyrazolyl group, tetrazolyl group, etc.), halogen atoms (chlorine atom, bromine atom, iodine atom, fluorine atom), alkoxy groups (methoxy group, ethoxy group, propyloxy group, pentyloxy group, cyclopentyloxy group, hexyloxy group, cyclohexyloxy group, etc.), aryloxy groups (phenoxy group, etc.), alkoxycarbonyl groups (methyloxycarbonyl group, ethyloxycarbonyl group, butyloxycarbonyl group, etc.), aryloxycarbonyl groups (phenyloxycarbonyl group, etc.), sulfonamide groups (methanesulfonamide group, ethanesulfonamide group, butanesulfonamide group, hexanesulfonamide group, cyclohexanesulfonamide group, benzenesulfonamide group, etc.), sulfamoyl groups (aminosulfonyl group, methylaminosulfonyl group, dimethylaminosulfonyl group, butylaminosulfonyl group, hexylaminosulfonyl group, cyclohexylaminosulfonyl group, phenylaminosulfonyl group, 2-pyridylaminosulfonyl group, etc.), urethane groups (methylureido group, ethylureido group, pentylureido group, cyclohexylureido group, phenylureido group, 2-pyridylureido, etc.), acyl groups (acetyl group, propionyl group, butanoyl group, hexanoyl group, cyclohexanoyl group, benzoyl group, pyridinoyl group, etc.), carbamoyl groups (aminocarbonyl group, methylaminocarbonyl group, dimethylaminocarbonyl group, propylaminocarbonyl group, pentylaminocarbonyl group, cyclohexylaminocarbonyl group, phenylaminocarbonyl group, 2-pyridylaminocarbonyl group, etc.), amide groups (acetamide group, propionamide group, butanamide group, hexanamide group, benzamide group, etc.), sulfonyl groups (methylsulfonyl group, ethylsulfonyl group, butylsulfonyl group, cyclohexylsulfonyl group, phenylsulfonyl group, 2-pyridylsulfonyl group, etc.), amino groups (amino group, ethylamino group, dimethylamino group, butylamino group, cyclopentylamino group, anilino group, 2-pyridylamino group, etc.), cyano group, nitro group, sulfo group, carboxyl group, hydroxyl group, oxamoyl group, and the like. These groups may be further substituted with these groups. And, n and m represent integers of 0 to 2, and most preferably both n and m are 0. n and m being 0 represents that $R_4$ is a hydrogen atom. When there are a plurality of $R_4$, $R_4$s can be same or different.

Also, $R_4$ may form a saturated ring together with $R_2$ and $R_3$. $R_4$ is preferably a hydrogen, halogen atom or an alkyl group, and more preferably the hydrogen atom.

In the Formula (2), $R_5$, $R_7$ and $R_8$ are as same as $R_1$, $R_3$ and $R_4$ in the Formula (1) respectively.

The two alkyl groups represented by $R_6$ are same or different, but are not secondary or tertiary alkyl group. The alkyl groups represented by $R_6$ are preferably substituted or unsubstituted alkyl groups of 1 to 20 carbon atoms, concretely including methyl group, ethyl group, propyl group, buthyl group and the like.

These groups may have substituents, and the substituents are not specifically limited. For example, the groups include aryl group, hydroxy group, alkoxyl group, aryloxy group, alkylthio group, arylthio group, acylamino group, sulfoamide group, sulfonyl group, phosphoryl group, acyl group, carbamoyl group, ester group, halogen atom and the like.

Also, $(R_8)_n$ and $(R_8)_m$ can form saturated rings.

$R_6$ is preferably methyl group.

Among the compounds represented by Formula (2), preferable are compounds which fulfill the Formula (S) and Formula (T) disclosed in EP 1278101 Specification, and concretely included are compounds of (1-24) to (1-54), (1-56) to (1-75) disclosed on page 21 to 28.

Hereinafter, specific examples of the compounds represented by the Formulas (1) and (2), but the compounds represented by the Formulas (1) and (2) are not limited thereto.

1-1

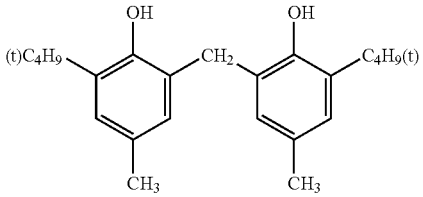

1-2

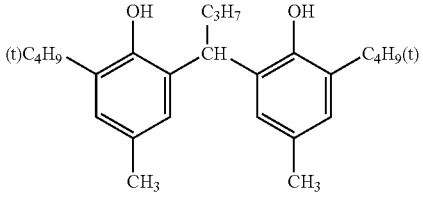

1-3

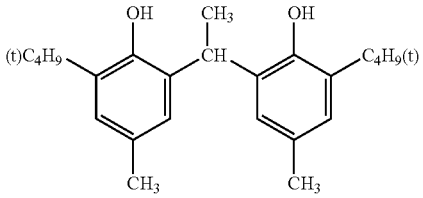

1-4

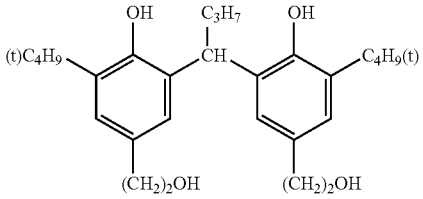

1-5

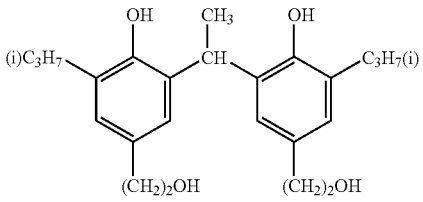

1-6

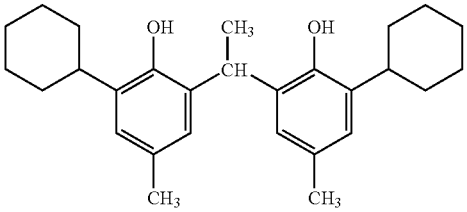

-continued 1-7

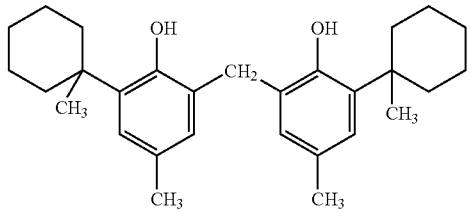

1-8

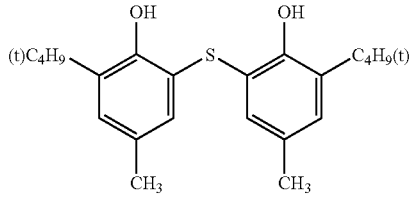

1-9

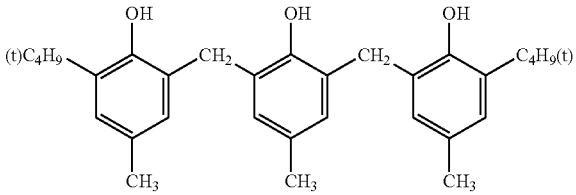

1-10

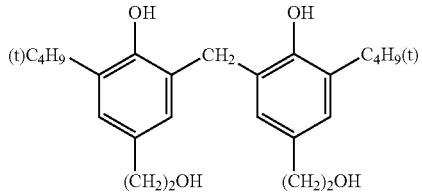

2-1

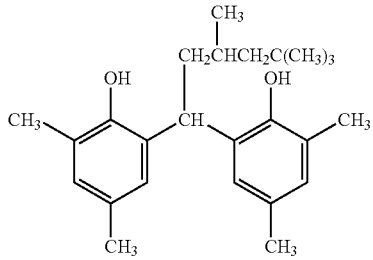

2-2

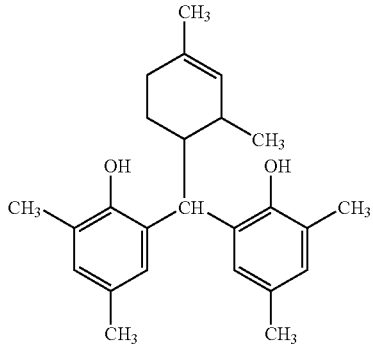

-continued

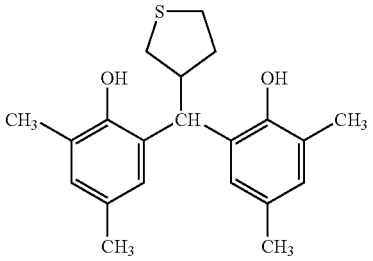

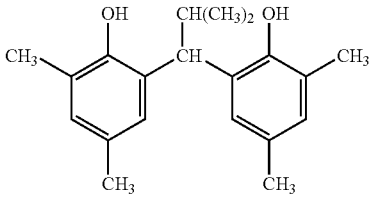

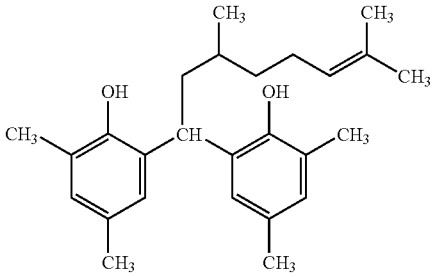

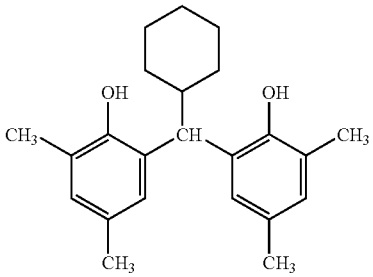

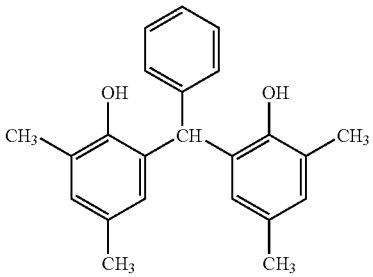

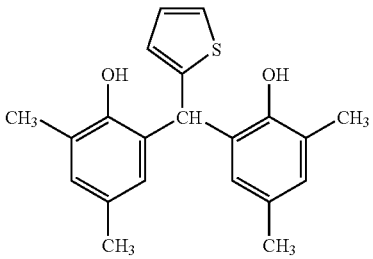

2-3 The above bisphenol compounds represented by Formulas (1) and (2) can be easily synthesized by methods known in earlier development.

The reducing agents contained are those which reduce the organic silver salt to form silver images. In the invention, other reducing agents can be used in combination with the above reducing agents for example, the reducing agents disclosed in U.S. Pat. Nos. 3,770,448, 3,773,512, and 3,593,863, Research Disclosure (hereinafter, abbreviated as RD) 17029 and 29963, JP Tokukaihei-11-119372A and JP Tokukai-2002-62616A can be used.

2-4 The use amount of the reducing agents including the compounds represented by the above Formula (1) are preferably from $1\times10^{-2}$ to 10 mol, and especially preferably from $1\times10^{-2}$ to 1.5 mol per 1 mol of the silver.

The bisphenol compounds represented by the Formulas (1) and (2) can be contained in applying solution by given methods and thus can be contained in the photoconductive material.

2-5 Further in the photothermographic imaging material of the invention, as developing promoting agent used in combination with the above reducing agent, hydrazine derivatives, phenol derivatives and naphthol derivatives represented by the Formulas (1) to (4) disclosed in JP Tokukai-2003-43614A and the Formulas (1) to (3) disclosed in JP Tokukai-2003-66559A are preferably used.

[Color Tones of Images]

Next, described are color tones of the images obtained by thermally developing the photothermographic imaging material.

2-6 Concerning the color tone of the output images for medical diagnosis such as X-ray films in earlier technology, it is said that more accurate diagnostic observation results of the recorded image are easily obtained for interpreting persons in image tone with cooler tone. Here, it is said that the image tone with cool tone is blue-black tone where pure black or black images take on a blue tinge and that the image tone with warm tone is warm-black tone where black images take on a brown tinge. But, so as to perform more strict and quantitative discussions, the color tones are described below on the basis of the expression recommended by International Commission on Illumination (CIE, Commission Internationale de l'Eclairage).

2-7 The terms for the color tones, "cooler tone" and "warmer tone" can be expressed by a hue angle, $h_{ab}$ at the minimum density Dmin and at the optical density D=1.0. That is, the hue angle $h_{ab}$ is obtained by the following formula using color coordinates, a* and b* in a color space, L*a*b* which is the color space with perceptually nearly equal paces, recommended by International Commission on Illumination (CIE) in 1976.

$$hab=\tan^{-1}(b^*/a^*)$$

2-8 As a result of investigating by the expression on the basis of the above hue angle, it has been found that the color tone of the silver salt photothermal photographic imaging material according to the invention after the development is preferably in the range of hue angle hab of 180 degree <hab< 270 degree, more preferably 200 degree <hab< 270 degree, and most preferably 220 degree <hab< 260 degree. This is disclosed in JP Tokukai-2002-6463A.

It has been known in earlier technology that diagnostic images with visually preferable color tone are obtained by adjusting u* and v* or a* and b* at the color space CIE 1976 (L*u*v*) or (L*a*b*) at the optical density of around 1.0 to the certain numerical values, and for example it is described in JP Tokukai-2000-29164A.

However, as a result of further intensive study on the photothermographic imaging material of the invention, it has been found to have diagnosability equivalent to or more than that of the wet type silver salt imaging materials in earlier technology by adjusting a linear regression straight line to the certain range when the linear regression straight line is made by plotting u* and v* or a* and b* at various photographic densities on a graph where a horizontal axis is made u* or a* and a vertical axis is made v* or b* in CIE 1976 (L*u*v*) color space or (L*a*b*) color space. The preferable ranges are described below.

(1) It is preferable that a coefficient of determination (multiple determination) $R^2$ of the linear regression straight line is 0.998 to 1.000 when the linear regression straight line is made by measuring each density at the optical density of 0.5, 1.0, 1.5 and the minimum of the silver image obtained after the thermal development processing of the photothermographic imaging material and disposing u* and v* at the above each optical density on two dimensional coordinates where the horizontal axis is made u* and the vertical axis is made v* of the CIE 1976 (L*u*v*) color space.

Further it is preferred that a v* value of an intersecting point of the linear regression straight line with the vertical axis is −5 to 5 and a slope (v*/u*) is 0.7 to 2.5.

(2) Also, it is preferable that the coefficient of determination (multiple determination) $R^2$ of a linear regression straight line is 0.998 or more and 1.000 or less when the linear regression straight line is made by measuring each density at the optical density of 0.5, 1.0, 1.5 of the above photothermographic imaging material and the minimum of the material and disposing a* and b* at the above each optical density on two dimensional coordinates where the horizontal axis is made a* and the vertical axis is made b* of the CIE 1976 (L*a*b*) color space.

Further, it is preferred that a b* value of an intersecting point of the linear regression straight line with the vertical axis is −5 to 5 and a slope (b*/a*) is 0.7 to 2.5.

Next, described is the method for making the above linear regression straight line, i.e., one example of the method for measuring u*, v* and a*, b* in the CIE 1976 color space.

A four stage wedge sample including an unexposed part and parts of the optical density of 0.5, 1.0 and 1.5 is made using the thermal development apparatus. Each wedge density made in this way is measured using a spectral calorimeter (e.g., CM-3600d supplied from Minolta Co., Ltd.), and u*, v* or a*, b* are calculated. As a measurement condition at that time, a light source is F7 light source, an angle of field is 10°, and the measurement is carried out in a transmission measurement mode. The measured u*, v* or a*, b* are plotted on the graph where the horizontal axis is made u* or a* and the vertical axis is made v* or b* to obtain the linear regression straight line, from which the coefficient of determination (multiple determination) $R^2$, an intercept and the slope are obtained.

Next, described are specific methods for obtaining the linear regression straight line with the above characteristics.

In the invention, it is possible to optimize the developed silver shape and make the preferable color tone by regulating the addition amounts of the compounds directly and indirectly involved in the development reaction process, such as the following toning agent, developer, silver halide grains and aliphatic silver carboxylate and the like. For example, when the developed silver shape is made into dendrite, the image is prone to take on a blue tinge and when it is made into filament, the image is prone to take on a yellow tinge. That is, the color tone can be regulated by considering such tendencies of the developed silver shape.

In earlier technology, as the toning agents, phthalazinone or phthalazine and phthalic acids, phthalic acid anhydrides are generally used. Examples of the suitable toning agents are disclosed in RD 17029, U.S. Pat. Nos. 4,123,282, 3,994,732, 3,846,136, 4,021,249 and the like.

In addition to such toning agents, it is also possible to adjust the color tone using the couplers disclosed in JP Tokukaihei-11-288057A and EP 1134611A2 Specification and leuco dyes described in detail below. Especially, it is preferable to use couplers and leuco dyes for fine adjustment of the color tone.

[Coupler]

The couplers represented by Formulas (CP1) and (CP2) can be used in the invention.

First, the coupler represented by the Formula (CP1) will be described.

Formula (CP1)

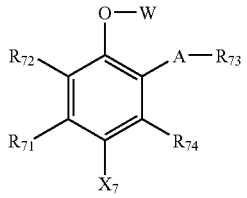

In the formula, $R_{71}$ is hydrogen atom, halogen atom, substituted or unsubstituted alkyl, alkoxy and —NHCO—R group (R represents an alkyl, aryl or heterocyclic group). A represents —NHCO—, —CONH— or —NHCONH— group, and $R_{73}$ represents a substituted or unsubstituted alkyl, aryl or heterocyclic group. Also, -A-$R_{73}$ may be a hydrogen atom. W represents a hydrogen atom or —CONH—$R_{75}$, —CO—$R_{75}$ or —CO—O—$R_{75}$ group ($R_{75}$ represents a substituted or unsubstituted alkyl, aryl or heterocyclic group.), and $R_{72}$ and $R_{74}$ represent hydrogen atoms, halogen atoms, a substituted or unsubstituted alkyl, alkenyl, alkoxy, carbamoyl or nitrile groups. $X_7$ represents a hydrogen atom or a group which can be eliminated by oxidation coupling reaction with main developing agent.

In the Formula (CP1), as the halogen atom represented by $R_{71}$, included are for example fluorine atom, bromine atom, chlorine atom and the like. As the alkyl group represented by $R_{71}$, included are the alkyl groups with up to 20 carbon atoms (e.g., methyl, ethyl, butyl, dodecyl groups, etc.). As the alkoxy group represented by $R_{71}$, included are the alkoxy group with up to 20 carbon atoms (e.g., methoxy, ethoxy groups, etc.). Also, in —NHCO—R, as the alkyl, aryl and heterocyclic groups represented by R, included are the alkyl groups with up to 20 carbon atoms (e.g., methyl, ethyl, butyl, dodecyl, etc.), the aryl group with 6 to 20 carbon atoms such as phenyl group, naphthyl group and thienyl group, and the heterocyclic group such as thiophene, furan, imidazole, pyrazole and pyrrole groups, respectively. The alkyl group represented by $R_{73}$ are preferably the alkyl groups with up to 20 carbon atoms, and for example, included are methyl group, ethyl group, butyl group, dodecyl group and the like. The aryl groups represented by $R_{73}$ are preferably the aryl groups with 6 to 20 carbon atoms, and for example, included are phenyl group, naphthyl group, thienyl group and the like. As the heterocyclic groups represented by $R_{73}$, included are thiophene group, furan group, imidazole group, pyrazole group, pyrrole group and the like.

The alkyl groups represented by $R_{75}$ are preferably the alkyl groups with up to 20 carbon atoms, and for example, included are methyl group, ethyl group, butyl group, dodecyl group and the like, the aryl groups represented by $R_{75}$ are preferably the aryl groups with 6 to 20 carbon atoms, and for example, included are phenyl group, naphthyl group, thienyl group and the like, and as the heterocyclic groups represented by $R_{75}$, included are, for example, thiophene, furan, imidazole, pyrazole, pyrrole groups and the like.

The halogen atoms represented by $R_{72}$ and $R_{74}$, for example, included are fluorine, chlorine, bromine, iodine groups and the like. As the alkyl groups, for example, included are the chain or cyclic alkyl groups such as methyl, butyl, dodecyl and cyclohexyl groups. As alkoxy groups represented by $R_{72}$ and $R_{74}$, for example, included are methoxy, butoxy, tetradecyloxy groups and the like. The carbamoyl groups represented by $R_{72}$ and $R_{74}$, for example, included are diethylcarbamoyl, phenylcarbamoyl groups and the like. In these, the hydrogen atom and the alkyl group are more preferable.

Also, $R_{71}$ and $R_{72}$ can form an aromatic or aliphatic hydrocarbon ring by linking each other, and $R_{73}$ and $R_{74}$ can form a cyclic structure by linking each other.

The above groups can further have a single substituent or multiple substituents. As the typical substituents which can be typically introduced to a aryl group, included are halogen atoms (e.g., fluorine, chlorine, bromine atoms, etc.), alkyl groups (e.g., methyl, ethyl, propyl, butyl, dodecyl, etc.), hydroxy groups, cyano groups, nitro groups, alkoxy groups (e.g., methoxy, ethoxy, etc.), alkylsulfonamide groups (e.g., methylsulfonamide, octylsulfonamide, etc.), arylsulfonamide groups (e.g., phenylsulfonamide, naphthylsulfonamide, etc.), alkylsulfamoyl groups (e.g., butylsulfamoyl, etc.), arylsulfamoyl groups (e.g., phenylsulfamoyl, etc.), alkyloxycarbonyl groups (e.g., methoxycarbonyl, etc.), aryloxycarbonyl groups (e.g., phenyloxycarbonyl, etc.), aminosulfonamide groups, acylamino groups, carbamoyl groups, sulfonyl groups, sulfinyl groups, sulfoxy groups, sulfo groups, aryloxy groups, alkoxy groups, alkylcarbonyl groups, arylcarbonyl groups, aminocarbonyl groups and the like.

R and $R_{75}$ are preferably phenyl group, and more preferably the phenyl group having multiple substituents including halogen atoms and cyano groups.

The group represented by $X_7$, which can be eliminated by oxidation coupling reaction with main developing agent includes, for example, halogen atom (fluorine, chlorine, bromine, iodine, etc.), alkoxyl group (ethoxy, dodecyloxy, methoxyethylchalbamoil, carboxymethoxy, methylsulfonylethoxy groups, etc.), aryloxy group (phenoxy, naphtyloxy, 4-carboxyphenoxy group, etc.), acyloxy group (acetoxy, tetradecanoyloxy, benzoyloxy, etc.), sulfonyloxy group (methane sulfonyloxy, toluene sulfonyloxy, etc.), amide group (dichloroacetylamino, hepthafluorobutyrylamino, toluenesulfonyl amino, etc.), alkoxycarbonyloxy group (ethoxycarbonyloxy, dodecylcarbonyloxy, hexadecyloxycarbonyloxy, benzyloxycarbonyl, etc.), aryloxycarbonyloxy group (phenoxycarbonyloxy, etc.), thio group (phenylthio, tetrazolylthio, etc.), imide group (succinimide, hidantoinyl, etc.), azo group (phenylazo, etc.), aminocarbonyloxy group (N,N-diethylaminocarbonyloxy, N-methyl-N-octadecylaminocarbonyloxy, etc.), and the like. Among them, halogen atom, alkoxycarbonyloxy group and aminocarbonyloxy group are more preferable. These groups which can be eliminated by oxidation coupling reaction with main developing agent can include photographically functionable groups.

Next, the concrete examples of the compounds represented by the Formula (CP1) (exemplified compound CP1-1 to CP1-8) will be noted, but the compounds represented by the Formula (CP1) used in the invention are not limited thereto.

CP 1-1

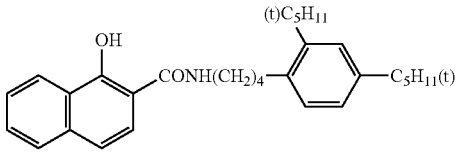

CP 1-2

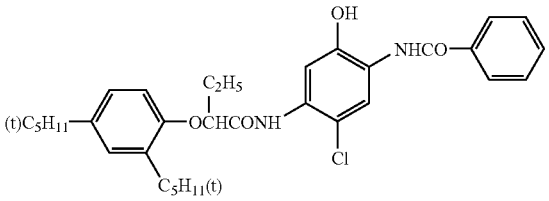

CP 1-3

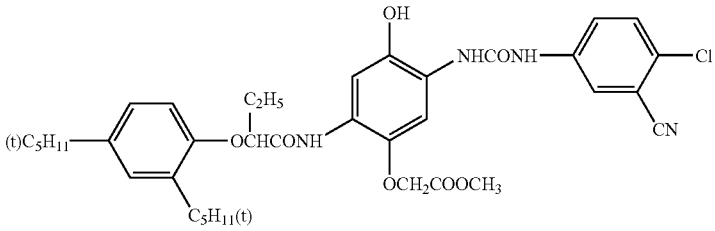

-continued

CP 1-4

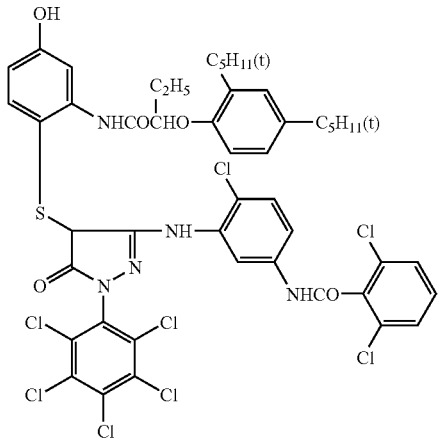

CP 1-5

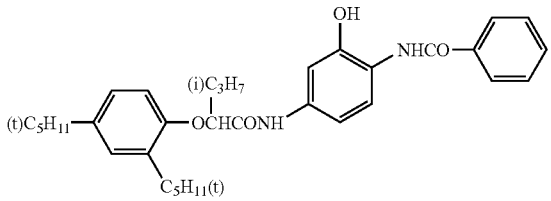

CP 1-6

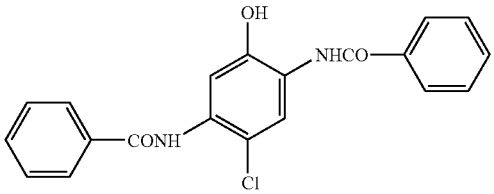

CP 1-7

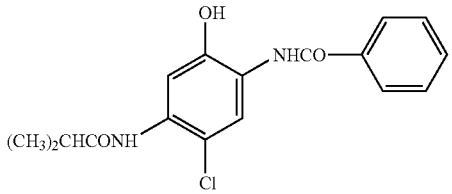

CP 1-8

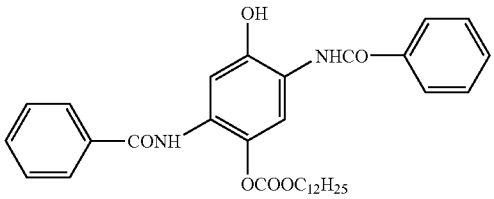

In the invention, as main developing agent which form the coloring image by reacting with couplers, given as examples are the main developing agents represented as the Formula (1) disclosed in JP Tokukaihei 11-288057A, concretely the compounds of 1 to 25 noted in [0040] to [0043] and the compounds represented as the Formula (2) disclosed in JP Tokukai-2002-318432, concretely the compounds D-101 to D154 noted in [0061] to [0069]. These main developing agent is preferably used 0.1 to 100% by mol with respect to the reducing agent used in the invention (for example, total amount of the compounds represented by the Formulas (1) and (2)), and more preferably is used 1 to 10% by mol.

The amount ratio of the coupler to be added to the compound represented by the Formula (1) and Formula (2) is preferably 0.001 to 0.2 by mol, more preferably 0.005 to 0.1 by mol.

In the invention, the sum of the maximum density at maximum absorption wavelength of coloring agent image formed by the couplers and the main developing agents is 0.01 or more and 0.50 or less, preferably 0.01 or more and 0.30 or less, and especially preferably 0.02 or more and 0.20 or less.

Next, concrete examples of the main developing agent which form a coloring image by reacting with the couplers (exemplified compound D-1 to D-7) are given, but the main developing agent which form a coloring image by reacting with the couplers are not limited thereto.

D-1

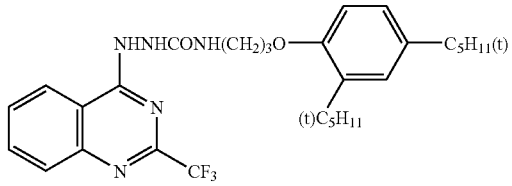

D-2

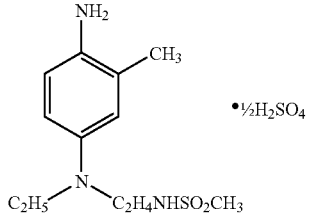

-continued

D-3

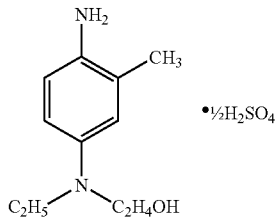

D-4

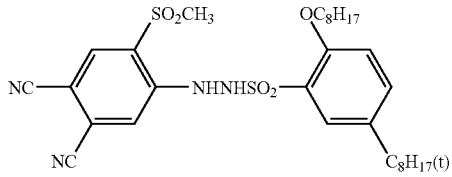

D-5

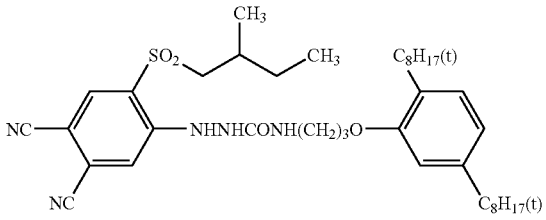

D-6

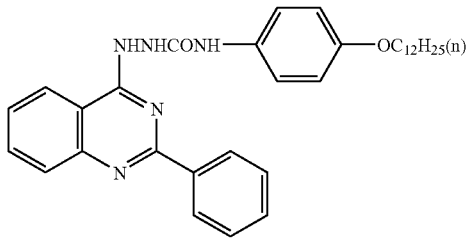

D-7

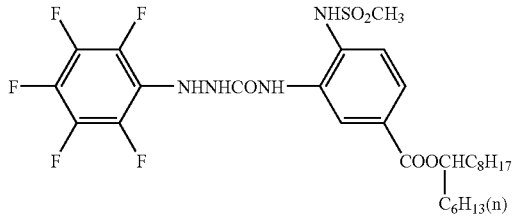

In the invention, when the couplers represented by the Formula (CP2) is used as the coupler for regulating color tone, color image forming agent in which the absorbance at 600 to 700 nm is increased by coupling reaction with the main developing agent is specially preferable.

Formula (CP2)

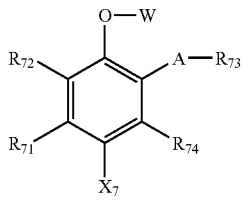

In the formula, $R_{71}$ and $R_{72}$ are hydrogen atoms, halogen atoms, substituted or unsubstituted alkyl, alkenyl, alkoxy and —NHCO—R groups (R represents an alkyl, aryl or heterocyclic group), or $R_{71}$ and $R_{72}$ are the groups which are bound one another to form an aliphatic hydrocarbon ring, aromatic hydrocarbon ring or heterocycle. A represents —NHCO—, —CONH— or —NHCONH— group, and $R_{73}$ represents a substituted or unsubstituted alkyl, aryl or heterocyclic group. Also, -A-$R_{73}$ may be a hydrogen atom. W represents a hydrogen atom or —CONH—$R_{75}$, —CO—$R_{75}$ or —CO—O—$R_{75}$ group ($R_{75}$ represents a substituted or unsubstituted alkyl, aryl or heterocyclic group.), and $R_{74}$ represents a hydrogen atom, halogen atom, a substituted or unsubstituted alkyl, alkoxy, carbamoyl or nitrile group. $X_7$ represents a hydrogen atom or a group which can be eliminated by oxidation coupling reaction with main developing agent.

In the Formula (CP2), as the halogen atoms represented by $R_{71}$ and $R_{72}$, included are for example fluorine atom, bromine atom, chlorine atom and the like. As the alkyl groups represented by $R_{71}$ and $R_{72}$, included are the alkyl groups with up to 20 carbon atoms (e.g., methyl, ethyl, butyl, dodecyl, etc.). As the alkenyl groups represented by $R_{71}$ and $R_{72}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As the alkoxy groups represented by $R_{71}$ and $R_{72}$, included are the alkoxy groups with up to 20 carbon atoms (e.g., methoxy, ethoxy groups, etc.). Also, in —NHCO—R, as the alkyl, aryl and heterocyclic groups represented by R, included are the alkyl groups with up to 20 carbon atoms (e.g., methyl, ethyl, butyl, dodecyl, etc.), the aryl groups with 6 to 20 carbon atoms such as phenyl group, naphthyl group and thienyl group, and the heterocyclic groups such as thiophene group, furan group, imidazole group, pyrazole group and pyrrole group, respectively.

The alkyl groups represented by $R_{73}$ are preferably the alkyl groups with up to 20 carbon atoms, and for example, included are methyl, ethyl, butyl, dodecyl and the like. The aryl groups represented by $R_{73}$ are preferably the aryl groups with 6 to 20 carbon atoms, and for example, included are phenyl, naphthyl, thienyl groups and the like. As the heterocyclic groups represented by $R_{73}$, included are thiophene, furan, imidazole, pyrazole, pyrrole groups and the like.

The alkyl groups represented by $R_{75}$ are preferably the alkyl groups with up to 20 carbon atoms, and for example, included are methyl, ethyl, butyl, dodecyl and the like. The aryl groups represented by $R_{75}$ are preferably the aryl groups with 6 to 20 carbon atoms, and for example, included are phenyl, naphthyl, thienyl groups and the like. As the heterocyclic groups represented by $R_{75}$, included are thiophene, furan, imidazole, pyrazole, pyrrole groups and the like.

The halogen atoms represented by $R_{74}$, for example, included are fluorine, chlorine, bromine, iodine groups and the like. As the alkyl groups represented by $R_{74}$, for example, included are methyl, butyl, dodecyl and cyclohexyl groups and the like. As alkoxy groups represented by $R_{74}$, for example, included are methoxy, butoxy, tetradecyloxy groups and the like. The carbamoyl groups represented by $R_{74}$, for example, included are diethylcarbamoyl, phenylcarbamoyl groups and the like. Also, nitrile groups are preferable. In these, the hydrogen atom and the alkyl group are more preferable.

The above $R_{71}$ and $R_{72}$, and $R_{73}$ and $R_{74}$ may be linked each other to form a cyclic structure.

The above groups can further have a single substituent or multiple substituents. As the typical substituents which can be introduced to a aryl group, included are halogen atoms (e.g., fluorine, chlorine, bromine atoms, etc.), alkyl groups (e.g., methyl, ethyl, propyl, butyl, dodecyl, etc.), hydroxy, cyano, nitro groups, alkoxy groups (e.g., methoxy, ethoxy, etc.), alkylsulfonamide groups (e.g., methylsulfonamide, octylsulfonamide, etc.), arylsulfonamide groups (e.g., phenylsulfonamide, naphthylsulfonamide, etc.), alkylsulfamoyl groups (e.g., butylsulfamoyl, etc.), arylsulfamoyl groups (e.g., phenylsulfamoyl, etc.), alkyloxycarbonyl groups (e.g., methoxycarbonyl, etc.), aryloxycarbonyl groups (e.g., phenyloxycarbonyl, etc.), aminosulfonamide, acylamino, carbamoyl, sulfonyl, sulfinyl, sulfoxy, sulfo, aryloxy, alkoxy, alkylcarbonyl, arylcarbonyl, aminocarbonyl groups and the like. Two different families among above families can be introduced to the aryl group.

R or $R_{75}$ is preferably phenyl group, and more preferably the phenyl group having multiple substituents including halogen atoms and cyano groups.

The group represented by $X_7$, which can be eliminated by oxidation coupling reaction with main developing agent includes, for example, halogen atom (fluorine, chlorine, bromine, iodine, etc.), alkoxyl group (ethoxy, dodecyloxy, methoxyethylchalbamoil, carboxymethoxy, methylsulfonylethoxy groups, etc.), aryloxy group (phenoxy, naphtyloxy, 4-carboxyphenoxy group, etc.), acyloxy group (acetoxy, tetradecanoyloxy, benzoyloxy, etc.), sulfonyloxy group (methane sulfonyloxy, toluene sulfonyloxy, etc.), amide group (dichloroacetylamino, hepthafluorobutyrylamino, toluenesulfonyl amino, etc.), alkoxycarbonyloxy group (ethoxycarbonyloxy, dodecylcarbonyloxy, hexadecyloxycarbonyloxy, benzyloxycarbonyl, etc.), aryloxycarbonyloxy group (phenoxycarbonyloxy, etc.), thio group (phenylthio, tetrazolylthio, etc.), imide group (succinimide, hidantoinyl, etc.), azo group (phenylazo, etc.), aminocarbonyloxy group (N,N-diethylaminocarbonyloxy, N-methyl-N-octadecylaminocarbonyloxy, etc.), and the like. Among them, halogen atom, alkoxycarbonyloxy group and aminocarbonyloxy group are more preferable. These groups which can be eliminated by oxidation coupling reaction with main developing agent can include photographically functionable groups.

Next, concrete examples of the compounds represented by the Formula (CP2) will be noted, but the concrete examples of the compounds represented by the Formula (CP2) is not limited thereto.

CP 2-1

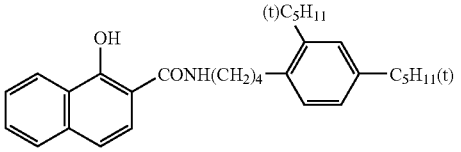

CP 2-2

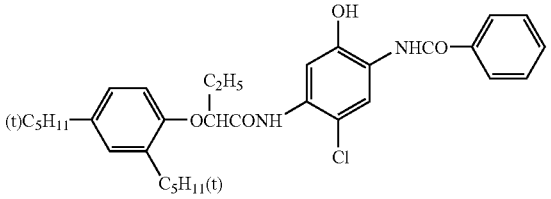

CP 2-3

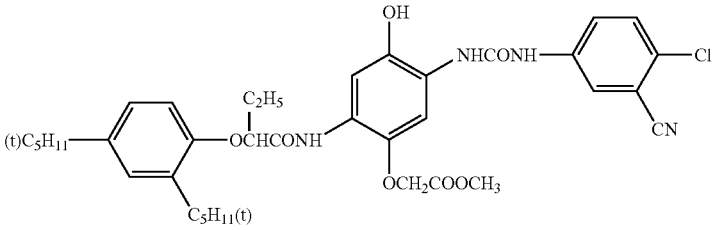

CP 2-4

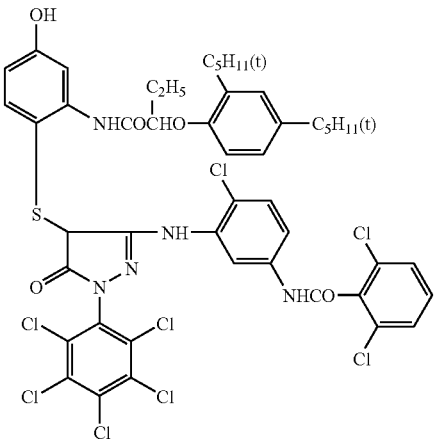

CP 2-5

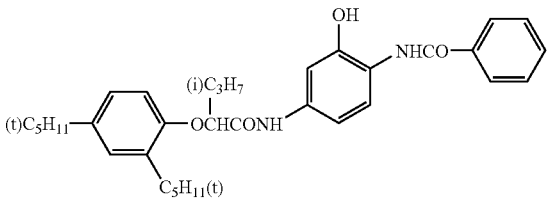

-continued

CP 2-6

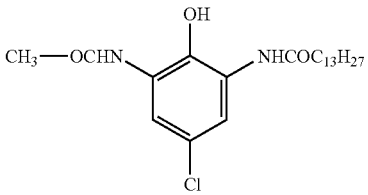

CP 2-7

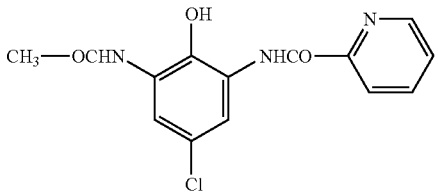

CP 2-8

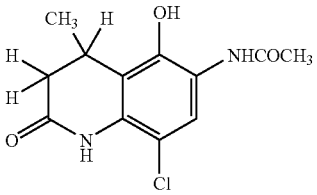

CP 2-9

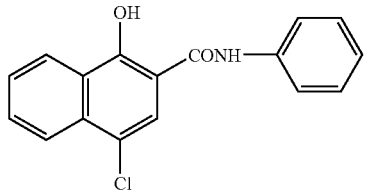

In the invention, as main developing agent which form the coloring image by reacting with couplers, given as examples are the main developing agents represented as the Formula (1) disclosed in JP Tokukaihei 11-288057A, concretely the compounds of 1 to 25 noted in [0040] to [0043] and the compounds represented as the Formula (2) disclosed in JP Tokukai-2002-318432, concretely the compounds D-101 to D154 noted in [0061] to [0069]. These main developing agent is preferably used 0.1 to 100% by mol with respect to the reducing agent used in the invention (for example, total amount of the compounds represented by the Formulas (1) and (2)), and more preferably is used 1 to 10% by mol.

The amount ratio of the coupler to be added to the compound represented by the Formula (1) and Formula (2) is preferably 0.001 to 0.2 by mol, more preferably 0.005 to 0.1 by mol.

It is preferable that coloring density is regulated properly in connection with the color tone of the developed silver itself. In the invention, the sum of the maximum density at maximum absorption wavelength of coloring agent image formed by the couplers and the main developing agents is 0.01 or more and 0.50 or less, preferably 0.01 or more and 0.30 or less, and especially preferably 0.02 or more and 0.20 or less.

Next, concrete examples of the main developing agent which form a coloring image by reacting with the couplers (exemplified compound D-1 to D-7) are given, but the main developing agent which form a coloring image by reacting with the couplers are not limited thereto.

D-1

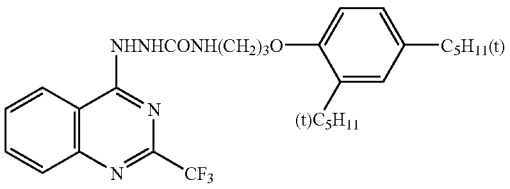

-continued

D-2

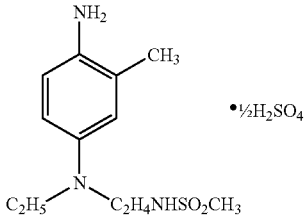

D-3

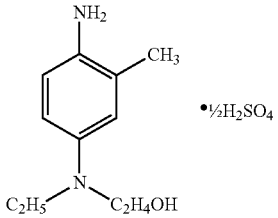

D-4

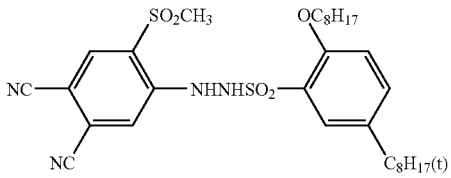

D-5

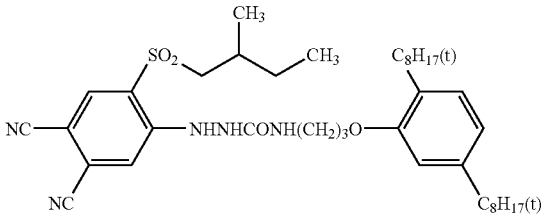

-continued

D-6

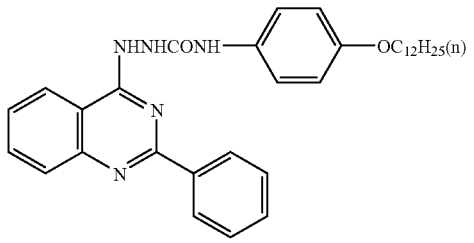

D-7

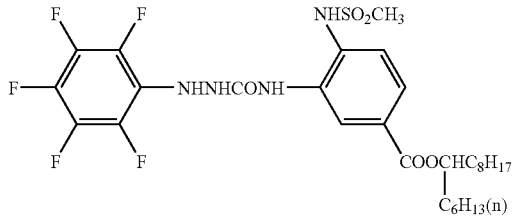

[Leuco Dye]

Leuco dyes can be used as the photothermographic imaging material of the invention. The leuco dyes could be any colorless or slightly colored compounds which become colored patterns by being oxidized when heated preferably at a temperature of about 80 to 200° C. for 0.5 to 30 sec, and it is possible to use any leuco dyes which are oxidized by the silver ions to form dyestuffs. Compounds having pH sensitivity and capable of being oxidized to the colored pattern are useful.

[Cyan Coloring Leuco Dye]

In the invention, cyan coloring leuco dye is preferably used as leuco dye in the invention.

Especially preferable as cyan coloring leuco dyes are color image forming agent in which the absorbance at 600 to 700 nm is increased by oxidation, which are compounds disclosed in JP Tokukaisho-59-206831A (particularly the compounds having λ max in a range of 600 to 700 nm), compounds represented by the Formulas (I) to (IV) disclosed in JP Tokukaihei-5-204087A, concretely compounds of (1) to (18) noted at [0032] to [0037] and compounds represented by the Formulas 4 to 7 disclosed in JP Tokukaihei-11-231460A (concretely the compounds of No. 1 to No. 7 noted at [0105]).

The cyan coloring leuco dye especially preferably used in the invention is represented by the following Formula (CL).

Formula (CL)

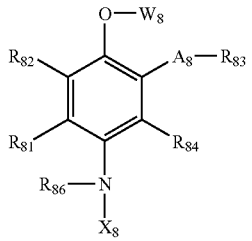

In the formula, $R_{81}$ and $R_{82}$ are hydrogen atoms, halogen atoms, substituted or unsubstituted alkyl, alkenyl, alkoxy and —NHCO—$R_{10}$ groups ($R_{10}$ represents an alkyl, aryl or heterocyclic group), or $R_{81}$ and $R_{82}$ are the groups which are bound one another to form an aliphatic hydrocarbon ring, aromatic hydrocarbon ring or heterocycle. $A_8$ represents —NHCO—, —CONH— or —NHCONH— group, and $R_{83}$ represents a substituted or unsubstituted alkyl, aryl or heterocyclic group. Also, -$A_8$-$R_{83}$ may be a hydrogen atom. $W_8$ represents a hydrogen atom or —CONH—$R_{85}$, —CO—$R_{85}$ or —CO—O—$R_{85}$ group ($R_{85}$ represents a substituted or unsubstituted alkyl, aryl or heterocyclic group.), and $R_{84}$ represents a hydrogen atom, halogen atom, a substituted or unsubstituted alkyl, alkoxy, carbamoyl or nitrile group. $R_{86}$ represents —CONH—$R_{87}$, —CO—$R_{87}$ or —CO—O—$R_{87}$ group ($R_{87}$ represents a substituted or unsubstituted alkyl, aryl or heterocyclic group.). $X_8$ represents a substituted or unsubstituted aryl or heterocyclic group.

In the Formula (CL), as the halogen atoms represented by $R_{81}$ and $R_{82}$, included are for example fluorine, bromine, chlorine atoms and the like. As the alkyl groups represented by $R_{81}$ and $R_{82}$, included are the alkyl groups with up to 20 carbon atoms (e.g., methyl, ethyl, butyl, dodecyl, etc.). As the alkenyl groups represented by $R_{81}$ and $R_{82}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As the alkoxy groups represented by $R_{81}$ and $R_{82}$, included are the alkoxy groups with up to 20 carbon atoms (e.g., methoxy, ethoxy groups, etc.). Also, in —NHCO—$R_{10}$, as the alkyl, aryl and heterocyclic groups represented by $R_{10}$, included are the alkyl groups with up to 20 carbon atoms (e.g., methyl, ethyl, butyl, dodecyl, etc.), the aryl groups with 6 to 20 carbon atoms such as phenyl, naphthyl and thienyl groups, and the heterocyclic groups such as thiophene, furan, imidazole, pyrazole and pyrrole groups, respectively.

The alkyl groups represented by $R_{83}$ are preferably the alkyl groups with up to 20 carbon atoms, and for example, included are methyl, ethyl, butyl, dodecyl and the like. The aryl groups represented by $R_{83}$ are preferably the aryl groups with 6 to 20 carbon atoms, and for example, included are phenyl, naphthyl, thienyl groups and the like. As the heterocyclic groups represented by $R_{83}$, included are thiophene, furan, imidazole, pyrazole, pyrrole groups and the like. In —CONH—$R_{85}$, —CO—$R_{85}$ or —CO—O—$R_{85}$ represented by $W_8$, the alkyl groups represented by $R_{85}$ are preferably the alkyl groups with up to 20 carbon atoms, and for example, included are methyl, ethyl, butyl, dodecyl and the like, the aryl groups represented by $R_{85}$ are preferably the aryl groups with 6 to 20 carbon atoms, and for example, included are phenyl, naphthyl, thienyl groups and the like, and as the heterocyclic groups represented by $R_{85}$, included are, for example, thiophene, furan, imidazole, pyrazole, pyrrole groups and the like.

The halogen atoms represented by $R_{84}$, for example, included are fluorine, chlorine, bromine, iodine groups and the like. As the alkyl groups represented by $R_{84}$, for example, included are the chain or cyclic alkyl groups such as methyl, butyl, dodecyl and cyclohexyl groups. As alkoxy groups represented by $R_{84}$, for example, included are methoxy, butoxy, tetradecyloxy groups and the like. The carbamoyl groups represented by $R_{84}$, for example, included are diethylcarbamoyl, phenylcarbamoyl groups and the like. Also, nitrile groups are preferable. In these, the hydrogen atom and the alkyl group are more preferable.

The above groups can further have a single substituent or multiple substituents. As the typical substituents, included are halogen atoms (e.g., fluorine, chlorine, bromine atoms, etc.), alkyl groups (e.g., methyl, ethyl, propyl, butyl, dodecyl, etc.), hydroxy, cyano, nitro groups, alkoxy groups (e.g., methoxy, ethoxy, etc.), alkylsulfonamide groups (e.g., methylsulfonamide, octylsulfonamide, etc.), arylsulfonamide groups (e.g., phenylsulfonamide, naphthylsulfonamide, etc.), alkylsulfamoyl groups (e.g., butylsulfamoyl, etc.), arylsulfamoyl groups (e.g., phenylsulfamoyl, etc.), alkyloxycarbonyl groups (e.g., methoxycarbonyl, etc.), aryloxycarbonyl groups (e.g., phenyloxycarbonyl, etc.), aminosulfonamide, acylamino, carbamoyl, sulfonyl, sulfinyl, sulfoxy, sulfo, aryloxy, alkoxy, alkylcarbonyl, arylcarbonyl, aminocarbonyl groups and the like.

$R_{10}$ or $R_{85}$ is preferably phenyl group, and more preferably the phenyl group having multiple halogen atoms and cyano groups as the substituents.

In —CONH—$R_{87}$, —CO—$R_{87}$ or —CO—O—$R_{87}$ group represented by $R_{86}$, the alkyl groups represented by $R_{87}$ are preferably the alkyl groups with up to 20 carbon atoms and for example included are methyl, ethyl, butyl, dodecyl groups and the like, the aryl groups represented by $R_{87}$ are preferably the aryl groups with 6 to 20 carbons and for example included are phenyl, naphthyl, thienyl groups and the like, and as the heterocyclic groups represented by $R_{87}$, for example included are thiophene, furan, imidazole, pyrazole and pyrrole groups and the like.

As the substituents which the groups represented by $R_{87}$, it is possible to give those which are give as the substituents included in the description for $R_{81}$ to $R_{84}$. The aryl groups represented by $X_8$ include the aryl groups with 6 to 20 carbon atoms such as phenyl, naphthyl and thienyl groups, and the heterocyclic groups represented by $X_8$ include thiophene, furan, imidazole, pyrazole and pyrrole groups and the like.

As the substituents of the groups represented by $X_8$, it is possible to give those which are given as the substituents included in the description for $R_{81}$ to $R_{84}$.

As the groups represented by $X_8$, preferable are the aryl or heterocyclic group having the alkylamino group (diethylamino, etc.) at a para-position.

These groups may comprise photographically useful groups.

Specific examples of the cyan coloring leuco dyes (CA) are shown below, but the cyan coloring leuco dye used for the invention is not limited thereto.

CA-1

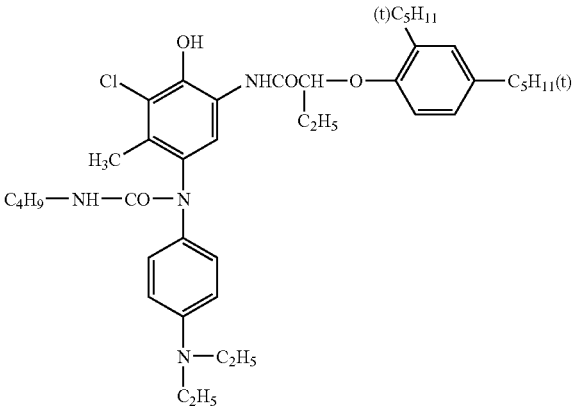

-continued

CA-2

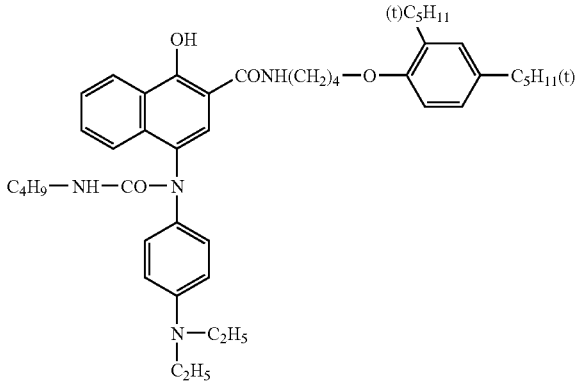

CA-3

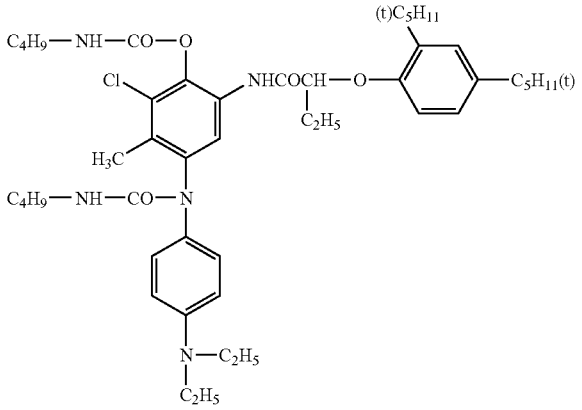

CA-4

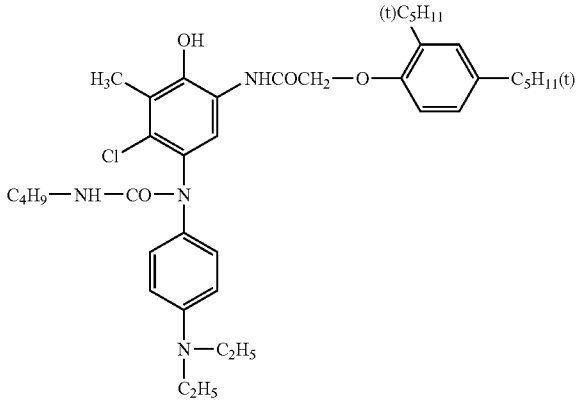

-continued
CA-5
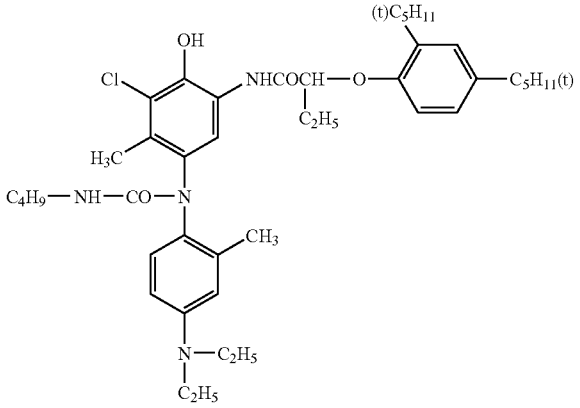
CA-6
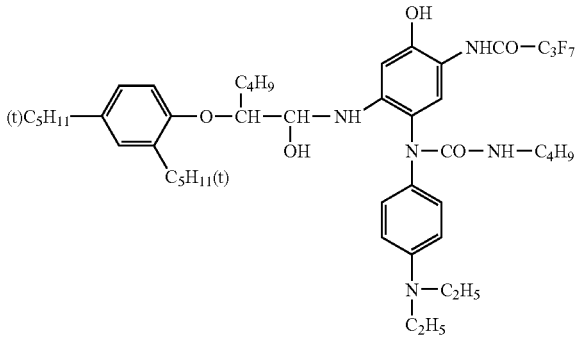
CA-7
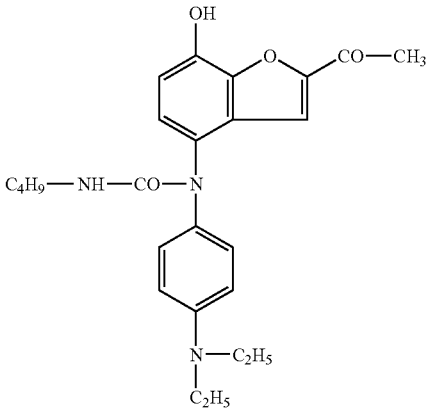
CA-8
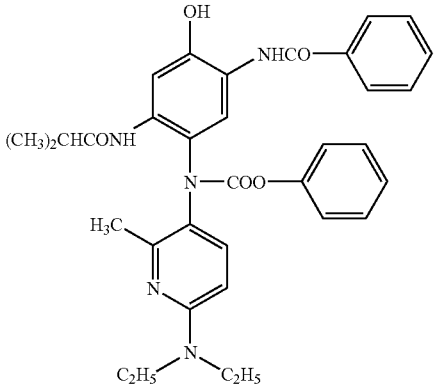
-continued
CA-9
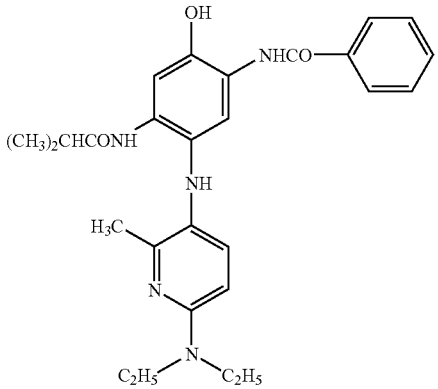
CA-10
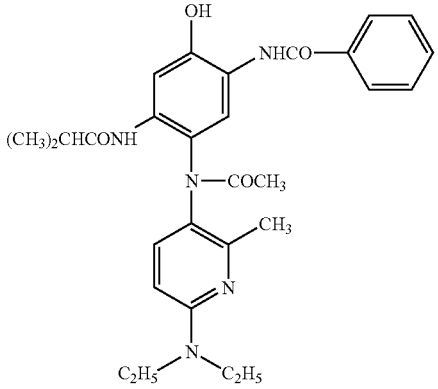
CA-11
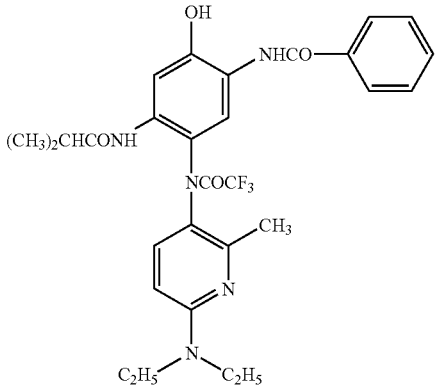
CA-12
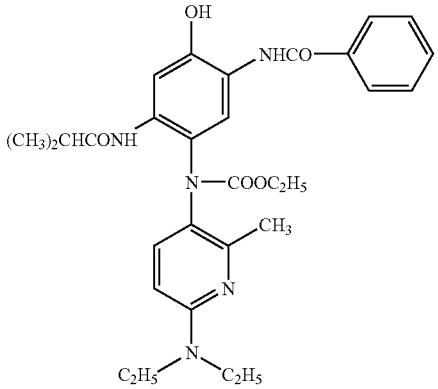
The addition amount of the cyan coloring leuco dye is typically from 0.00001 to 0.05 mol/1 mol of Ag, preferably from 0.0005 to 0.02 mol/1 mol of Ag, and more preferably from 0.001 to 0.01 mol/1 mol of Ag.

The amount ratio of the cyan leuco dye to be added to the compound represented by the Formula (1) and Formula (2) is preferably 0.001 to 0.2 by mol, more preferably 0.005 to 0.1 by mol.

In the invention, other leuco dyes can be used as well as the above cyan coloring leuco dyes.

The leuco dyes used in the invention is not specially limited. The representative leuco dyes include, for example, biphenol leuco dye, phenol leuco dye, indoaniline leuco dye, acrylated azine leuco dye, phenoxazine leuco dye, phenodiazine leuco dye and phenothiazine leuco dye and the like.

Also, useful are the leuco dyes disclosed in U.S. Pat. Nos. 3,445,234, 3,846,136, 3,994,732, 4,021,249, 4,021,250, 4,022,617, 4,123,282, 4,368,247, 4,461,681, and JP Tokukaisho-50-36110A, JP Tokukaisho-59-206831A, JP Tokukaihei-5-204087A, JP Tokukaihei-11-231460A, JP Tokukai-2002-169249A, JP Tokukai-2002-236334A and the like.

In the invention, the leuco dyes which develop a cyan color are used in order to prevent the color tone from excessively taking on a yellow tinge involved in the use of the reducing agent with high activity and especially prevent the image from excessively taking on a red tinge at high density parts where the density is 2.0 or more, but for the fine adjustment of the color tone, it is preferable to further combine leuco dyes which develop yellow color.

It is preferred that coloring density is properly adjusted in association with the color tone of the developed silver per se.

In the invention, the sum of the maximum density at maximum absorption wavelength of coloring agent image formed by the leuco dyes is generally 0.01 or more and 0.50 or less, preferably 0.02 or more and 0.30 or less, and especially preferably 0.02 or more and 0.20 or less.

[Yellow Coloring Leuco Dyes]

Further in the invention, yellow coloring leuco dyes are preferably used in combination with the cyan coloring leuco dyes.

In the invention, the yellow coloring leuco dyes represented by the following Formula (YA), in which the absorbance at 360 to 450 nm is increased by oxidation are especially preferably used.

Hereinafter, the compounds represented by the Formula (YA) is described in detail.

Formula (YA)

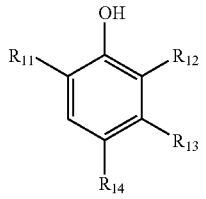

In the formula, $R_{11}$ represents a substituted or unsubstituted alkyl group, $R_{12}$ represents hydrogen atom or substituted or unsubstituted alkyl or acylamino groups. $R_{11}$ and $R_{12}$ are not 2-hydroxyphenylmethyl group. $R_{13}$ represents hydrogen atom or substituted or unsubstituted alkyl group, and $R_{14}$ represents a group capable of being substituent on a benzene ring.

The alkyl group represented by $R_{11}$ is preferably the alkyl group with 1 to 30 carbons and may have substituents.

Specifically, methyl, ethyl, butyl, octyl, i-propyl, t-butyl, t-octyl, t-pentyl, sec-butyl, cyclohexyl, 1-methyl-cyclohexyl and the like are preferable. The groups which are sterically greater than i-propyl (i-propyl, i-nonyl, t-butyl, t-amyl, t-octyl, cyclohexyl, 1-methyl-cyclohexyl, adamanthyl, etc.) are preferable. Among others, secondary or tertiary alkyl groups are preferable, and t-butyl, t-octyl, t-pentyl and the like which are the tertiary alkyl groups are especially preferable. The substituents which $R_{11}$ may have include halogen atoms, aryl, alkoxy, amino, acyl, acylamino, alkylthio, arylthio, sulfonamide, acyloxy, oxycarbonyl, carbamoyl, sulfamoyl, sulfonyl, phosphoryl groups and the like.

$R_{12}$ represents alkyl or acylamino group. The alkyl groups represented by $R_{12}$ are preferably the alkyl groups with 1 to 30 carbons, and the acylamino groups represented by $R_{12}$ are preferably the acylamino groups with 1 to 30 carbons.

As the description of above alkyl these alkyl groups, the description of alkyl group represented by $R_{11}$ can be referred as.

The acylamino groups represented by $R_{12}$ may be unsubstituted or may have substituents, which specifically include acetylamino, alkoxyacetylamino, aryloxyacetylamino groups and the like. $R_{12}$ is preferably a hydrogen atom or an unsubstituted alkyl group with 1 to 24 carbons, and specifically include methyl, i-propyl and t-butyl.

The alkyl group represented by $R_{13}$ is preferably alkyl groups with 1 to 30 carbons, and the description of the alkyl groups is the same as that of $R_{11}$.

$R_{13}$ is preferably a hydrogen atom or an unsubstituted alkyl group with 1 to 24 carbons, and specifically include methyl, i-propyl, t-butyl and the like. And it is preferred that either $R_{12}$ or $R_{13}$ is the hydrogen atom.

$R_{14}$ represents a group capable of being substituted to benzene ring, and is, for example, the same group described in the substituent $R_4$ in the Formula (1).

$R_{14}$ is preferably a substituted or unsubstituted alkyl group with 1 to 30 carbons or an oxycarbonyl group with 2 to 30 carbons, and more preferably an alkyl group with 1 to 24 carbons. The substituents of the alkyl group include aryl, amino, alkoxy, oxycarbonyl, acylamino, acyloxy, imide, ureido groups and the like, and are more preferably aryl, amino, oxycarbonyl and alkoxy groups. These substituents of the alkyl group may be further substituted with these substituents.

In the invention, the compounds represented by following Formula (YB) is especially preferable among the compounds represented by the above Formula (YA).

Formula (YB)

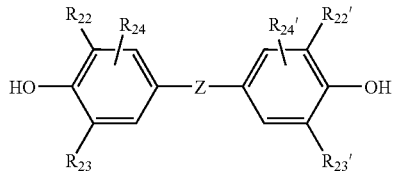

In the Formula, Z represents —S— or —C($R_{21}$)($R_{21}$'), $R_{21}$ and $R_{21}$' represents hydrogen atom or substituent respectively. $R_{22}$, $R_{23}$, $R_{22}$' and $R_{23}$' represent substituent respectively. $R_{24}$ and $R_{24}$' represent hydrogen atom or substituent respectively.

In the Formula (YB), the substituents represented by $R_{21}$ and $R_{21}$' are same subsititutents of $R_1$ in the Formula (1). Hydrogen atom or alkyl group is preferable $R_{21}$ and $R_{21}$'.

$R_{22}$, $R_{23}$, $R_{22}$' and $R_{23}$' each represent substituents, and the substituents include the same groups as the substituents included in the description for $R_2$ and $R_3$. As $R_{22}$, $R_{23}$, $R_{22}$' and $R_{23}'$, preferred are alkyl, alkenyl, alkynyl, aryl, heterocyclic groups and the like, and the alkyl groups are more preferable.

These can have substituents and the substituents of alkyl groups include the same groups as the substituents included in the description for the Formula (1).

$R_{22}$, $R_{23}$, $R_{22}'$ and $R_{23}'$ are more preferably tertiary alkyl groups such as t-butyl, t-pentyl, t-octyl, 1-methyl-cyclohexyl and the like.

The substituents represented by $R_{24}$ and $R_{24}'$ include the same groups as the substituents included in the description for $R_4$ in the above Formula (1).

The compounds represented by the Formulas (YA) and (YB) can include the compounds (II-1) to (II-40) described in [0032] to [0038] of JP-A-2002-169249, and the compounds (ITS-1) to (ITS-12) described in [0026] of EP 1,211,093.

Hereinafter, specific examples of the bisphenol compounds represented by the Formulas (YA) and (YB) are shown, but the present invention is not limited thereto.

(YA-1)

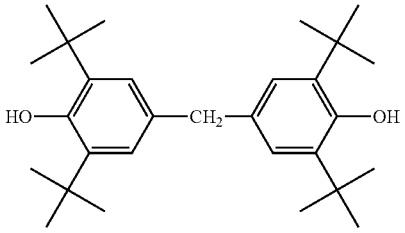

(YA-2)

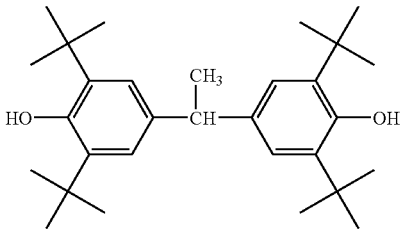

(YA-3)

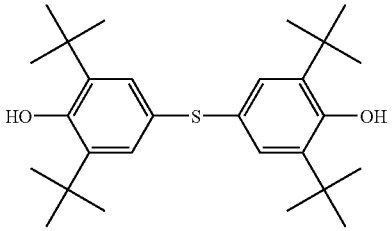

(YA-4)

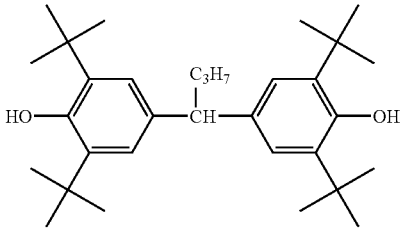

-continued (YA-5)

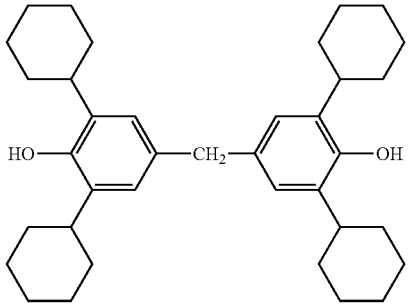

(YA-6)

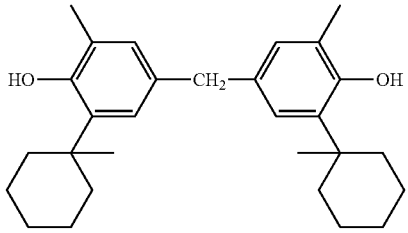

(YA-7)

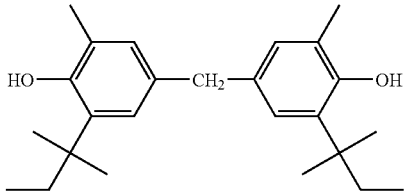

(YA-8)

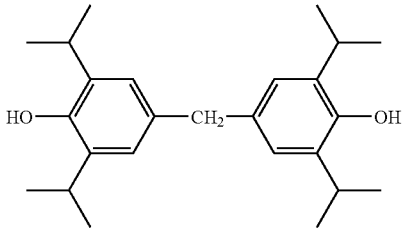

(YA-9)

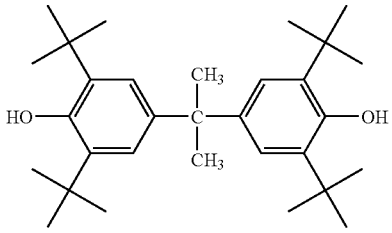

(YA-10)

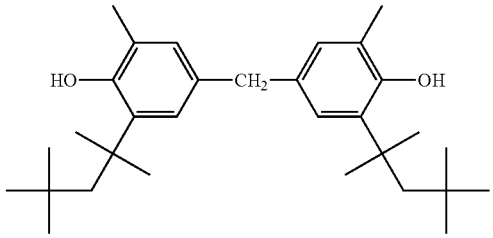

-continued (YA-11)

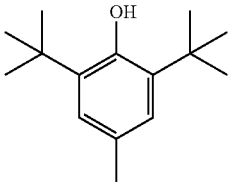

(YA-12)

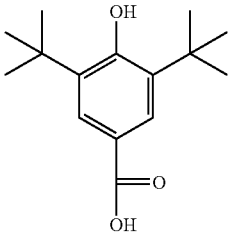

(YA-13)

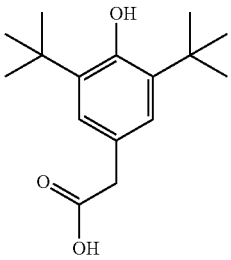

(YA-14)

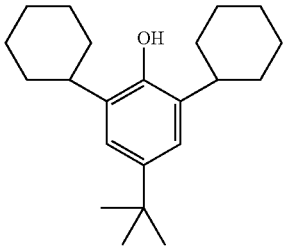

(YA-15)

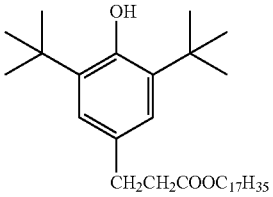

The addition amount of the compound (hindered phenol compound) of the Formula (YA) (including the compounds of the Formula (YB)) is typically from 0.00001 to 0.01 mol, preferably from 0.0005 to 0.01 mol, and more preferably from 0.001 to 0.008 mol per 1 mol of Ag.

Further, the amount ratio of the compound represented by the Formula (YA) to be added to the compound represented by the Formula (1) and Formula (2) to be added is preferably 0.001 to 0.2 by mol, more preferably 0.005 to 0.1 by mol.

As the method of adding the compounds represented by the Formula (YA) and (YB), the cyan coloring leuco dyes, and the couplers, the same method of adding as the method of adding the reducing agent represented by the Formula (1) can be used, and they can be contained in applying solution by given methods of solution morph, emulsified dispersion morph, solid fine particle phase and the like, and thus can be contained in the photoconductive material.

It is preferred that the compounds of the Formulas (YA) and (YB), the cyan coloring leuco dye, the couplers and compounds of Formulas (1) and (2) are contained in the image formation layer containing the organic silver salt, but one may be contained in the image formation layer and the other may be contained in non-image formation layer adjacent thereto, and both may be contained in the non-image forming layer. Also when the image forming layer is made up of multiple layers, they may be contained in different layers, respectively.

[Binder]

Binders suitable for the materials of the invention are transparent or translucent, generally colorless, and include naturally occurring polymer synthetic resins and polymers and copolymers and the other media which form films, e.g., those described in [0069] of JP-A-2001-330918. In these, the binders preferable for the photosensitive layer of the photothermographic imaging material of the invention are polyvinyl acetals, and the especially preferable binder is polyvinyl butyral. These are described later in detail.

Also, for non-photosensitive layers such as a face coating layer and a base coating layer, especially a protection layer and a back coat layer, preferred are cellulose esters which are polymers with higher softening temperature, especially polymers such as triacetylcellulose and cellulose acetate butyrate. The above binders can be used in combination of two or more if necessary.

For the binder, it is preferable to use those at least one or more of polar group selected from —COOM, —$SO_3M$, —$OSO_3M$, —P═O$(OM)_2$, —O—P═$(OM)_2$, —N$(R)_2$, —$N^+(R)_3$ (M represents a hydrogen atom or an alkali metal base and R represents a hydrocarbon group), epoxy group, —SH, —CN and the like are introduced by copolymerization or addition reaction, and especially as polar group, —$SO_3M$, and —$OSO_3M$ are preferable. The amount of such a polar group is preferably from $1\times10^{-1}$ to $1\times10^{-8}$ mol/g, and more preferably from $1\times10^{-2}$ to $1\times10^{-6}$ mol/g.

Such a binder is used in the effective range to function as the binder. The effective range can be easily determined by those skilled in the art. For example, as an index when at least retaining the organic silver salt at the image forming layer, a ratio of the binder to the organic silver salt is preferably from 15:1 to 1:2, and especially the range of 8:1 to 1:1 is preferable. That is, it is preferred that the amount of binder in the image forming layer is from 1.5 to 6 g/$m^2$. More preferably it is from 1.7 to 5 g/$m^2$. When it is less than 1.5 g/$m^2$, the density at an unexposed part is drastically increased and there are sometimes unusable cases.

A glass transition temperature (Tg) of the binder used in the invention is preferably 70° C. to 150° C. Tg can be obtained by measuring with a differential thermometer, and an intersecting point of a baseline and a slope of an endothermic peak is rendered the glass transition temperature. Tg in the present invention is obtained by the method described in Brandwrap et al., "Polymer Handbook" III-139 to III-179 pages (1966, Willy and Sun Publisher).

When the binder is a copolymer resin, Tg is obtained by the following formula.

$$Tg\ (\text{copolymer})\ (^\circ\ \text{C.})=v_1Tg_1+v_2Tg_2+\ldots v_nTg_n$$

In the formula, $v_1$, $v_2$ . . . $V_n$ represent a percentage by mass of a monomer in the copolymer, and $Tg_1$, $Tg_2$ . . . $Tg_n$ represent Tg (° C.) of a single polymer obtained from each monomer in the copolymer. An accuracy of Tg calculated according to the above formula is ±5° C.

When using the binder with Tg of 70 to 105° C., the sufficient and maximum density can be obtained in the image formation, and thus it is preferable As the binder in the invention, Tg is from 70 to 105° C., the number average molecular weight is from 1,000 to 1,000,000, preferably from 10,000 to 500,000, and the polymerization degree is from about 50 to 1,000.

As the binder, the polymers or copolymers comprising the ethylenic unsaturated monomer mentioned above as a component unit include those described in [0069] of JP Tokukai-2001-330918A.

Among them, the especially preferable examples include alkyl methacrylate esters, aryl methacrylate esters, styrenes and the like. In such polymer compounds, it is preferable to use the polymer compounds having acetal group. It is more preferable to be polyvinyl acetal having acetoacetal structure, and for example, it is possible to include polyvinyl acetal shown in U.S. Pat. Nos. 2,358,836, 3,003,879 and 2,828,204, British Patent No. 771,155 and the like.

As the polymer compounds having the acetal group, especially preferred are the compounds represented by the following Formula (V).

Formula (V)

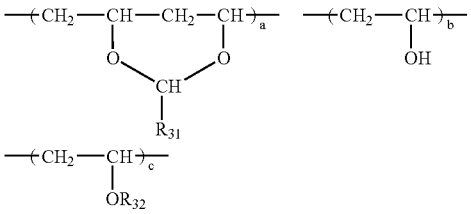

In the Formula (V), $R_{31}$ represents an unsubstituted alkyl, substituted alkyl, aryl or substituted aryl group, and is preferably a group other than aryl group. $R_{32}$ represents unsubstituted alkyl, substituted alkyl, unsubstituted aryl, substituted aryl group, —$COR_{33}$ or $ONHR_{33}$ $R_{33}$ is the same as defined $R_{31}$.

The unsubstituted alkyl groups represented by $R_{31}$, $R_{32}$ and $R_{33}$ are preferably alkyl groups with 1 to 20 carbons, and more preferably alkyl groups with 1 to 6 carbons. These may be linear or branched, and preferably linear alkyl groups are preferable. Such substituents include, for example, methyl, ethyl, n-propyl, isopropyl, n-butyl, isobutyl, t-butyl, n-amyl, t-amyl, n-hexyl, cyclohexyl, n-hepsyl, n-octyl, t-octyl, 2-ethylhexyl, n-nonyl, n-decyl, n-dodecyl, n-octadecyl and the like. Methyl or propyl group is especially preferable.

The unsubstituted aryl groups are preferably those with 6 to 20 carbons, and for example include phenyl, naphthyl groups and the like.

The substituents of the above alkyl or aryl group include alkyl groups (for example, methyl, n-propyl, t-amyl, t-octyl, n-nonyl, dodecyl groups, etc.), aryl groups (for example, phenyl group, etc.), nitro, hydroxy, cyano, sulfo groups, alkoxy groups (for example, methoxy group, etc.), aryloxy groups (for example, phenoxy group, etc.), acyloxy groups (for example, acetoxy group, etc.), acylamino groups (for example, acetylamino group, etc.), sulfonamide groups (for example, methanesulfonamide group, etc.), sulfamoyl groups (for example, methylsulfamoyl group, etc.), halogen atoms (for example, fluorine, chlorine, bromine atoms, etc.), carboxy, carbamoyl groups (for example, methylcarbamoyl group, etc.), alkoxycarbonyl groups (for example, methoxycarbonyl group, etc.), sulfonyl groups (for example, methylsulfonyl group, etc.) and the like. When these substituents are two or more, they may be the same or different. The total carbon number of substituted alkyl group is preferably from 1 to 20, and the total carbon number of substituted aryl group is preferably from 6 to 20.

As $R_{32}$, preferred is —$COR_{33}$ ($R_{33}$ is an alkyl or aryl group) or —$CONR_{33}$ ($R_{33}$ is an aryl group).

a, b and c is values showing the weight of respective repeat units by mol %, a is in the range of 40 to 86 mol %, b is in the range of 0 to 30 mol %, c is in the range of 0 to 60 mol %, which represent the numbers to be a+b+c=100 mol %. Especially preferably, a is in the range of 50 to 86 mol %, b is in the range of 5 to 25 mol %, and c is in the range of 0 to 40 mol %. Each repeat unit having each composition ratio of a, b and c may be made up of the same or different components.

The polymer compounds represented by the above Formula (V) can be synthesized by the general method for synthesis described in "Vinyl Acetate Resins" edited by Ichiro Sakurada (1962, Kobunshi Kagaku Kankokai).

As polyurethane resins which can be used in the invention, it is possible to use those known in the art where the structure is polyester polyurethane, polyether polyurethane, polyetherpolyester polyurethane, polycarbonate polyurethane, polyesterpolycarbonate polyurethane, polycaprolactone polyurethane and the like. Also, it is preferable to have at least one OH group at each end of polyurethane molecule and thus total two or more OH groups. Since OH groups form three dimensional network structure by crosslinking with polyisocyanate which is a hardening agent, it is more preferable to include more groups in the molecules. Especially, when OH groups are located at the molecular ends, the reactivity to the hardening agent is high, and thus it is preferable. Polyurethane has preferably 3 or more OH groups at the molecular ends, and it is especially preferable to have 4 or more. When polyurethane is used in the invention, it is preferred that Tg is from 70 to 105° C., elongation after fracture is from 100 to 2000% and breaking stress for link chain is from 0.5 to 100 $N/mm^2$.

These polymer compounds (polymers) may be used alone or in blend of two or more. The above polymer is used as the main binder for the image forming layer of the invention.

The main binder here is referred to a "state where the above polymer occupies 50% or more by mass of the total binders of the image forming layer". Therefore, the other polymers may be blended in the range of less than 50% by mass of the total binders. These polymers is not especially limited as long as they are solvents where the polymer of the invention is solubilized. More preferably included are polyvinyl acetate, polyacryl resins, urethane resins and like.

In the present invention, an organic gelling agent may be contained in the image forming layer. The organic gelling agent herein is referred to compounds such as polyvalent alcohols having a function which makes fluidity of the system disappear or lower by adding to an organic liquid to impart an yield value to the system.

In the present invention, it is also the preferable aspect that an coating solution for the image forming layer contains polymer latex in aqueous dispersion. In this case, it is preferred that 50% or more by mass of the total binders of the coating solution for the image forming layer is polymer latex in aqueous dispersion. Also, when the image forming layer according to the invention contains polymer latex, it is preferred that 50% or more by mass of the total binders in the image forming layer is the polymer latex, and more preferably the polymer latex is 70% or more by mass.

"Polymer latex" is one where water-insoluble hydriphobic polymer is dispersed in an aqueous dispersion medium as fine particles. The dispersion state may be any of one where the polymer is emulsified in the dispersion medium, emulsified and polymerized one, micelle dispersion, or one where hydriphilic structures are partially present in the molecule and molecular chains per se are in molecular dispersion. The mean particle size of the dispersed particles is preferably from 1 to 50,000 nm, and more preferably in the range of about 5 to 1,000 nm. The particle size distribution is not especially limited, and the particles may have a broad particle size distribution or a particle size distribution of monodisperse.

The polymer latex used in the invention may be so-called core/shell type latex in addition to the polymer latex with common uniform structure. In this case, there are sometimes preferable cases when the glass transition temperature is different in the core and the shell. A minimum film forming temperature (MFT) of the polymer latex according to the invention is preferably from −30 to 90° C., and more preferably from about 0 to 70° C. Also, a film forming aid may be added to control the minimum film forming temperature.

The film forming aid used for the invention is also called a plasticizer, an organic compound (typically organic solvent) which reduces the minimum film forming temperature of the polymer latex, and for example, described in "Chemistry of Synthetic Latex (written by Soichi Muroi, published by Kobunshi Kanko, 1970)".

Polymer types used for the polymer latex are acryl, vinyl acetate, polyester, polyurethane, rubber type, vinyl chloride, vinyliden chloride and polyolefin resins, or copolymers thereof and the like. The polymers may be linear polymers, branched polymers or crosslinked polymers. Also, the polymers may be so-called homopolymers where a single monomer is polymerized or copolymers where two or more types of monomers are polymerized. The copolymers may be random copolymers or block copolymers. The molecular weight of the polymer is typically from 5,000 to 1,000,000, and preferably from about 10,000 to 100,000 by number average molecular weight. When the molecular weight is too small, dynamic strength of the photosensitive layer is insufficient, and when it is too large, it is not preferable either because film-making ability is poor.

The polymer latex with equilibrium water content of 0.01 to 2% or less by mass at 25° C. and 60% RH (relative humidity) is preferable, and more preferable are those with 0.01 to 1% by mass. For the definition of and the method for measurement of the equilibrium water content, it is possible to refer to, for example, "Kobunshi Kogaku Koza 14, Kobunshi Zairyo Shikenho (edited by Society of Polymer Science, Japan, Chijinshokan).

Specific examples of the polymer latex include latex of methyl methacrylate/ethyl methacrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer, and the like. These polymers may be used alone or in blend of two or more if necessary. As polymer types of the polymer latex, it is preferred that carboxylic acid ingredient such as acrylate or methacrylate ingredient is contained at about 0.1 to 10% by mass.

Furthermore, hydrophilic polymers such as gelatin, polyvinyl alcohol, methylcellulose, hydroxypropylcellulose, carboxymethylcellulose, and hydroxypropylmethylcellulose may be added in the range of 50% or less by mass based on total binders if necessary. It is preferred that the addition amount of these hydrophilic polymers is 30% or less by mass based on the total binders of the photosensitive layer.

In the preparation of the coating solution for the image forming layer according to the invention, concerning an order of the addition of the organic silver salt and the polymer latex in aqueous dispersion, either one may be added precedently, or they may be added simultaneously, but preferably the polymer latex is added later.

Furthermore, it is preferred that the organic silver salt and further the reducing agent have been mixed before the addition of the polymer latex. Also, in the present invention, after mixing the organic silver salt and the polymer latex, there is problematic in that when the temperature with time is too low, a coating face is impaired whereas when it is too high, the photographic fog is increased, and thus, it is preferred that the coating solution after mixing is retained at 30° C. to for the above time period. Furthermore, it is preferred to retain at 65° C. 35° C. to 60° C., and especially, it is preferred to retain at 35° C. to 55° C. for time elapsing. To maintain such a temperature, a liquid preparation bath for the coating solution could be kept warm.

Concerning the coating of the coating solution for the image forming layer according to the invention, it is preferable to use the coating solution 30 min to 24 hours after mixing the organic silver salt and the polymer latex, more preferably the coating solution is left 60 min to 12 hours after the mixing, and it is especially preferable to use the coating solution 120 min to 10 hours after the mixing.

Here, "after mixing" is referred to subsequence of adding the organic silver salt and the polymer latex in aqueous dispersion and added materials being dispersed evenly. In addition, it is well known that the use of a crosslinker described below for the above binder improves film adherence and reduces development unevenness, and there are also effects that the photographic fog in storage and the production of printout silver after the development are inhibited.

As such crosslinkers used, it is possible to use various crosslinkers used as photographic materials in earlier technology such as aldehyde, epoxy, ethyleneimine, vinylsulfone, sulfonate ester, acryloyl, carbodiimide, silane type crosslinkers described in JP Tokukaisho-50-96216A, but preferred are isocyanate type compounds, silane type compounds, epoxy type compounds or acid anhydride shown below.

The above isocyanate type crosslinkers are the isocyanates or the adduct bodies thereof, and having at least two isocyanate groups, and further specifically include aliphatic diisocyanates, aliphatic diisocyanates having cyclic group(s), benzene diisocyanates, naphthalene diisocyanates, biphenyl isocyanates, diphenylmethane diisocyanates, triphenylmethane diisocyanates, triisocyanates, tetraisocyanates, the adduct bodies of theses isocyanates, and the adduct bodies of these isocyanates and bivalent or trivalent polyalcohols. Specific examples can include the isocyanate compounds described in pages 10 to 12 of JP Tokukaisho-56-5535A.

The adduct body of isocyanate and polyalcohol especially makes interlayer adhesion good and has a high ability to prevent occurrence of dropout of layer, image slippage and cells. Such an isocyanate compound may be placed at any part of the silver salt photothermographic dry imaging material. For example, it can be added to the given layer at the side of the photosensitive layer of the support such as the photosensitive layer, a surface protection layer, an intermediate layer, an anti-halation layer and an under coating layer in the support (especially when the support is paper, it can be contained in the size composition), and it can be added to one layer or two or more layers in these layers.

Also thioisocyanate system crosslinker can be used as the crosslinker. As the thioisocyanate crosslinker capable of used in the invention, compound having thioisocyanate structure corresponding to the above isocyanate type.

The amount of the above crosslinkers used in the invention is in the range of 0.001 to 2 mol, and preferably from 0.005 to 0.5 mol per 1 mol of the silver. In this range, two or more types may be combined.

Also, as thioisocyanate type crosslinkers which can be used in the invention, useful are also the compounds having thioisocyanate structure corresponding to the above isocyanates.

Also, silane compounds can be used as crosslinkes. Examples of the silane compounds include the compounds represented by the Formulas (1) to (3) disclosed in JP Tokukai-2001-264930A.

Further, epoxy compounds can be used as crosslinkes in the invention. The epoxy compounds could be those having one or more epoxy groups, and the number of epoxy groups, molecular weight and the others are not limited. It is preferred that epoxy group is contained in the molecule as glycidyl group via ether and imino bonds. Also, the epoxy compound may be any of monomer, oligomer and polymer, the number of epoxy groups present in the molecule is typically from about 1 to 10, and preferably from 2 to 4. When the epoxy compound is polymer, it may be either of homopolymer or copolymer, and the preferable range of the number average molecular weight thereof is from about 2,000 to 20,000.

Also, acid anhydrides can be used as crosslinkes in the invention. The acid anhydride is the compound having at least acid anhydride group represented by the following structure formula. The acid anhydride used for the invention could be having one or more of such acid anhydride groups, and the number of acid anhydride groups, molecular weight and the others are not limited.

—CO—O—CO—

The above epoxy compounds and acid anhydride may be used alone or in combination of two or more. The addition amount thereof is not especially limited, but the range of $1\times10^{-6}$ to $1\times10^{-2}$ mol/m$^2$ is preferable, and the range of $1\times10^{-5}$ to $1\times10^{-3}$ mol/m$^2$ is more preferable. The epoxy compound and acid anhydride can be added to any layer of the photosensitive layer side of the support such as the photosensitive layer, surface protection layer, intermediate layer, anti-halation layer and under coating layer, and can be added to one or two or more layers of these layers.

[Silver Saving Agent]

The silver saving agent used in the invention is referred to the compounds capable of reducing the silver amount required for obtaining the constant silver image density. Various action mechanisms for this reduction are thought, but preferred are the compounds having the function to enhance covering power of development silver. Here, the covering power of development silver is referred to optical density per unit amount of the silver.

As the silver saving agent, preferable examples include hydrazine derivative compounds represented by the following Formula (H), vinyl compounds represented by the following Formula (G), and quaternary onium compounds represented by the following Formula (P).

First, hydrazine derivative compounds represented by the following Formula (H) is explained.

Formula (H)

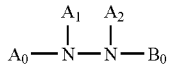

In the Formula (H), $A_0$ represents an aliphatic group, aromatic group, heterocyclic group or $-G_0-D_0-$ group which may have substituents, respectively. $G_0$ represents —CO—, —COCO—, —CS—, —C(=N$G_1D_1$)-, —SO—, —$SO_2$— or —P(O)($G_1D_1$) group, $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different. $D_0$ represents a hydrogen atom, aliphatic, aromatic, heterocyclic, amino, alkoxy, aryloxy, heterocyclicoxy, alkylthio or arylthio group. $B_0$ represents a blocking group, $A_1$ and $A_2$ both represent hydrogen atoms or one represents a hydrogen atom and the other represents an acyl, sulfonyl or oxalyl group.

Preferable $D_0$ includes hydrogen atom, alkyl, alkoxy and amino groups.

The aliphatic groups represented by $A_0$ are preferably those with 1 to 30 carbons, especially preferably linear, branched or cyclic alkyl groups with 1 to 20 carbons, and include, for example, methyl, ethyl, t-butyl, octyl, cyclohexyl, and benzyl groups. These may be further substituted with appropriate substituents (e.g., aryl, alkoxy, aryloxy, alkylthio, arylthio, sulfoxy, sulfonamide, sulfamoyl, acylamino, ureido groups, etc.)

The aromatic group represented by $A_0$ is preferably monocyclic or condensed cyclic aryl group, and for example, includes benzene or naphthalene ring.

The heterocyclic group represented by $A_0$ is preferably monocyclic or condensed cyclic heterocyclic group containing at least one heteroatom selected from nitrogen, sulfur and oxygen atoms, and for example includes imidazole, tetrahydrofuran, morpholine, pyridine, pyrimidine, quinoline, thiazole, benzothiazole, thiophene, and furan rings In $G_0$-$D_0$ group represented by $A_0$, $G_0$ represents —CO—, —COCO—, —CS—, —C(=N$G_1D_1$)-, —SO—, —$SO_2$— or —P(O)($G_1D_1$) group, and preferable $G_0$ includes —CO— and —COCO— groups.

$D_0$ represents a hydrogen atom, aliphatic, aromatic, heterocyclic, amino, alkoxy, aryloxy, alkylthio or arylthio group, and preferable $D_0$ includes hydrogen atom, alkyl, alkoxy and amino groups.

The aromatic and heterocyclic and $-G_0-D_0$ groups of $A_0$ may have substituents. As $A_0$, especially preferred are aryl group and $-G_0-D_0$ group.

Also, it is preferred that $A_0$ comprises at lease one of anti-diffusion group and silver halide adsorption group. As the anti-diffusion group, preferred is ballast group usually used in additives for unmoving photographs such as coupler, and the ballast groups include alkyl, alkenyl, alkynyl, alkoxy, phenyl, phenoxy, alkylphenoxy groups and the like, which are photographically inert. It is preferred that total number of carbons at substituted moiety is 8 or more.

The silver halide adsorption facilitating groups include thio urea, thiourethane, mercapto, thioether, thione, heterocyclic, thioamide heterocyclic, mercapto heterocyclic groups or adsorption groups described in JP-A-64-90439.

$B_0$ represents a blocking group, and is preferably $-G_0-D_0$ group.

$A_1$ and $A_2$ both represent hydrogen atoms, or one represents a hydrogen atom and the other represents an acyl group (acetyl, trifluoroacetyl, benzoyl, etc.), sulfonyl group (methanesulfonyl, toluene sulfonyl, etc.) or oxalyl group (ethoxalyl etc.).

These compounds represented by the Formula (H) can be readily synthesized by the methods known in the art. For example, they can be synthesized in reference to U.S. Pat. Nos. 5,464,738 and 5,496,695.

The other hydrazine derivatives which can be preferably used can include the compounds H-1 to H-29 described in columns of 11 to 20 of U.S. Pat. No. 5,545,505, the compounds 1 to 12 described in the columns of 9 to 11 of U.S. Pat. No. 5,464,738, the compounds H-1-1 to H-1-28, H-2-1 to H-2-9, H-3-1 to H-3-12, H-4-1 to H-4-21 and H-5-1 to H-5-5 described in [0042] to [0052] of JP-A-2001-27790. These hydrazine derivatives can be synthesized by the methods known in the art.

Representative examples of the hydrazine derivatives preferably used in the invention are shown below, but the invention is not limited thereto.

H-1

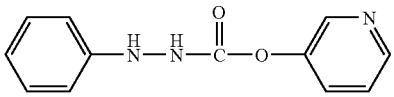

H-2

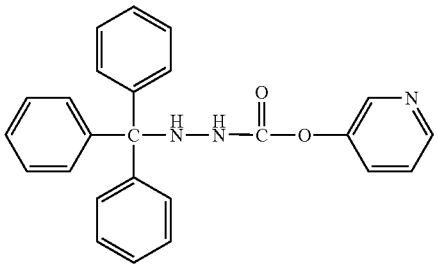

H-3

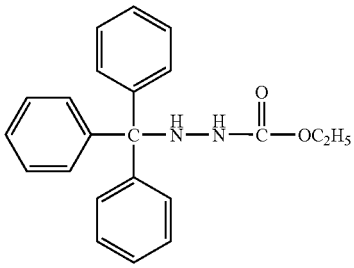

H-4

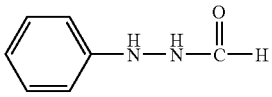

H-5

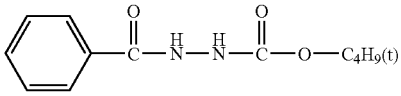

H-6

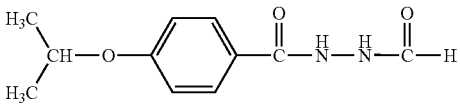

-continued

H-7

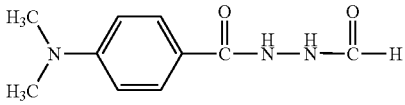

H-8

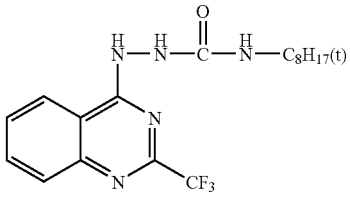

H-9

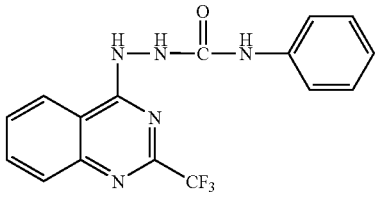

H-10

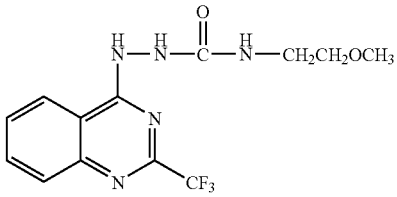

Next, vinyl compounds represented by Formula (G) is explained.

Formula (G)

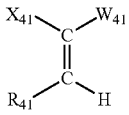

In the Formula (G), $X_{41}$ and $R_{41}$ are represented in the form of cis, but the form where $X_{41}$ and $R_{41}$ are trans is included in the Formula (G). This is the same in the structure representation of the specific compounds.

In the Formula (G), $X_{41}$ represents an electron withdrawing group, and $W_{41}$ represents hydrogen atom, alkyl, alkenyl, alkynyl, aryl, hetero ring groups, halogen atom, acyl, thioacyl, oxalyl, oxyoxalyl, thiooxalyl, oxamoyl, oxycarbonyl, thiocarbonyl, carbamoyl, thiocarbamoyl, sulfonyl, sulfinyl, oxysulfinyl, thiosulfinyl, sulfamoyl, oxysulfinyl, thiosulfinyl, sulfamoyl, phosphoryl, nitro, imino, N-carbonylimino, N-sulfonylimino, dicyanoethylene, ammonium, sulfonium, phosphonium, pyrilium, and immonium groups.

$R_{41}$ represents halogen atom, hydroxyl, alkoxy, aryloxy, hetero ring oxy, alkenyloxy, acyloxy, alkoxycarbonyloxy, aminocarbonyloxy, mercapto, alkylthio, arylthio, hetero ring thio, alkenylthio, acylthio, alkoxycarbonyl thio, aminocarbonyl thio groups, organic or inorganic salt of hydroxyl or mercapto group (e.g., sodium, potassium, silver salts, etc.), amino, alkylamino, cyclic amino (e.g., pyrolidino etc.), acylamino, oxycarbonylamino, hetero ring groups (nitrogen-containing 5 to 6-membered cyclic ring, e.g., benztriazolyl, imidazolyl, triazolyl, tetrazolyl, etc.), ureido and sulfonamide groups.

$X_{41}$ and $W_{41}$, $X_{41}$ and $R_{41}$ may be bound one another to form a cyclic structure. Rings which $X_{41}$ and $W_{41}$ form include, for example, pyrazolone, pyrazolidinone, cyclopentanedione, β-ketolactone, β-ketolactam and the like.

The electron withdrawing group represented by $X_{41}$ is the substituent where a substituent constant σp can be a positive value. Specifically included are substituted alkyl groups (halogen substituted alkyl etc.), substituted alkenyl groups (cyanovinyl, etc.), substituted/unsubstituted alkynyl groups (trifluoromethylacetylenyl, cyanoacetylenyl, etc.), substituted aryl groups (cyanophenyl, etc.), substituted/unsubstituted hetero ring groups (pyridyl, triazyl, benzoxazolyl, etc.), halogen atoms, cyano group, acyl groups (acetyl, trifluoroacetyl, formyl, etc.), oxalyl groups (methyloxalyl, etc.), oxyoxalyl groups (ethoxalyl, etc.), thiooxalyl groups (ethylthiooxalyl, etc.), oxamoyl groups (methyloxamoyl, etc.), oxycarbonyl groups (ethoxycarbonyl, etc.), carboxyl groups, thiocarbonyl groups (ethylthiocarbonyl, etc.), carbamoyl, thiocarbamoyl, sulfonyl, sulfinyl groups, oxysulfonyl groups (ethoxysulfonyl, etc.), thio sulfonyl groups (ethylthiosulfonyl, etc.), sulfamoyl, oxysulfinyl groups (methoxysulfinyl, etc.), thiosulfinyl groups (methylthiosulfinyl, etc.), sulfinamoyl, phosphoryl, nitro, imino groups, N-carbonylimino groups (N-acetylimino, etc.), N-sulfonylimino groups (N-methanesulfonylimino, etc.), dicyanoethylene, ammonium, sulfonium, phosphonium, pyrilium and immonium, and comprised are hetero rings where ammonium, sulfonium, phosphonium and immonium form the ring. The substituents with the σp value of 0.30 or more are especially preferable.

The alkyl groups represented by $W_{41}$ include methyl, ethyl, trifluoromethyl and the like, the alkenyl groups include vinyl, halogen substituted vinyl, cyanovinyl, and the like, the alkynyl groups include acetylenyl, cyanoacetylenyl and the like, the aryl groups include nitrophenyl, cyanophenyl, pentafluorophenyl, and the like, and the hetero rings include pyridyl, pyrimidyl, triazyl, succinimide, tetrazolyl, triazolyl, imidazolyl, benzoxazolyl and the like. As $W_{41}$, the electron withdrawing group with positive σp value is preferable, and further the value is preferably 0.30 or more.

In the above substituents of $R_{41}$, preferably included are hydroxyl, mercapto, alkoxy, alkylthio groups, halogen atoms, organic or inorganic salt of hydroxyl or mercapto group, and hetero ring, more preferably included are hydroxyl, alkoxy, organic or inorganic salt of hydroxyl or mercapto group and hetero ring, and especially preferably included is organic or inorganic salt of hydroxyl or mercapto group.

Specific examples of the compounds of the Formula (G) include the compounds CN-01 to CN-13 described in the columns of 13 to 14 of U.S. Pat. No. 5,545,515, the compounds HET-01 to HET-02 described in the column 10 of U.S. Pat. No. 5,635,339, the compounds MA-01 to MA-07 described in the columns of 9 to 10 of U.S. Pat. No. 5,654,130, the compounds IS-01 to IS-04 described in the columns of 9 to 10 of U.S. Pat. No. 5,705,324, and the compounds 1-1 to 218-2 described in [0043] to [0088] of JP-A-2001-125224, and the like.

Vinyl compounds preferably used in the Formula (G) are shown below, but the invention is not limited thereto.

A1

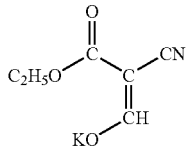

A2

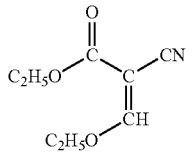

A3

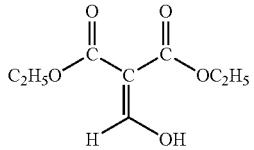

A3

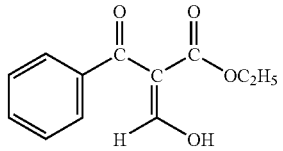

A5

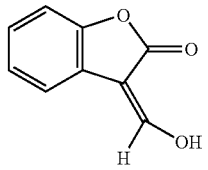

A6

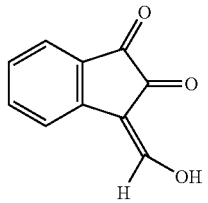

A7

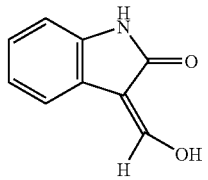

A8

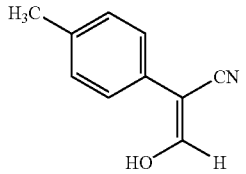

A9

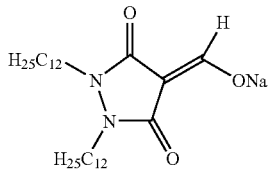

-continued

A10

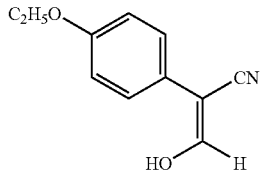

The onium compound represented by Formula (P) is described.

Formula (P)

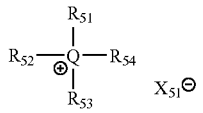

In the formula, Q represents a nitrogen or phosphorus atom, $R_{51}$, $R_{52}$, $R_{53}$ and $R_{54}$ each represent hydrogen atoms or substituents, and $X_{51}^-$ represents anion. Besides, $R_{51}$ to $R_{54}$ may be linked one another to form a ring.

The substituents represented by $R_{51}$ to $R_{54}$ include alkyl groups (methyl, ethyl, propyl, butyl, hexyl, cyclohexyl, etc.), alkenyl groups (allyl, butenyl, etc.), alkynyl groups (propargyl, butynyl, etc.), aryl groups (phenyl, naphthyl, etc.), heterocyclic groups (piperidinyl, piperadinyl, morpholinyl, pyridyl, furyl, thienyl, tetrahydrofuryl, tetrahydrothienyl, sulfolanyl, etc.), amino groups and the like.

The rings which $R_{51}$ to $R_{54}$ can be linked one another to form include piperidine, morpholine, piperazine, quinuclidine, pyridine, pyrrole, imidazole, triazole, tetrazole rings and the like.

The groups represented by $R_{51}$ to $R_{54}$ may have substituents such as hydroxyl, alkoxy, aryloxy, carboxyl, sulfa, alkyl and aryl groups.

$R_{51}$, $R_{52}$, $R_{53}$ and $R_{54}$ are preferably hydrogen atoms and alkyl groups.

Anions represented by $X_{51}^-$ include inorganic and organic anions such as halogen ion, sulfate ion, nitrate ion, acetate ion, p-toluene sulfonate ion and the like.

The above quaternary onium compounds can be readily synthesized according to the methods known in the art, and for example, the above tetrazolium compounds can refer to the method described in Chemical Review, Vol. 55 pages 335 to 483.

Next, silane compound is described.

As the concrete examples of the silane compounds, alkoxysilane compound and the salts thereto such as the compounds described in [0027] to [0029] of JP-A-2003-5324 can be given.

Preferable loading amount of the above silver saving agent is $1\times10^{-4}$ to 1 mol with respect to 1 mol of organic silver salt, and preferably is $1\times10^{-4}$ to $5\times10^{-1}$ mol.

[Image Stabilizer]

Next, described are an Antifoggant and an image stabilizer used for materials of the invention.

Since as the reducing agent used in the invention, mainly the reducing agent such as bisphenols and sulfonamidephenols having proton is used, it is preferable to contain compounds capable of inactivating the reducing agent by producing active species capable of withdrawing these hydrogen atoms in order to stabilize the image. Suitably, preferred is the compound as colorless photooxidation substance capable of producing free radicals as reaction active species at exposure.

Therefore, it may be any compound as long as it is the compound having these functions, but organic free radical made up of multiple atoms is preferable. It may be the compound having any structure as long as it is the compound having such functions and which cause no special adverse effect on the photothermographic imaging material. Also, the compounds which produce these free radicals are preferably those having carbocyclic or heterocyclic aromatic groups in order to make produced free radicals have stability capable of contacting sufficiently to react with and inactivate the reducing agent.

Representatives of these compounds can include biimidazolyl compounds and iodonium compounds.

The addition amount of the above biimidazolyl compounds and iodonium compounds is in a range of 0.001 to 0.1 mol/m$^2$, and preferably, 0.005 to 0.05 mol/m$^2$. Besides, the compounds can be contained also in any component layer of the material in the invention. However, they are preferred to be contained in the vicinity of the reducing agent.

Also, as Antifoggants and image stabilizers, many compounds which can release halogen atoms as active species are well known and available.

As specific examples of the compounds which produce these active halogen atoms, there are the compounds of the Formula (ST) shown below.

Formula (ST)

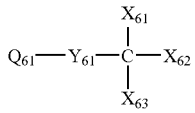

In the formula (ST), $Q_{61}$ represents an aryl or heterocyclic group. $X_{61}$, $X_{62}$ and $X_{63}$ represent hydrogen atoms, halogen atoms, acyl, alkoxycarbonyl, aryloxycarbonyl, sulfonyl, or aryl groups, and at least one is the halogen atom. $Y_{61}$ represents —C(═O)—, —SO— or —$SO_2$—.

The aryl group represented by $Q_{61}$ may be monocyclic or condensed cyclic, is preferably the monocyclic or bicyclic aryl group with 6 to 30 carbons (e.g., phenyl, naphthyl, etc.), more preferably phenyl or naphthyl group, and still preferably phenyl group.

The heterocyclic group represented by $Q_{61}$ is preferably the 3- to 5-membered saturated or unsaturated heterocyclic group comprising at least one of N, O or S, and this may be monocyclic or may form a condensed ring with the other ring. The heterocyclic groups are preferably 5- to 6-membered unsaturated heterocyclic groups which may have condensed rings, and more preferably 5- to 6-membered aromatic heterocyclic groups which may have condensed rings. The heterocyclic groups are still preferably 5- to 6-membered aromatic heterocyclic groups which may have condensed rings comprising nitrogen atoms, and especially preferably 5- to 6-membered aromatic heterocyclic groups which may have condensed rings comprising 1 to 4 nitrogen atoms.

Heterocyclic groups in such heterocyclic groups preferably include those described in the paragraph [0268] of JP-A-2002-287299, and are more preferably imidazole, pyridine, pyrimidine, pyrazine, pyridazine, triazole, triazine, thiadiazole, quinoline, phthalazine, naphthylidine, quinoxaline, quinazoline, cinnoline, tetrazole, thiazole, benzimidazole and benzothiazole, and especially preferably, pyridine, thiadiazole, quinoline and benzothiazole.

The aryl groups and the heterocyclic groups represented by $Q_{51}$ may have substituents in addition to —$Y_{61}$—$C(X_{61})(X_{62})(X_{63})$. The substituents preferably include those described in the paragraph [0269] of JP-A-2002-287299, and are more preferably alkyl, aryl, alkoxy, aryloxy, acyl, acylamino, sulfonylamino, sulfamoyl, carbamoyl groups, halogen atoms, cyano, nitro and heterocyclic groups, and especially preferably alkyl, aryl groups and halogen atoms.

$X_{61}$, $X_{62}$ and $X_{63}$ are preferably halogen atoms, haloalkyl, acyl, alkoxycarbonyl, aryloxycarbonyl, carbamoyl, sulfamoyl, sulfonyl and heterocyclic groups, more preferably halogen atoms, haloalkyl, acyl, alkoxycarbonyl, aryloxycarbonyl and sulfonyl, and especially preferably halogen atoms. In the halogen atoms, chlorine, bromine and iodine atoms are preferable, chlorine and bromine atoms are more preferable, and bromine atoms are especially preferable.

$Y_{61}$ represents —C(═O)—, —SO—, or —$SO_2$—, and is preferably —$SO_2$—.

The addition amount of these compounds is preferably in the range where the increase of printout silver due to the production of silver halide does not substantially become problematic. It is preferred that their percentage (mass) for the compounds which produce no active halogen radical is 150% or less at the maximum, and preferably 100% or less. Specific examples of these compounds which produce active halogen radicals can include the compounds (III-1) to (III-23) described in the paragraph numbers of [0086] to [0087] of JP-A2002-169249.

[Antifoggant]

Antifoggants can be preferably used in the photothermographic imaging material of the invention. Such antifoggants can include, for example, the compound examples a to j described in the paragraph [0012] of JP-A-8-314059, thiosulfonate esters A to K described in the paragraph [0028] of JP-A-7-209797, the compound examples (1) to (44) described from page 14 of JP-A-55-140833, the compounds (I-1) to (I-6) described in the paragraph [0063] and (C-1) to (C-3) described in the paragraph [0066] of JP-A-2001-13627, the compounds (III-1) to (III-108) described in the paragraph [0027] of JP-A-2002-90937, the compounds VS-1 to VS-7, the compounds HS-1 to HS-5 described in the paragraph [0013] of JP-A-6-208192 as the compounds of vinylsulfones and/or β-halosulfones, the compounds of KS-1 to KS-8 described in JP-A-330235 as sulfonylbenzotriazole compounds, PR-01 to PR-08 described in JP-T-2000-515995 as substituted propenenitrile compounds, and the like.

The above Antifoggant is generally used at the amount of at least 0.001 mol per mol of the silver. Typically, the range thereof is from 0.01 to 5 mol per 1 mol of the silver, and preferably from 0.02 to 0.6 mol per 1 mol of the silver.

In addition to the above compounds, the compound known as the Antifoggant in earlier technology may be comprised in the photothermographic imaging material of the invention, and may be the compound capable of producing the same reaction active species as the above compounds or may be the compound with different inhibition mechanism. For example, included are the compounds described in U.S. Pat. Nos. 3,589,903, 4,546,075, 4,452,885, JP-A-59-57234, U.S. Pat. Nos. 3,874,946, 4,756,999, JP-A-9-288328, and JP-A-9-90550. Additionally, the other Antifoggants include the compounds disclosed in U.S. Pat. No. 5,028,523, EP Nos. 600,587, 605,981, 631,176 and the like.

When the reducing agent used for the invention has aromatic hydroxy group (—OH), especially in the case of bisphenols, it is preferable to combine a non-reducing compound having a group capable of forming hydrogen bond with these groups. In the present invention, especially preferable specific examples of hydrogen bonding compounds include the compounds (UU-1) to (II-40) described in [0061] to [0064] of JP-A-2002-90937.

[Toning Agent]

The photothermographic imaging materials are those where photographic images are formed by thermal development, and it is preferred that a toning agent which regulates color tone of the silver if necessary is usually contained in (organic) binder matrix at the dispersed state.

The suitable toning agents used for the invention are disclosed in RD 17029, U.S. Pat. Nos. 4,123,282, 3,994,732, 3,846,136 and 4,021,249, and for example, include the followings.

Included are imides (e.g., succinimide, phthalimide, naphthalimide, N-hydroxy-1,8-naphthalimide, etc.); mercaptans (e.g., 3-mercapto-1,2,4-triazole, etc.); phthalazine derivatives or metallic salts of these derivatives (e.g., phthalazine, 4-(1-naphthyl) phthalazine, 6-chlorophthalazine, 5,7-dimethyloxyphthalazine and 2,3-dihydro-1,4-phthalazione, etc.); the combination of phthalazine and phthalic acid (e.g., phthalic acid, 4-methylphthalic acid, 4-nitrophthalic acid and tetrachlorophthalic acid, etc.); and the combination of phthalazine, maleic acid anhydride and at least one compound selected from phthalic acid, 2,3-naphthalene dicarboxylate or o-phenylenic acid derivatives and anhydrides thereof (e.g., phthalic acid, 4-methylphthalic acid, 4-nitrophthalic acid and tetrachlorophthalic acid anhydride, etc.).

Especially preferable toning agents are phthalazine or the combination of phthalazine with phthalic acid, phthalic acid anhydride.

[Fluorinated Surfactant]

In the present invention, in order to improve film transport property and environmental aptitude (accumulation in vivo) in a thermal development apparatus, fluorinated surfactants represented by the Formula (SF) are used.

$$(Rf\text{-}(L)_{n1}\text{-})_p\text{-}(Y)_{m1}\text{-}(A)_q \quad \text{(SF)}$$

In the Formula (SF), Rf represents a substituent having fluorine atom, L represents a bivalent linkage group containing no fluorine atom, Y represents a linkage group having (p+q) valency containing no fluorine, and A represents an anion group or an anion salt group. $m_1$ and $n_1$ represent an integer of 0 or 1 respectively, p and q represent an integer of 1 to 3 respectively, and when q is 1, at least one of $n_1$ and $m_1$ is not 0.

In the Formula (SF), as the fluorine atom-containing substituents represented by Rf, include are, for example, alkyl groups with 1 to 25 carbons, which are substituted with fluorine atoms (methyl, ethyl, butyl, octyl, dodecyl and octadecyl groups, etc., which are substituted with fluorine atoms), or alkenyl groups, which are substituted with fluorine atoms (propenyl, butenyl, nonenyl and dodecenyl groups, etc., which are substituted with fluorine atoms).

The bivalent linkage groups containing no fluorine atom represented by L include, for example, alkylene groups (methylene, ethylene, butylene groups, etc.), alkyleneoxy groups (methyleneoxy, ethyleneoxy, butyleneoxy groups, etc.), oxyalkylene groups (oxymethylene, oxyethylene, oxybutylene groups, etc.), oxyalkyleneoxy groups (oxymethyleneoxy, oxyethyleneoxy, oxyethyleneoxyethyleneoxy groups, etc.), phenylene, oxyphenylene, phenyloxy, oxyphenyloxy groups or the combination thereof, and the like.

An anion group or a salt group thereof represented by A, and for example, includes carboxylic acid group or the salt group thereof (sodium, potassium and lithium salts), sulfonic acid group or the salt group thereof (sodium, potassium and lithium salts), and phosphoric acid group or the salt group thereof (sodium, and potassium salts).

As a linkage group having no fluorine atom of (p+q) valency or preferably bivalent to tetravalent represented by Y, examples includes atomic groups which are linkage group having no fluorine atom of valency of (p+q) or preferably bivalent to tetravalent and made up of mainly carbon and nitrogen atoms, and n1 represent integers of 0 or 1, and preferably 1.

The fluorinated surfactants represented by the Formula (SF) can be obtained by further introducing the anion group (A) for example by sulfate esterification to the compound (alkanol compound with partial Rf) obtained by the addition reaction or the condensation reaction of a fluorine atom-introducing alkyl compound (the compounds having trifluoromethyl, pentafluoroethyl, perfluorobutyl, perfluorooctyl and perfluorooctadecyl groups, etc.) and an alkenyl compound (the compounds having perfluorohexenyl, perfluorononenyl groups, etc.) with 1 to 25 carbons, with a trivalent to hexavalent alkanol compound introducing no fluorine atom, an aromatic compound or a hetero compound having 3 to 4 hydroxy groups introducing no fluorine atom.

The above tervalent to hexavalent alkanol compound includes glycerine, pentaerythritol, 2-methyl-2-hydroxymethyl-1,3-propanediol, 2,4-dihydroxy-3-hydroxymethylpentene, 1,2,6-hexanetriol, 1,1,1-tris (hydroxymethyl) propane, 2,2-bis (butanol)-3, aliphatic triol, tetramethylolmethane, D-sorbitol, xylitol, D-mannitol and the like. Also, the aromatic compound and hetero compound with the above 3 to 4 hydroxy groups include 1,3,5-trihydroxybenzene and 2,4,6-trihydroxypyridine.

Hereinafter, shown are preferable specific examples of the fluorinated surfactants represented by the Formula (SF). However, it is not limited thereto.

SF-1

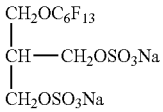

SF-2

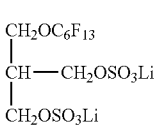

SF-3

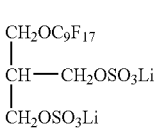

SF-4

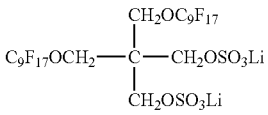

-continued

SF-5

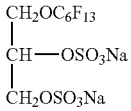

SF-6

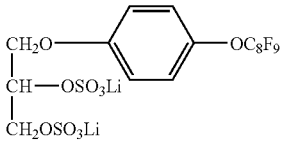

SF-7

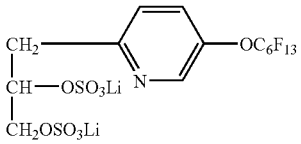

SF-8

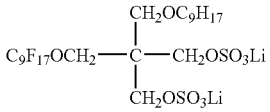

SF-9

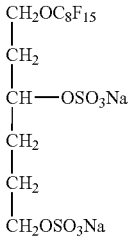

SF-10

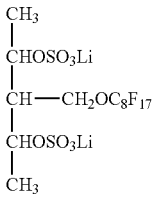

SF-11

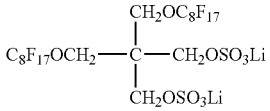

SF-12

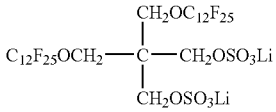

SF-13

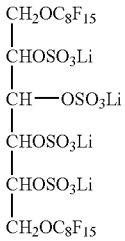

-continued

SF-14

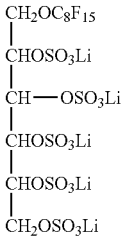

SF-15

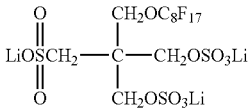

SF-16

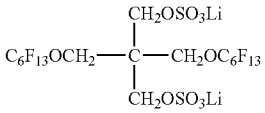

SF-17

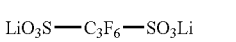

SF-18

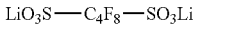

These fluorinated can be added to the coating solution according to the methods known in the art. That is, it can be added by dissolving in polar solvents such as alcohols such as methanol and ethanol, ketones such as methylethylketone and acetone, methylsulfoxide, and dimethylformamide. Also it can be added by making into fine particles of 1 μm or less and dispersing in water or the organic solvent by sand mill dispersion, jet mill dispersion, ultrasonic dispersion and homogenizer dispersion. Numerous technologies are disclosed for fine particle dispersion technology, and the dispersion can be carried out according to these technologies.

It is preferred that the fluorinated surfactant represented by the Formula (SF) is added to the protection layer of the outermost layer. The addition amount of the fluorinated surfactant represented by the Formula (SF) of the invention is preferably from $1\times10^{-8}$ to $1\times10^{-1}$ mol per $m^2$, and especially preferably from $1\times10^{-5}$ to $1\times10^{-2}$ mol per $m^2$. When it is less than the former range, electrostatic property is not obtained whereas when it is over the former range, temperature dependency is high and storage stability under high temperature is deteriorated.

[Outer Layer]

In the photothermographic imaging material of the invention, the value of Rz(E)/Rz(B) is preferably from 0.1 or more to 0.7 or less, more preferably from 0.2 or more to 0.6 or less, and particularly preferably from 0.3 or more to 0.5 or less, where Rz(E) represents mean roughness of 10 points on the outermost surface of image forming layer side and Rz(B) represents mean roughness of 10 points on the outermost surface of the opposite side of the image forming layer side with interleaving the support. When the value of Rz(E)/Rz(B)in the range, unevenness of density in the thermal development can be improved. Also, it is preferred that Lb/Le is 2.0 to 10, and more preferably, 3.0 to 4.5, when the mean particle size of matting agents comprised in an outermost face at the side having the image forming layer is made Le (μm), and that comprised in an outermost face at the side having the back coat layer is made Lb (μm). Density unevenness at thermal development can be improved by making Lb/Le this range.

The above mean roughness of 10 points (Rz) is defined in following JIS surface roughness (B0601). The mean roughness of 10 points (Rz) is a difference between mean height of 5 highest peaks and mean depth of 5 deepest concaves denoted in micrometer (μm), where the peaks and concaves are selected from a cross-sectional curve of predetermined length according to the criteria, and height and depth is measured in a axial magnification direction in which the line which is not cross the cross-sectional curve and parallel to the average line is defined as a base line. Center line average surface roughness is measured at 25° C. and 65% RH after the humidity of sample is conditioned by keeping the sample not stacked in the same condition for 24 hours. Here, the condition of not stacked is as such that the sample is rolled where the edge of film is made thicker, paper is placed between the films and stacked, or four corners are fixed with a flame made of board paper and the like. Available as measuring device are, for example, RSTPLUS noncontact three dimensional micro surface profile measurement system by WYKO Corp. and the like.

The mean roughness of 10 points of front and back surfaces of the photosensitive material is easily regulated in the above range by controlling the type, mean particle size and loading amount of the matting agent used and dispersing condition and drying condition in applying of the matting agent. In the present invention, it is preferred that organic or inorganic powder is used as the matting agent in the outer layer of the photothermographic imaging material (side of the image forming layer, also when non-photosensitive layer is installed at an opposite side of the image forming layer with interleaving the support) to control the object of the invention and surface roughness. As the used powder, it is preferable to use the powder with Mohs hardness of 5 or more.

As the powder, it is possible to use by appropriately selecting inorganic or organic powders known in the art. The inorganic powders can include, for example, titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, pomegranate stone, garnet, mica, silica stone, silicon nitride, silicon carbide and the like. The organic powders can include, for example, powders of polymethylmethacrylate, polystyrene, Teflon (R) and the like. In these, preferred are the inorganic powders such as $SiO_2$, titanium oxide, $\alpha$-$Al_2O_3$, $\alpha$-$Fe_2O_3$, $\alpha$-FeOOH, $Cr_2O_3$, mica and the like, and especially preferable is $SiO_2$.

In the present invention, it is preferred that the matting agent has been surface-treated with Si compound and/or Al compound. When the powder with such surface treatment is used, it is possible to make the surface state of an uppermost layer good. For the content of the Si and/or Al, preferably Si is from 0.1 to 10% and Al is from 0.1 to 10%, and more preferably Si is from 0.1 to 5% and Al is 0.1 to 5%, and especially preferably Si is 0.1 to 2% and Al is 0.1 to 2% by mass based on the powder. Also it is better that the mass ratio of Si to Al is (Si/Al)<1. The surface treatment can be carried out by the method described in JP-A-2-83219. The mean particle size of the powder in the invention means the average diameter in spherical powder, average of the long axis length in needle-shaped powder, and the average value of maximum diagonal lines in the platy face in plate-shaped powder those which are measured by electron microscopy.

The mean particle size of the above organic or inorganic powder is preferably from 0.5 to 10 μm, and more preferably, from 1.0 to 8.0 μm.

The mean particle size of the organic or inorganic powder comprised in the outermost layer at the side of the photosensitive layer is typically from 0.5 to 8.0 μm, preferably from 1.0 to 6.0 μm, and more preferably from 2.0 to 5.0 μm. The addition amount is typically from 1.0 to 20%, preferably from 2.0 to 15%, and more preferably from 3.0 to 10% by mass based on the amount of the binders used for the outermost layer (a hardening agent is included in the binder amount).

The mean particle size of the organic or inorganic powder comprised in the outermost layer at the opposite side of the photosensitive layer with interleaving the support is typically from 2.0 to 15.0 μm, preferably from 3.0 to 12.0 μm, and more preferably from 4.0 to 10.0 μm. The addition amount is typically from 0.2 to 10% by mass, preferably from 0.4 to 7% by mass, and more preferably from 0.6 to 5% by mass based on the amount of the binders used for the outermost layer (a hardening agent is included in the binder amount).

Also, a variation coefficient of particle size distribution is preferably 50% or less, more preferably 40% or less and especially preferably 30% or less. Here, the variation coefficient of particle size distribution is a value represented by the following formula.

{(Standard deviation of particle sizes)/(Mean value of particle sizes)}×100

An addition method of the organic or inorganic powder into the outer layer may be the method for coating by precedently dispersing in the coating solution or the method where after coating the coating solution, the organic or inorganic powder is sprayed before the completion of drying. Also when multiple types of the powders are added, both methods may be combined.

[Support]

Materials of the support used for photothermographic imaging material include various polymer materials, glass, wool fabrics, cotton fabrics, paper, metals (aluminium etc.) and the like, but flexible sheets or those capable of being made into rolls are suitable in terms of handling the photothermographic imaging material as information recording materials. Therefore, as the support in the photothermographic imaging material of the invention, preferred are plastic films such as cellulose acetate film, polyester film, polyethylene terephthalate film, polyethylene naphthalate film, polyamide film, polyimide film, cellulose triacetate film, polycarbonate film or the like, and in the invention, the biaxially stretched polyethylene terephthalate film is especially preferable. A thickness of the support is from about 50 to 300 μm, and preferably from 70 to 180 μm.

It is possible the photothermographic imaging material of the invention to include conductive compounds such as metal oxide and/or conductive polymer in the component layer to improve the electrostatic property. These may be contained in any layer, but preferably is comprised in the backing layer, the surface protection layer at the side of the photosensitive layer, the under coating layer and the like.

As the above conductive compounds, preferably used are the conductive compounds described in columns 14 to 20 of U.S. Pat. No. 5,244,773.

In the photothermographic imaging material of the invention, it is preferable to contain the conductive metal oxide in the surface protection layer at the side of the backing layer. It has been found that this further enhances the effects of the invention (especially, transport property at the thermal development).

Here, the conductive metal oxide is crystalline metal oxide particle. Those comprising oxygen-defect and those comprising heterogenous atoms at a small amount which form donors for the metal oxide used are especially preferable because they are highly conductive in general. In particular, the latter is especially preferable because they do not give the photographic fog to the silver halide emulsion. As examples of the metal oxide, preferred are ZnO, $TiO_2$, $AnO_2$, $Al_2O_3$, $In_2O_3$, $SiO_2$, MgO, BaO, $MoO_3$, $V_2O_5$ and the like, or composite oxides thereof, and in particular ZnO, $TiO_2$ and $SnO_2$ are preferable. As examples of heterogenous atoms added to metal oxides, for example, the addition of Al, In to ZnO, the addition of Sb, Nb, P, halogen elements to $SnO_2$, and the addition of Nb, Ta to $TiO_2$ are effective. The addition amount of these heterogenous atoms is preferably in the range of 0.01 to 30 mol %, and the range of 0.1 to 10 mol % is especially preferable. Further also, to improve fine particle dispersibility and transparency, silicon compounds may be added at making fine particles.

The metal oxides used for the invention have conductivity, and volume resistance rate thereof is preferably $10^7$ Ω·cm or less, and especially $10^5$ Ω·cm or less. These oxides are described in JP-A-56-143431, JP-A-56-120519 and JP-A-58-62647. Additionally also, as described in JP-B-59-6235, conductive materials where the above metal oxide is accreted to the other crystalline metal oxide particles or fibrous matters (titanium oxide, etc.) may be used.

The particle size of the conductive particles is preferably 1 μm or less, but when it is 0.5 μm or less, stability after the dispersion is good and the particles are easy-to-use. Also, to make light scattering small as possible, when the conductive particles of 0.3 μm or less are utilized, it becomes possible to form the clear imaging material, and thus it is extremely preferable. Also when the conductive metal oxide is needle-shaped or fibrous, it is preferred that the length is 30 μm or less and the diameter is 1 μm or less, and especially preferable is that the length is 10 μm or less, the diameter is 0.3 μm or less and a length/diameter ratio is 3 or more. Besides, $SnO_2$ is commercially available from Ishihara Sangyo Co. Ltd., and it is possible to use SNS10M, SN-100P, SN-100D, FSS10M and the like.

The photothermographic imaging material of the invention have the image forming layer which is at least one layer of the photosensitive layer on the support. Only the image forming layer may be formed on the support, but it is preferred that at least one layer of the non-photosensitive layer is formed on the image forming layer. For example, it is preferred that the protection layer is installed on the image forming layer for the purpose of protecting the image forming layer, and the back coat layer is installed at the opposite side of the support to prevent "sticking" between the photothermographic imaging materials or at the photothermographic imaging material roll.

As the binders used for these protection layer and back coat layer, selected are polymers where the glass transition temperature (Tg) is higher than that in the image forming layer and scratch and deformation unlikely occur, such as cellulose acetate and cellulose acetate butyrate from the binders.

For adjusting gradation, two or more of the image forming layers may be placed at one side of the support, or one or more may be placed at both side of the support.

[Dye]

The photothermographic imaging material of the invention, it is preferred that a filter layer is formed at the same side or the opposite side of the image forming layer, or dyes or pigments are contained in the image forming layer in order to control the amount or wavelength distribution of light transmitting the image forming layer.

As the used dyes, it is possible to use the compounds known in the art, which absorb light in various wavelength areas depending on color sensitivity of the photothermographic imaging materials. For example, in the case of making the photothermographic imaging materials, an image recording material by infrared light, it is preferable to use squalirium dye having thiopyrylium nuclei (herein called thiopyrylium squalirium dye) and squalirium dye having pyrylium nuclei (herein called pyrylium squalirium dye) as disclosed in JP-A-2001-83655, and thiopyrylium chroconium dye or pyrylium chroconium dye which are similar to squalirium dyes.

The compounds having squalirium nuclei are the compound having 1-cyclobutene-2-hydroxy-4-one in the molecular structure, and the compounds having chroconium nuclei are the compounds having 1-cyclopentene-2-hydroxy-4,5-dione in the molecular structure. Here, the hydroxy groups may be dissociated. Hereinafter, herein, these pigments are collectively called squalirium dyes for convenience. As the dye, the compounds of JP-A-8-201959 are also preferable.

[Coating of Component Layer]

It is preferred that the photothermographic imaging material of the invention are formed by making the coating solutions where the materials of each component layer described above are dissolved or dispersed in the solvent, overlaying and coating these coating solutions in plurality simultaneously, and then performing the treatment with heat. Here, "overlaying and coating in plurality simultaneously" means that the coating solution of each component layer (photosensitive layer, protection layer and the like) is made, coating and drying are not repeated for each layer when coated on the support, and each component layer can be formed in the state where overlaying and coating is simultaneously performed and the drying step can be also simultaneously performed. That is, it is included that an upper layer is installed before a remaining amount of the total solvent in a lower layer becomes 70% or less by mass.

The method where respective layers are overlaid and coated in plurality simultaneously is not especially limited, and for example, it is possible to use the methods known in the art such as a bar coater method, curtain coat method, immersion method, air knife method, hopper coating method, and extrusion coating method. In these, preferred is the coating manner of previous measure type called the extrusion coating method. The extrusion coating method is suitable for precise coating and organic solvent coating because there is no volatilization on a slide face such as a slide coating method. This coating method was described for the side having the photosensitive layer, but it is the same in the case of coating along with the under coating layer when the back coat layer is installed. The simultaneous overlaying and coating method in the photothermographic imaging material of the invention is described in JP-A-2000-15173 in detail, and these are available.

In the present invention, it is preferable to select an appropriate amount depending on the purpose of the materials. In the case of making an image for medical use a target, the amount is preferably 0.3 to 1.5 g/m$^2$, and more preferably 0.5 to 1.5 g/m$^2$. It is preferred that in the coated silver amount, the amount derived from the silver halide is from 2 to 18% based on the total silver amount. More preferably it is from 5 to 15%.

Also, in the present invention, a coating density of the silver halide grains of 0.01 μm or more (converted particle size of a corresponding sphere) is preferably $1\times10^{14}$ to $1\times10^{18}$/m$^2$, and more preferably $1\times10^{15}$ to $1\times10^{17}$/m$^2$.

Furthermore, the coating density of the non-photosensitive long chain aliphatic carboxylate silver is $1\times10^{-17}$ to $1\times10^{-14}$ g, and more preferably $1\times10^{-16}$ to $1\times10^{-15}$ g per silver halide particle of 0.01 μm or more (converted particle size of a corresponding sphere).

When coated in the condition within the above range, the preferable effects are obtained in terms of optical maximum density of silver image per constant coated silver amount (covering power) and the color tone of the silver image.

In the present invention, it is preferred that the solvent at the range of 5 to 1,000 mg/m$^2$ is contained at the development. It is more preferable to adjust to be 100 to 500 mg/m$^2$. That makes the photothermographic imaging material with high sensitivity, low photographic fog and high maximum density.

The solvents include those described in [0030] of JP-A-2001-264930. But it is not limited thereto. Also these solvents can be used alone or in combination of several types.

The content of the above solvent in the photothermographic imaging materials can be adjusted by condition changes such as temperature condition and the like in the drying step after the coating step. Also, the content of the solvent can be measured by gas chromatography under the condition suitable for detecting the contained solvent.

[Wrapping Body]

When the materials of the invention are stored, it is preferable to store by housing in a wrapping body in order to prevent density change and occurrence of photographic fog with time. A void ratio in the wrapping body could be from 0.01 to 10%, and preferably from 0.02 to 5%. A nitrogen partial pressure in the wrapping body could be made 80% or more, and preferably 90% or more by performing nitrogen charging.

[Exposure of Photothermographic Imaging Material]

In the photothermographic imaging materials, it is common to use laser beam when recording the image. As the light source used in recording an image, it is desirable to use a proper light source for the color sensitivity imparted to the photosensitive material. For example, when the photosensitive materials are made one which can be sensitive to the infrared light, it can be applied for any light sources in the infrared light area, but infrared semiconductor laser (780 nm, 820 nm) is preferably used in terms of points where laser power is high and the material can be made transparent. It is possible to make the photothermographic imaging material not absorb visible light, or transparent, since the dye used for preventing halation can be used as the infrared dye which absorb infrared ray.

In the present invention, it is preferred that the exposure is carried out by laser scanning exposure, but various methods can be employed for the exposure methods. For example, the first preferable method includes the method using a laser scanning exposure machine where angles made by an exposure face of the imaging material and the scanning laser beam do not substantially become perpendicular.

Here, "do not substantially become perpendicular" is referred to the angles of preferably 55° to 88° C. more preferably 60° to 86° C. still preferably 65° to 84° C. most preferably 70° to 82° C. as the angle most close to the perpendicular during the laster scanning.

The diameter of a beam spot on the exposure face of the photosensitive materials when the laser beam is scanned on the materials is preferably 200 μm or less, and more preferably 100 μm or less. This is preferable in that the smaller spot diameter can reduce a "shift angle" from the perpendicular of a laser beam entry angle. A lower limit of the beam spot diameter is 10 μm. By performing the laser scanning exposure in this way, it is possible to reduce image quality deterioration due to reflected light such as an occurrence of interference fringe like unevenness.

Also, as the second preferable method, exposing an image using a laser scanning exposure machine which emits the scanning laser beam which is vertical multiple mode can be given. Compared to the scanning laser beam in vertical single mode, it further reduces the image quality deterioration such as the occurrence of interference fringe like unevenness. To make the vertical multiple mode, the method by combining lights, the method by utilizing returned light and the method by loading high frequency superposition could be used. The vertical multiple mode means that the exposure wavelength is not a single, and typically the distribution of exposure wavelength could be 5 nm or more, and preferably 10 nm or more. An upper limit of the exposure wavelength is not especially limited, but typically is about 60 nm.

Furthermore, as the third preferable method, forming an image by scanning exposure using two or more laser beams can be given. Such an image recording method by utilizing multiple laser beams is the technology used for image writing means of laser printers and digital copying machines where the image with multiple lines are written by one scanning on the requisition of high resolution and high speed, and for example is known by JP-A-60-166916. This is the method where the laser beam emitted from the light source unit is deflected and scanned by polygon mirror, and the imaging is performed on the photosensitive body via fθ lens, and this is principally the same laser scanning optical apparatus as a laser imager and the like.

In the imaging of the laser beam on the photosensitive body in the image writing means of the laser printer and the digital copying machine, next laser beam is imaged with shifting by one line from the imaging site of one laser beam, for the use where multiple lines of the image are written by one scanning. Specifically, two light beam come close with an interval of some 10 μm order on an image face in a sub-scanning direction one another, when print density is 400 dpi (dpi indicates a dot number per inch=2.54 cm), the pitch of two beams in the sub-scanning direction is 63.5 μm, and in the case of 600 dpi, it is 42.3 μm. Differently from the method which shifs by resolution segment to the sub-scanning direction in this way, in the invention, it is preferred that the image is formed by condensing two or more lasers with different entry angles on the exposure face at the same site. At that time, it is preferable to make the range of $0.9\times E \leqq En\times N \leqq 1.1\times E$ when an exposure energy on the exposure face is E when written by typical one laser beam (wavelength λ[nm]), and when N of laser beams used for the exposure heve the same wavelength (wavelength λ[nm]) and the same exposure energy (En). The energy is secured on the exposure face in this way, the reflection of each laser beam to the image forming layer is reduced because the exposure energy of the laser is low, and thus the occurrence of interference fringe is inhibited.

In the above, multiple laser beams with the same wavelength as λ were used, but those with different wavelength of $\lambda_1, \lambda_2 \ldots \lambda_n$ may be used. In this case, it is preferable to make the range $(\lambda-30)<\lambda_1, \lambda_2 \ldots \lambda_n \leqq (\lambda+30)$.

In the image recording methods of the above first, second and third aspects, as the laser used for the scanning exposure, it is possible to use by appropriately selecting solid lasers such as ruby laser, YAG laser and glass laser; gas lasers such as He—Ne laser, Ar ion laser, Kr ion laser, $CO_2$ laser, CO laser, He—Cd laser, $N_2$ laser and excimer laser; semiconductor laser such as InGap laser, AlGaAs laser, GaAsP laser, InGaAs laser, InAs laser, $CdSnP_2$ laser and GaSb laser; chemical lasers and pigment lasers generally well-known in conjugation with the use, but in these, it is preferable to use the laser beam by the semiconductor laser with wavelength of 600 to 1200 nm in terms of the maintenance and the size of light source. In the laser beam used for the laser imager and laser image setter, when scanned on the photothermographic imaging material, the beam spot diameter on the exposure face of the material is generally in the range of 5 to 75 μm as a minor axis diameter and 5 to 100 μm as a major axis diameter. For the laser beam scanning velocity, an optimal value by photothermographic imaging material can be set by sensitivity and laser power at a laser oscillation wavelength inherent for the photothermographic imaging material.

[Thermal Development Apparatus]

The thermal development apparatus used in development of the photothermographic imaging material of the invention is made up of a film supplying portion represented by a film tray, a laser image recording portion, a photothermographic portion where uniform and stable heat is supplied on whole area of the materials in the invention, and a transport portion from the film supplying portion, via the laser recording, to discharge of the materials of the invention where the image is formed by the thermal development out of the apparatus. A specific example of this aspect of the thermal development apparatus is shown in FIG. 1.

A photothermographic apparatus 100 has a feeding portion 110 where a sheet-shaped photothermographic imaging material is fed one by one, an exposure portion 120 where the fed film F is exposed, a developing portion 130 where the exposed film is developed, a cooling portion 150 where the development is stopped, and an accumulating portion 160, and made up of multiple rollers such as a supplying roller pair 140 for supplying the film F from the feeding portion, a supplying roller pair 144 for delivering the film to the developing portion, and transport roller pairs 141, 142, 143 and 145 for smoothly transporting the film between the portions. The thermodeveloping portion 130 is made up of a heat drum 1 having multiple opposed rollers 2 capable of heating with retaining in adherence with a periphery as a heating means for the development of the film F, and a peeling tab 6 for peeling the developed film F and delivering to the cooling portion.

A transport velocity of the photothermographic imaging material is preferably from 10 to 200 mm/sec.

The developing condition of the photothermographic imaging material varies depending on instruments, apparatus and means used, but typically, the development is carried out by heating the photothermographic imaging material exposed to an image at suitable high temperature. A latent image obtained after the exposure is developed by heating the photothermographic imaging material at moderately high temperature (from about 80 to 200° C. preferably from about 100 to 200° C. for a sufficient time period (generally from about one second to about two minutes).

When the heating temperature is lower than 80° C. sufficient image density is not obtained in a short time, and when it is higher than 200° C. the binders are melted and adverse effects are given not only to the image itself but also to transport ability and a developing machine such as transfer to the rollers. The silver image is produced by an oxidation reduction reaction between the organic silver salt (functions as the oxidizing agent) and the reducing agent due to heating. This reaction process progresses with supplying no process liquid such as water or the like from the outside.

As instruments, apparatus or means for heating, for example, a hot plate, iron, hot roller, typical heating means as a thermogenesis machine using carbon or white titanium may be used. More preferably, in the photothermographic imaging material with the protection layer, it is preferred that heating process is carried out by contacting the face at the side having the protection layer with the heating means in terms of performing uniform heating, heat efficiency and working property. It is preferred that the development is performed by transporting and heat processing with contacting the face at the side having the protection layer with the heat rollers.

EXAMPLES

Hereinafter, the present invention is described in detail by examples, but the present invention is not limited thereto.

In addition "%" in the Examples represents "% by mass" when there is no special notice.

Example A-1

<Manufacture of Support Given Under Coating for Photograph>

Corona discharge treatment at 8W/m$^2$·min was given to both faces of a commercially available PET film with thickness of 175 μm and optical density of 0.170 (measured by a densitometer PDA-65 supplied from Konica Corporation) biaxially stretched and thermally fixed which was colored with the following blue dye, the following under coating solution a-1 was applied on one side face such that the thickness of dried film is 0.8 μm, and was dried to make an under coating layer A-1. Also, the following under coating solution b-1 was applied on an opposite side face such that the thickness of dried film is 0.8 μm, and was dried to make an under coating layer B-1.

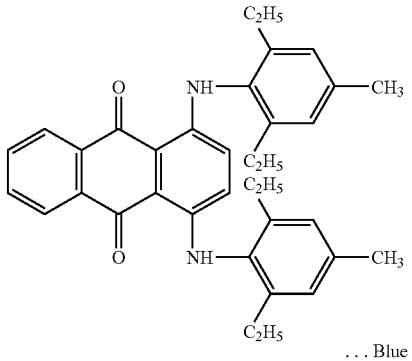

. . . Blue dye

| (Under coat coating solution a-1) | |
|---|---|
| Copolymer latex solution of butyl acrylate/t-butyl acrylate/styrene/2-hydroxyethyl acrylate (30/20/25/25% ratio) (solid content 30%) | 270 g |
| (C-1) | 0.6 g |

-continued

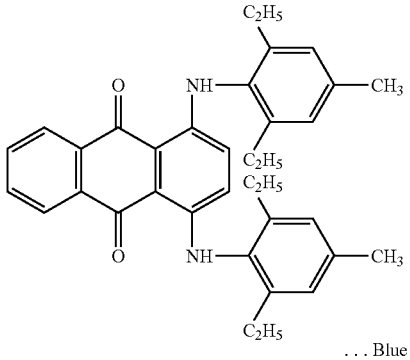

. . . Blue dye

| | |
|---|---|
| Hexamethylene-1,6-bis(ethylene urea) are filled up with water to 1 L. | 0.8 g |
| (Under coat coating solution b-1) | |
| Copolymer latex solution of butyl acrylate/styrene/glycidyl acrylate (40/20/40% ratio) (solid content 30%) | 270 g |
| (C-1) | 0.6 g |
| Hexamethylene-1,6-bis(ethylene urea) are filled up with water to 1 L. | 0.8 g |

Subsequently, the corona discharge treatment at 8W/m$^2$·min was given to upper surfaces of the under coating layers A-1 and B-1, the following under coating upper layer coating solution a-2 was applied on the under coating layer A-1 such that the thickness of dried film is 0.1 μm as the under coating upper layer A-2, and the following under coating upper layer coating solution b-2 was applied on the under coating layer A-1 such that the thickness of dried film is 0.4 μm as the under coating upper layer B-2 which has antistatic function.

| (Under coating upper layer coating solution a-2) | |
|---|---|
| Gelatin | amount corresponding to 0.4 g/m$^2$, |
| (C-1) | 0.2 g |
| (C-2) | 0.2 g |
| (C-3) | 0.1 g |
| silica particles (mean particle size, 3 μm) are filled up with water to 1 L. | 0.1 g |
| (Under coating upper layer coating solution b-2) | |
| Sb doped $SnO_2$ (SNS10M supplied from Ishihara Sangyo Co. Ltd.) | 60 g |
| latex solution of which component is (C-4) (solid content 20%) | 80 g |
| ammonium sulfate | 0.5 g |
| (C-5) | 12 g |
| Polyethyleneglycol (mass average molecular weight) are filled up with water to 1 L. | 6 g |

C-1

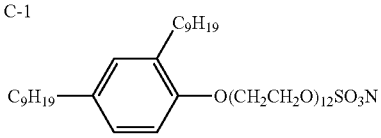

C-2

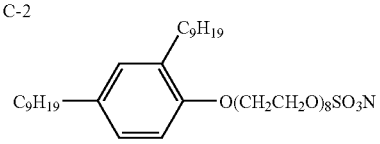

-continued

C-3

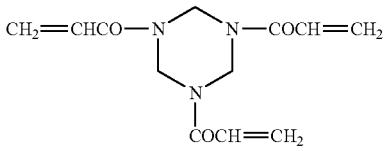

C-4

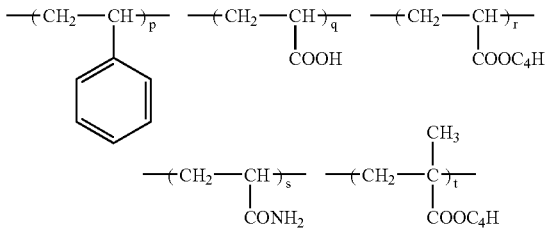

p:q:r:s:t = 40:5:10:5:40 (ratio by mass)

C-5

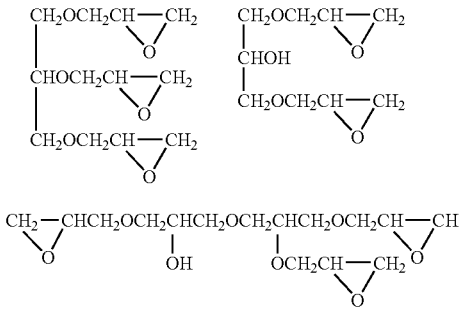

<Preparation of Back Coat Layer Coating Solution>

Cellulose acetate propionate (84.2 g)(Eastman Chemical Company, CAP 482-20) and polyester resin (4.5 g)(Bostic Inc., Vitel PE2200) were added and dissolved in methylethylketone (MEK) (830 g) with stirring. Next, 0.3 g of the following infrared dye 1 was added to the dissolved solution, further 4.5 g of Fluorinated type surfactant (Asahi Glass Co., Ltd., Surflon KH40) and 2.3 g of Fluorinated type surfactant (Dainippon Ink And Chemicals, Incorporated, Megafag F 120K) dissolved in 43.2 g of methanol were added, and thoroughly stirred until dissolved. Next, 2.5 g of oleyloleate was added and stirred to prepare the back coat layer coating solution.

Infrared dye 1

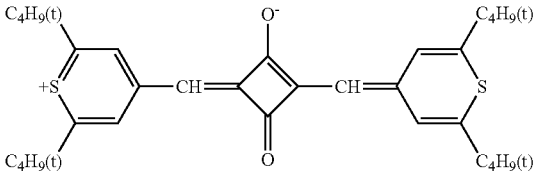

<Preparation of Back Coat Layer Protection Layer (Surface Protection Layer) Coating Solution>

| | |
|---|---|
| Cellulose acetate butyrate (CAP482-20, by Eastman Chemical Corp.) (10% MEK solution) | 15 g |
| Monodisperse silica (mean particle size: 8 μm) with monodisperse degree of 15% (surface treated with aluminum at 1% by mass based on total weight of silica) | 0.03 g |
| $C_8F_{17}(CH_2CH_2O)_{12}C_8F_{17}$ | 0.05 g |
| Fluorinated surfactant (SF-17) | 0.01 g |
| Stearic acid | 0.1 g |
| Oleyloleate | 0.1 g |
| α-alumina (Mohs hardness: 9) | 0.1 g |

<Preparation of Photosensitive Silver Halide Emulsion A>

| | |
|---|---|
| (A1) | |
| Phenylcarbamoyled gelatin | 88.3 g |
| 10% methanol solution of compound (AO-1) | 10 ml |
| potassium bromide | 0.32 g |
| are filled up with water to 5429 ml. | |
| (B1) | |
| An aqueous solution of silver nitrate at 0.67 mol/L | 2635 ml |
| (C1) | |
| Potassium bromide | 51.55 g |
| potassium iodide | 1.47 g |
| are filled up with water to 660 ml | |
| (D1) | |
| Potassium bromide | 151.6 g |
| potassium iodide | 7.67 g |
| potassium hexachloroiridium (IV) acid (1% solution) $K_2(IrCl_6)$ | 0.93 ml |
| potassium hexacyanoiron (II) acid | 0.004 g |
| potassium hexachloroosmium (IV) acid | 0.004 g |
| are filled up with water to 1982 ml. | |
| (E1) | |
| Aqueous solution of potassium bromide at 0.4 mol/L amount to control the following silver potential | |
| (F1) | |
| Potassium hydroxide | 0.71 g |
| is filled up with water to 20 ml. | |
| (G1) | |
| Aqueous solution of 56% acetic acid | 18.0 ml |
| (H1) | |
| Sodium carbonate anhydride | 1.72 g |
| is filled up with water to 151 ml | |
| AO-1: $HO(CH_2CH_2O)_n(CH(CH)_3CH_2O)_{17}(CH_2CH_2O)_mH$ (m + n = 5 to 7) | |

Using the mixing stirrer shown in JP-B-58-, ¼ amount of the solution (B1) and total amount of the solution (C1) were added to the solution (A) with controlling the temperature at 20° C. and pAg at 8.09 by the simultaneous mixing method over 4 mm 45 sec to perform the nuclear formation. After 1 mm, the total amount of the solution (F1) was added. Using (E1), the pAg value was appropriately controlled in the meantime. After 6 mm, ¾ amount of the solution (B1) and the total amount of the solution (D1) were added with controlling the temperature at 20° C. and pAg at 8.09 by the simultaneous mixing method over 14 mm 15 sec. After stirring for 5 mm, the temperature was lowered to 40° C. and the total amount of the solution (G1) was added to precipitate silver halide emulsion. Leaving 2000 ml of the precipitated portion, supernatant was eliminated, and 10 L of water was added to precipitate the silver halide emulsion again. Leaving 1500 ml of the precipitated portion, the supernatant was eliminated, 10 L of water was further added, then after stirring, the silver halide emulsion was precipitated again. Leaving 1500 ml of the precipitated portion, the supernatant was eliminated, subsequently, the solution (H1) was added, the temperature was elevated to 60° C. and the stirring was further performed for 120 mm. Finally, pH was adjusted to 5.8 and water was added to become 1161 g per 1 mol of the silver amount to yield the photosensitive silver halide emulsion A.

This emulsion was made up of monodisperse cubic iodide bromide silver particles with mean particle size of 25 nm, variation coefficient of particle sizes of 12% and [100] face ratio of 92% (the content of AgI was 3.1 mol %).

<Preparation of Photosensitive Silver Halide Emulsion B>

The preparation was carried out as is the case with the preparation of photosensitive silver halide emulsion A, except that the temperature at addition by the simultaneous mixing method was changed to 40° C. This emulsion was made up of monodisperse cubic iodide bromide silver particles with mean particle size of 50 nm, variation coefficient of particle sizes of 12% and [100] face ratio of 92% (the content of AgI was 3.5 mol %).

<Preparation of Powder Organic Silver Salt A>

Behenic acid (130.8 g), arachidic acid (67.7 g), stearic acid 43.6 g), and palmitic acid (2.3 g) were dissolved in 4720 ml of pure water at 80° C. Next, 540.2 ml of an aqueous solution of sodium hydroxide at 1.5 mol/L was added, and 6.9 ml of concentrated nitric acid was added, and subsequently the mixture was cooled to 55° C. to yield sodium fatty acid solution. With retaining the temperature of this sodium fatty acid solution at 55° C., 36.2 g of the above photosensitive silver halide emulsion A and 9.1 g of the above photosensitive silver halide emulsion B, and 450 ml of pure water were added and stirred for 5 min.

Next, 468.4 ml of 1 mol/L silver nitrate solution was added over 2 mm, and stirred for 10 mm to yield an organic silver salt dispersion. Subsequently, the obtained organic silver salt dispersion was transferred to a water washing vessel, distilled water was added and stirred, then the organic silver salt was surfaced-separated by leaving at rest, and lower water-soluble salts were eliminated. Subsequently, water washing with distilled water and discharging water were repeated until the conductivity of the discharged water became 2 μS/cm, and centrifuge dehydration was carried out. The obtained cake-like organic silver salt was dried using a flash dryer, Flash Jet Dryer (supplied from Seishin Enterprise Co., Ltd.) by an operation condition of nitrogen gas atmosphere and hot wind temperature at a dryer inlet until the water content became 0.1% to yield the dried powder of organic silver salt A.

From the result of analysis using the electron microscope for the photothermographic imaging material 1 (described below) made using this organic silver salt, the organic silver salt was made up of tabular particles with mean particle size (diameters of corresponding circles) of 0.08 μm, aspect ratio of 5 and monodisperse degree of 10%.

An infrared moisture meter was used for the measurement of the water content in the organic silver salt composition.

<Preparation of Predispersing Solution A>

As the image forming layer binder, a predispersing solution A was prepared by dissolving 14.57 g of —$SO_3K$ group-containing polyvinyl butyral (Tg: 75° C., 0.2 mmol/g of —$SO_3K$ is contained) in 1457 g of MEK, gradually adding 500 g of the powder organic silver salt A with stirring by a dissolver DISPERMAT CA-40M type supplied from VMA-GETZMANN, and thoroughly mixing.

<Preparation of Photosensitive Emulsion Dispersion 1>

A photosensitive emulsion dispersion 1 was prepared by supplying the predispersing solution A to a media type dispersion machine DISPERMAT SL-C12EX type (supplied from VMA-GETZMANN) in which zirconia beads (Toreselam, supplied from Toray Industries Inc.) with diameter of 0.5 mm were filled at 80% of inner volume such that a staying time in a mill is 1.5 min using a pump, and performing dispersion at a mill peripheral velocity of 8 m/s.

<Preparation of Stabilizer Solution>

A stabilizer solution was prepared by dissolving 1.0 g of a stabilizer 1 and 0.31 g of potassium acetate in 4.97 g of methanol.

<Preparation of Infrared Sensitizing Dye Solution A>

An infrared sensitizing dye solution A was prepared by dissolving 19.2 mg of the infrared sensitizing dye, 1.488 g of 2-chloro-benzoic acid, 2.779 g of the stabilizer 2 and 365 mg of 5-methyl-2-mercaptobenzimidazole in 31.3 ml of MEK in a dark place.

<Preparation of Addition Solution a>

An addition solution a was prepared by dissolving the reducing agent (the compound and amount described in Table 1), the compound represented by the Formula (YA), coupler, main developing agent (type and amount described in Table 1), 1.54 g of 4-methyl phthalate and 0.48 g of the infrared dye 1 in 110 g of MEK.

<Preparation of Additive Solution b>

The antifoggant 2 (1.56 g), 0.5 g of the antifoggant 3, 0.5 g of the antifoggant 4 and 3.43 g of phthalazine were dissolved in 40.9 g of MEK to prepare the additive solution b.

<Preparation of Addition Solution c>

An addition solution c was prepared by dissolving 0.1 g of the silver saving agent A1 into 39.5 g of MEK.

<Preparation of Addition Solution d>

An addition solution d was prepared by dissolving 0.1 g of Supersensitizer 1 into 9.9 g of MEK.

<Preparation of Addition Solution e>

An addition solution e was made by dissolving 1.0 g of potassium p-toluene thiosulfonate in 9.0 g of MEK.

<Preparation of Additive Solution f>

The antifoggant containing 1.0 g of vinylsulfone [$CH_2{=}CH{-}SO_2CH_2)_2CHOH$] was dissolved in 9.0 g of MEK to prepare the additive solution f.

<Preparation of Image Forming Layer Coating Solution>

Under an inert gas atmosphere (nitrogen 97%), the photosensitive emulsion dispersion 1 (50 g) and 15.11 g of MEK were kept at 21° C. with stirring, 1000 μl of a chemical sensitizer S-5 (0.5% methanol solution) was added, after 2 min, 390 μl of the Antifoggant 1 (10% methanol solution) was added, and stirred for one hour. Further, 494 μl of calcium bromide (10% methanol solution) was added, stirred for 10 min, subsequently, a gold sensitizer Au-5 at the amount corresponding to 1/20 mol of the above chemical sensitizer was added, and further stirred for 20 min. Subsequently, 167 ml of the stabilizer solution was added, stirred for 10 min, then 1.32 g of the infrared sensitizing dye solution A was added, and stirred for one hour. Subsequently, the temperature was lowered to 13° C. and the stirring was performed for additional 30 min. With holding the temperature at 13° C., 0.5 g of the addition solution d, 0.5 g of the addition solution e, 0.5 g of the addition solution f, and 13.31 g of the binder used for the predispersing solution A were added, stirred for 30 min, then 1.084 g of tetrachlorophthalic acid (9.4% MEK solution) was added, and stirred for 15 min. The image forming layer coating solution was obtained by sequentially adding and stirring 12.43 of the addition solution a, 1.6 ml 10% MEK solution of Desmodur N3300 (aliphatic isocyanate supplied from Mobey), 4.27 g of the addition solution b and 4.0 g of the addition solution c with further continuing to stir.

The structures of the additive agents used for the preparation of respective coating solutions including the stabilizer solution, and the image forming layer coating solution are shown below.

Chemical sensitizer S-5

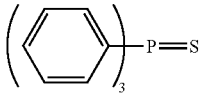

Au-5

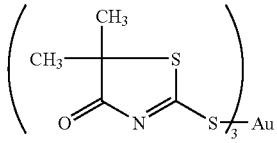

Antifoggant 1

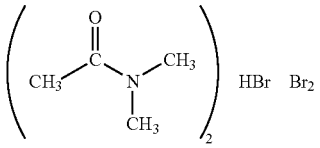

Antifoggant 3

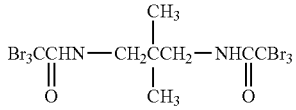

Antifoggant 4

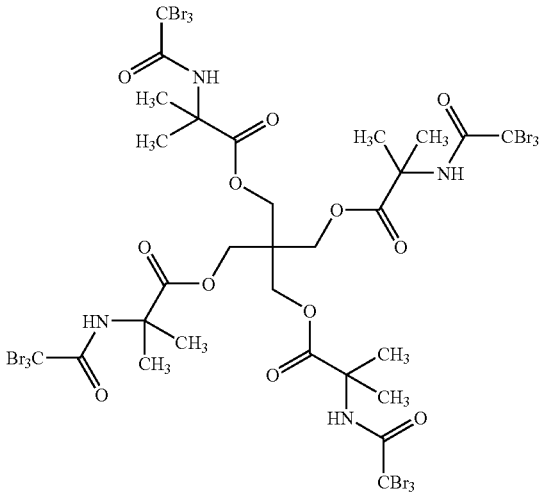

Stabilizer 1

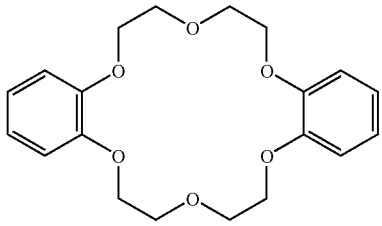

Stabilizer 2

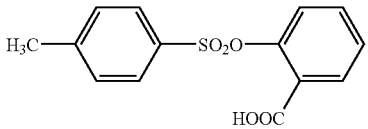

Antifoggant 2

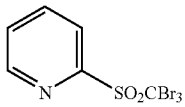

Infrared sensitizing dye

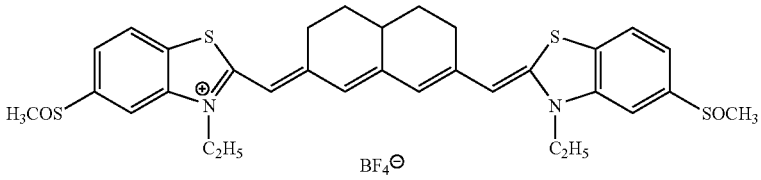

Supersensitizer 1

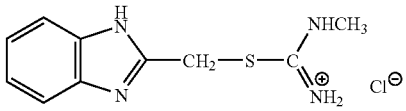

<Preparation of Image Forming Layer Protection Layer Lower Layer (Surface Protection Layer Lower Layer)>

| | |
|---|---|
| Acetone | 5 g |
| MEK | 21 g |
| Cellulose acetate butyrate | 2.3 g |
| Methanol | 7 g |
| Phthalazine | 0.25 g |
| Monodisperse silica with monodisperse degree of 15% (mean particle size: 3 μm) (surface-treated with aluminium at 1% by mass based on total weight of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17: mentioned before) | 0.01 g |
| Stearic acid | 0.1 g |
| Butyl stearate | 0.1 g |
| α-Alumina (Mohs hardness: 9) | 0.1 g |

<Preparation of Image Forming Layer Protection Layer Upper Layer (Surface Protection Layer Upper Layer)>

| | |
|---|---|
| Acetone | 5 g |
| Methylethylketone | 21 g |
| Cellulose acetate butyrate | 2.3 g |
| Methanol | 7 g |
| Phthalazine | 0.25 g |
| Monodisperse silica with monodisperse degree of 15% (mean particle size: 3 μm) (surface-treated with aluminium at 1% by mass based on total weight of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17: mentioned before) | 0.01 g |
| Stearic acid | 0.1 g |
| Butyl stearate | 0.1 g |
| α-Alumina (Mohs hardness: 9) | 0.1 g |

<Manufacture of Photothermographic Imaging Material>

The back coat layer coating solution and the back coat layer protection layer coating solution prepared above, were coated on the under coating under layer B-2 by an extrusion coater at a coating velocity of 50 m/min such that the thickness of each dried film was 3.5 μm. The drying was carried out over 5 min, using dried wind with drying temperature at 100° C. and dew point at 10° C.

The photothermographic imaging materials A-1 to A-15 shown in Table 1 were manufactured by simultaneously overlaying and coating the image forming layer coating solution and the image forming layer protection layer (surface protection layer) coating solution on the under coating upper layer A-2 using the extrusion coater at the coating velocity of 50 m/min. The coating was carried out such that a coated silver amount is 1.2 g/m$^2$ in the image forming layer and the thickness of dried film is 2.5 μm (surface protection layer upper layer: 1.3 μm, surface protection layer lower layer: 1.2 μm) in the image formation protection layer (surface protection layer). Subsequently, the drying was carried out for 10 min. using the dried wind with drying temperature 75° C. and dew point at 10° C.

The sample A-10 was prepared as is the case with the sample A-1, except that the fluorinated surfactant in the back coat layer protection layer and the image forming layer protection layer (upper and lower layers) was changed from SF-17 to $C_8F_{17}SO_3Li$ in the sample A-1.

The sample A-11 was made as in the case with the sample A-1, except that —$SO_3K$ group-containing polyvinyl butyral (Tg 65° C., 0.2 mmol/g of —$SO_3K$ is contained) was used in place of —$SO_3K$ group-containing polyvinyl butyral (Tg 75° C., 0.2 mmol/g of $SO_3K$ is contained) as the image forming layer binder in the preparation of the predispersing solution A in the sample A-1.

<Exposure and Development Processing>

The photothermographic imaging materials A-1 to A-15 manufactured above were cut into half-cut size (34.5 cm×43.0 cm), and then processed by the following procedure using the thermal development apparatus shown in FIG. 1.

The photothermographic imaging material F was taken out from the film tray C, transported to the laser exposure portion 121, and subsequently given exposure by laser scanning using an exposure machine where semiconductor laser (maximum output is made 70 mW by joining two of maximum output 35 mW per one) with vertical multiple mode of wavelength 810 nm at high frequency superposition is made an exposure source, from the side of the image formation layer face. At the time, the image was formed by making the angle of the exposure face of the photothermographic imaging material F and the exposure laser beam 75° C. Subsequently, the photothermographic imaging material F was transported to the developing portion 130, the heat drum 1 heated at 125° C. for 15 sec to perform thermal development such that the protection layer at the side of the image formation layer of the photothermographic imaging material F was in contact with the surface of the drum, and then photothermographic imaging material was taken out of the apparatus. At the time, the transport velocity from the feeding portion 110 to the exposure portion 121, the transport velocity at the exposure portion and the transport velocity at the developing portion were 20 mm/sec, respectively. The exposure and the development were carried out in the room adjusted at 23° C. and 50% RH. The exposure was performed gradually by reducing the amount of exposure energy of logEO.05 per one step from the maximum output.

<Performance Evaluation>

The following performances were evaluated for respective thermal developed images.

<<Image Density>>

The value at the maximum density part of the image obtained in the above condition is measured by a photographic densitometer and shown as the image density.

<<Average Gradation>>

The density of the obtained sensitometry sample was measured using PDM 65 transmission densitometer (supplied from Konica Corporation), and the characteristic curve was obtained by computer processing of the measurement result. The average gradation (Ga) value at the optical density of 0.25 to 2.5 was obtained from this characteristic curve.

<<Silver Color Tone>>

Silver color tone after the processing was visually evaluated by printing X-ray photographs of the chest in each photothermographic imaging material and using Schaukasten. As a standard sample, the film of wet processing for the laser imager supplied from Konica Corporation was used, and the relative color tone to the standard sample was visually evaluated with the following criteria by 0.5 increment.

5: Same tone as the standard sample
4: Preferable tone similar to the standard sample
3: Level with no practical problem although the tone is slightly different from the standard sample 2: Tone clearly different from the standard sample
1: Undesirable tone different from the standard sample <<Light Radiated Image Stability>>

The obtained imaging material was given the exposure and development processing as with the above, then attached on Schaukasten with luminance of 1000 Lux and left for 10 days, and subsequently the change of the image was evaluated with the following criteria by 0.5 increment.

5: Nearly no change
4: Slight tone change is observed
3: Tone change and increase of photographic fog are partially observed
2. Tone change and increase of photographic fog are considerably observed
1: Tone change and increase of photographic fog are noticeable, occurrence of strong density unevenness on whole area the wavelength of maximum absorption wavelength of each coloring agent within 600 to 700 nm.

<<Average Roughness of 10 Points>>

The samples prior to thermodevelopment treatment is subject to the measurement or average roughness of 10 points described below.

Average roughness of 10 points Rz(μm) in an area of 463.4 μm×623.9 μm is measured by noncontact three dimensional surface analyzer (RST/PLUS by WYKO Corp.). Rz is defined according to JIS surface roughness (B0601). Each sample of 10 cm×10 cm is divided into 100 sections of 1 cm×1 cm, and center of the individual squared sections is subjected to the measurement. The average value and standard deviation are obtained from results of the 100 measurements.

The results are shown together in Table 1.

TABLE 1

| SAMPLE NO. | TYPE AND ADDTION AMOUNT OF COMPOUND OF GENERAL FORMULA (YA) | TYPE AND ADDTION AMOUNT OF COUPLER (g) | TYPE AND ADDTION AMOUNT OF MAIN DEVELOPING AGENT (g) | TYPE AND ADDTION AMOUNT OF REDUCING AGENT OF GENERAL FORMULA(1) (g) | TYPE AND ADDTION AMOUNT OF REDUCING AGENT OF GENERAL FORMULA(2) (g) | MASS RATIO OF REDUCING AGENT OF GENERAL FORMULA(1) (%) | IMAGE DENSITY |
|---|---|---|---|---|---|---|---|
| A-1 | (YA-1) = 0.159 | CP1-1 = 0.172 | D-1 = 0.380 | (1-1) = 4.20 | (2-2) = 23.78 | 15 | 4.2 |
| A-2 | (YA-1) = 0.159 | CP1-1 = 0.172 | D-1 = 0.380 | (1-7) = 4.20 | (2-2) = 23.78 | 15 | 4.2 |
| A-3 | (YA-1) = 0.159 | CP1-1 = 0.172 | D-1 = 0.380 | (1-10) = 4.20 | (2-2) = 23.78 | 15 | 4.5 |
| A-4 | (YA-1) = 0.159 | CP1-6 = 0.172 | D-1 = 0.380 | (1-1) = 4.20 | (2-2) = 23.78 | 15 | 4.1 |
| A-5 | (YA-1) = 0.159 | CP1-8 = 0.172 | D-1 = 0.380 | (1-1) = 4.20 | (2-2) = 23.78 | 15 | 4.1 |
| A-6 | (YA-1) = 0.159 | CP1-2 = 0.172 | D-3 = 0.380 | (1-1) = 4.20 | (2-2) = 23.78 | 15 | 4.2 |
| A-7 | (YA-1) = 0.159 | CP1-7 = 0.172 | D-3 = 0.380 | (1-1) = 4.20 | (2-2) = 23.78 | 15 | 4.2 |
| A-8 | (YA-2) = 0.159 | CP1-1 = 0.172 | D-1 = 0.380 | (1-1) = 4.20 | (2-2) = 23.78 | 15 | 4.1 |
| A-9 | (YA-9) = 0.159 | CP1-1 = 0.172 | D-1 = 0.380 | (1-1) = 4.20 | (2-2) = 23.78 | 15 | 4.1 |
| A-10 | (YA-1) = 0.159 | CP1-1 = 0.172 | D-1 = 0.380 | (1-1) = 4.20 | (2-2) = 23.78 | 15 | 4.2 |
| A-11 | (YA-1) = 0.159 | CP1-1 = 0.172 | D-1 = 0.380 | (1-1) = 4.20 | (2-2) = 23.78 | 15 | 4.1 |
| A-12 | (YA-1) = 0.159 | NONE | NONE | (1-1) = 4.20 | (2-2) = 23.78 | 15 | 3.9 |
| A-13 | (YA-1) = 0.159 | CP1-1 = 0.172 | D-1 = 0.380 | NONE | (2-1) = 27.98 | 0 | 3.6 |
| A-14 | (YA-1) = 0.159 | NONE | NONE | NONE | (2-1) = 27.98 | 0 | 3.4 |
| A-15 | (YA-1) = 0.159 | CP1-1 = 1.204 | D-1 = 2.66 | NONE | (2-2) = 27.98 | 0 | 4.0 |

| SAMPLE NO. | AVERAGE GRADATION Ga | SILVER COLOR TONE | IMAGE STORAGE STABILITY FOR LIGHT IRRADIATION | MAXIMUM DENSITY OF COLORING AGENT | NOTE |
|---|---|---|---|---|---|
| A-1 | 2.7 | 5.0 | 5.0 | 0.08 | EXAMPLE |
| A-2 | 2.7 | 5.0 | 5.0 | 0.08 | EXAMPLE |
| A-3 | 2.9 | 5.0 | 5.0 | 0.08 | EXAMPLE |
| A-4 | 2.7 | 5.0 | 5.0 | 0.08 | EXAMPLE |
| A-5 | 2.7 | 5.0 | 5.0 | 0.08 | EXAMPLE |
| A-6 | 2.7 | 5.0 | 5.0 | 0.08 | EXAMPLE |
| A-7 | 2.7 | 5.0 | 5.0 | 0.08 | EXAMPLE |
| A-8 | 2.7 | 5.0 | 5.0 | 0.08 | EXAMPLE |
| A-9 | 2.7 | 5.0 | 5.0 | 0.08 | EXAMPLE |
| A-10 | 2.7 | 5.0 | 5.0 | 0.08 | EXAMPLE |
| A-11 | 2.7 | 5.0 | 5.0 | 0.08 | EXAMPLE |
| A-12 | 2.7 | 3.5 | 4.5 | 0.00 | COMPARATIVE EXAMPLE |
| A-13 | 2.6 | 2.5 | 2.5 | 0.08 | REFERENCE EXAMPLE |
| A-14 | 2.5 | 2.5 | 2.5 | 0.00 | COMPARATIVE EXAMPLE |
| A-15 | 2.7 | 2.5 | 4.0 | 0.56 | COMPARATIVE EXAMPLE |

<<Maximum Density of the Coloring Agent>>

The optical density of the coloring agents of each sample at the maximum density part in a wavelength range of 600 to 700 nm is measured using spectrophotometer of U-3410 type (Hitachi, Co., Ltd.). The measurement is performed at From Table 1, it is obvious that the photothermographic imaging materials of the invention are high density and excellent in silver color tone and light radiated image stability, compared to the comparative photothermographic imaging materials.

Also, when the samples A-10 and A-1 were compared, it was shown that the sample A-1 has more excellent properties for transportability and environmental suitability (accumulation in vivo). Also when the samples A-11 and A-1 were compared, it was shown that the sample A-1 has more excellent property for the image storage stability in storage at high temperature.

Rz(E)/Rz(B) values of samples A-1 to A-15 were all 0.4, which were obtained by measuring average roughness of 10 points with regard to front and back sides of the samples.

Example B-1

<Preparation of the Solutions>

The solutions used in manufacturing the photothermographic imaging material were prepared as in the case with the methods described in the example A-1, except: 50.6 g of potassium bromide and 2.66 g of potassium iodide were used in the solution (C1) which is used in the preparation of photosensitive silver halide emulsion A to be AgI content of 3.5 mol % in the silver halide emulsion A; AgI content in silver halide emulsion B is also regulated to 3.5 mol % by the same way; and the addition solution a is made by dissolving the reducing agent (type and amount of the compound is shown in Table 2A and 2B), the compound represented by the Formula (YA) and coupler or cyan leuco dye (type and amount of the compound is shown in Table 2A and 2B), 1.54 g of 4-methylfutalic acid and 0.48 g of the above infrared dye to 110 g of MEK.

<Manufacturing the Photothermographic Imaging Material>

The back face coating solution, back face layer protecting solution prepared as described above were coated onto the prepared under coating layer B-2 by an extruding coater such that the thickness of dried film became respectively 3.5 μm, and dried. Drying was performed over 5 min. using a drying wind with a drying temperature of 100° C. and a dew point of 10° C.

Applying solutions of the above image forming layer and image forming layer protection layer (surface protection layer) were applied onto the under coating layer A-2 at the applying rate of 50 m/min by an extruding coater. These two layers were overlaid and coated in plurality simultaneously such that applied silver is 1.2 g/m$^2$ in the image forming layer, dried thickness of the image forming layer protection layer (surface protection layer) is 2.5 μm (surface protection layer upper layer is 1.3 μm, surface protection layer lower layer is 1.2 μm), and dried. Drying was performed over 10 min. using a drying wind with a drying temperature of 75° C.

The sample B-9 was prepared as is the case with the sample B-1, except the fluorinated surfactant was exchanged from SF-17 to $C_8F_{17}SO_3Li$ in the back coating layer protection layer and the image forming layer protection layer (upper layer and lower layer).

The sample B-10 was prepared as is the case with the sample B-1, except $SO_3K$ group containing polyvinylbuthylal (Tg 75° C., containing 0.2 mmol/g of $SO_3K$) was used as the binder of the image forming layer in preparation of predispersing solution A instead of $SO_3K$ group containing polyvinylbuthylal (Tg 65° C., containing 0.2 mmol/g of $SO_3K$) in the sample B-1.

The sample B-19 was prepared as is the case with the sample B-11, expect the fluorinated surfactant was exchanged from SF-17 to $C_8F_{17}SO_3Li$ in the back coating layer protection layer and the image forming layer protection layer (upper layer and lower layer).

The sample B-20 was prepared as is the case with the sample B-11, expect $SO_3K$ group containing polyvinylbutyral (Tg 75° C., containing 0.2 mmol/g of $SO_3K$) was used as the binder of the image forming layer in preparation of, predispersing solution A instead of $SO_3K$ group containing polyvinylbutyral (Tg 65° C., containing 0.2 mmol/g of $SO_3K$) in the sample B-11.

<Exposure and Development Treatment>

The photothermographic imaging material B-1 to B-26 prepared as described above are cut into a half size (34.5 cm×43.0 cm), and were processed as described in example A-1 using the photothermographic imaging material shown in FIG. 1.

<Performance Evaluation>

The individual thermal developed images were subjected to the evaluations of image density, average gradation, silver color tone, light radiated image stability and maximum density of coloring agent those which were described in example A-1.

The results are shown together in Tables 2A and 2B.

TABLE 2A

| SAMPLE NO. | TYPE AND ADDTION AMOUNT OF COMPOUND OF GENERAL FORMULA (YA) | TYPE AND ADDTION AMOUNT OF COMPOUND OF COUPLER (g) | TYPE AND ADDTION AMOUNT OF MAIN DEVELOPING AGENT (g) | TYPE AND ADDTION AMOUNT OF CYAN COLORING LEUCO DYE(g) | TYPE AND ADDTION AMOUNT OF REDUCING AGENT OF GENERAL FORMULA(1) (g) | TYPE AND ADDTION AMOUNT OF REDUCING AGENT OF GENERAL FORMULA(2) (g) | MASS RATIO OF REDUCING AGENT OF GENERAL FORMULA(1) (%) |
|---|---|---|---|---|---|---|---|
| B-1 | (YA-1) = 0.159 | CP2-1 = 0.172 | D-1 = 0.380 | NONE | (1-1) = 4.20 | (2-2) = 23.78 | 15 |
| B-2 | (YA-1) = 0.159 | CP2-1 = 0.172 | D-1 = 0.380 | NONE | (1-7) = 4.20 | (2-2) = 23.78 | 15 |
| B-3 | (YA-1) = 0.159 | CP2-1 = 0.172 | D-1 = 0.380 | NONE | (1-10) = 4.20 | (2-2) = 23.78 | 15 |
| B-4 | (YA-1) = 0.159 | CP2-2 = 0.172 | D-3 = 0.380 | NONE | (1-1) = 4.20 | (2-2) = 23.78 | 15 |
| B-5 | (YA-1) = 0.159 | CP2-6 = 0.172 | D-1 = 0.380 | NONE | (1-1) = 4.20 | (2-2) = 23.78 | 15 |
| B-6 | (YA-1) = 0.159 | CP2-8 = 0.172 | D-1 = 0.380 | NONE | (1-1) = 4.20 | (2-2) = 23.78 | 15 |
| B-7 | (YA-1) = 0.159 | CP2-1 = 0.172 | D-1 = 0.380 | NONE | (1-1) = 4.20 | (2-2) = 23.78 | 15 |
| B-8 | (YA-1) = 0.159 | CP2-1 = 0.172 | D-1 = 0.380 | NONE | (1-1) = 4.20 | (2-2) = 23.78 | 15 |
| B-9 | (YA-1) = 0.159 | CP2-1 = 0.172 | D-1 = 0.380 | NONE | (1-1) = 4.20 | (2-2) = 23.78 | 15 |
| B-10 | (YA-1) = 0.159 | CP2-1 = 0.172 | D-1 = 0.380 | NONE | (1-1) = 4.20 | (2-2) = 23.78 | 15 |
| B-11 | (YA-1) = 0.159 | NONE | NONE | (CA-10) = 0.159 | (1-1) = 4.20 | (2-2) = 23.78 | 15 |
| B-12 | (YA-1) = 0.159 | NONE | NONE | (CA-10) = 0.159 | (1-7) = 4.20 | (2-2) = 23.78 | 15 |
| B-13 | (YA-1) = 0.159 | NONE | NONE | (CA-10) = 0.159 | (1-10) = 4.20 | (2-2) = 23.78 | 15 |

TABLE 2A-continued

| SAMPLE NO. | IMAGE DENSITY | AVERAGE GRADATION Ga | SILVER COLOR TONE | IMAGE STORAGE STABILITY FOR LIGHT IRRADIATION | MAXIMUM DENSITY OF COLORING AGENT | NOTE |
|---|---|---|---|---|---|---|
| B-1 | 4.2 | 2.7 | 5.0 | 5.0 | 0.08 | EXAMPLE |
| B-2 | 4.2 | 2.7 | 5.0 | 5.0 | 0.08 | EXAMPLE |
| B-3 | 4.5 | 2.9 | 5.0 | 5.0 | 0.08 | EXAMPLE |
| B-4 | 4.2 | 2.7 | 5.0 | 5.0 | 0.08 | EXAMPLE |
| B-5 | 4.1 | 2.7 | 5.0 | 5.0 | 0.08 | EXAMPLE |
| B-6 | 4.1 | 2.7 | 5.0 | 5.0 | 0.08 | EXAMPLE |
| B-7 | 4.2 | 2.7 | 5.0 | 5.0 | 0.08 | EXAMPLE |
| B-8 | 4.2 | 2.7 | 5.0 | 5.0 | 0.08 | EXAMPLE |
| B-9 | 4.2 | 2.7 | 5.0 | 5.0 | 0.08 | EXAMPLE |
| B-10 | 4.2 | 2.7 | 5.0 | 5.0 | 0.08 | EXAMPLE |
| B-11 | 4.2 | 2.7 | 5.0 | 5.0 | 0.07 | EXAMPLE |
| B-12 | 4.2 | 2.7 | 5.0 | 5.0 | 0.07 | EXAMPLE |
| B-13 | 4.4 | 2.9 | 5.0 | 5.0 | 0.07 | EXAMPLE |

TABLE 2B

| SAMPLE NO. | TYPE AND ADDTION AMOUNT OF COMPOUND OF GENERAL FORMULA (YA) | TYPE AND ADDTION AMOUNT OF COMPOUND OF COUPLER (g) | TYPE AND ADDTION AMOUNT OF MAIN DEVELOPING AGENT (g) | TYPE AND ADDTION AMOUNT OF CYAN COLORING LEUCO DYE (g) | TYPE AND ADDTION AMOUNT OF REDUCING AGENT OF GENERAL FORMULA(1) (g) | TYPE AND ADDTION AMOUNT OF REDUCING AGENT OF GENERAL FORMULA(2) (g) | MASS RATIO OF REDUCING AGENT OF GENERAL FORMULA(1) (%) |
|---|---|---|---|---|---|---|---|
| B-14 | (YA-1) = 0.159 | NONE | NONE | (CA-2) = 0.159 | (1-1) = 4.20 | (2-2) = 23.78 | 15 |
| B-15 | (YA-1) = 0.159 | NONE | NONE | (CA-5) = 0.159 | (1-1) = 4.20 | (2-2) = 23.78 | 15 |
| B-16 | (YA-1) = 0.159 | NONE | NONE | (CA-12) = 0.159 | (1-1) = 4.20 | (2-2) = 23.78 | 15 |
| B-17 | (YA-2) = 0.159 | NONE | NONE | (CA-10) = 0.159 | (1-1) = 4.20 | (2-2) = 23.78 | 15 |
| B-18 | (YA-9) = 0.159 | NONE | NONE | (CA-10) = 0.159 | (1-1) = 4.20 | (2-2) = 23.78 | 15 |
| B-19 | (YA-1) = 0.159 | NONE | NONE | (CA-10) = 0.159 | (1-1) = 4.20 | (2-2) = 23.78 | 15 |
| B-20 | (YA-1) = 0.159 | NONE | NONE | (CA-10) = 0.159 | (1-1) = 4.20 | (2-2) = 23.78 | 15 |
| B-21 | NONE | CP2-1 = 0.172 | D-1 = 0.380 | NONE | NONE | (2-2) = 27.98 | 0 |
| B-222 | NONE | NONE | NONE | (CA-10) = 0.159 | NONE | (2-2) = 27.98 | 0 |
| B-23 | (YA-1) = 0.159 | NONE | NONE | NONE | NONE | (2-2) = 27.98 | 0 |
| B-24 | (YA-1) = 0.159 | CP2-1 = 0.172 | D-1 = 0.380 | NONE | NONE | (2-2) = 27.98 | 0 |
| B-25 | (YA-1) = 0.159 | NONE | NONE | (CA-10) = 0.159 | NONE | (2-2) = 27.98 | 0 |
| B-26 | (YA-1) = 0.159 | CP2-1 = 1.204 | D-1 = 2.66 | NONE | NONE | (2-2) = 27.98 | 0 |

| SAMPLE NO. | IMAGE DENSITY | AVERAGE GRADATION Ga | SILVER COLOR TONE | IMAGE STORAGE STABILITY FOR LIGHT IRRADIATION | MAXIMUM DENSITY OF COLORING AGENT | NOTE |
|---|---|---|---|---|---|---|
| B-14 | 4.2 | 2.7 | 5.0 | 5.0 | 0.07 | EXAMPLE |
| B-15 | 4.2 | 2.7 | 5.0 | 5.0 | 0.07 | EXAMPLE |
| B-16 | 4.2 | 2.7 | 5.0 | 5.0 | 0.07 | EXAMPLE |
| B-17 | 4.1 | 2.7 | 5.0 | 5.0 | 0.07 | EXAMPLE |
| B-18 | 4.2 | 2.7 | 5.0 | 5.0 | 0.07 | EXAMPLE |
| B-19 | 4.2 | 2.7 | 5.0 | 5.0 | 0.07 | EXAMPLE |
| B-20 | 4.2 | 2.7 | 5.0 | 5.0 | 0.07 | EXAMPLE |
| B-21 | 3.4 | 2.6 | 2.5 | 4.0 | 0.08 | COMPARATIVE EXAMPLE |
| B-222 | 3.4 | 2.6 | 2.5 | 4.0 | 0.07 | COMPARATIVE EXAMPLE |
| B-23 | 3.4 | 2.7 | 2.5 | 4.0 | 0.00 | COMPARATIVE EXAMPLE |
| B-24 | 3.9 | 2.5 | 4.0 | 4.5 | 0.08 | REFERENCE EXAMPLE |
| B-25 | 3.9 | 2.5 | 4.0 | 4.5 | 0.07 | REFERENCE EXAMPLE |
| B-26 | 4.4 | 2.5 | 2.5 | 4.0 | 0.56 | COMPARATIVE EXAMPLE |

From Tables 2A and 2B, it is obvious that the photothermographic imaging materials of the invention are high density and excellent in silver color tone and light radiated image stability, compared to the comparative photothermographic imaging materials.

Also, when the samples B-9 and B-19 were compared with samples B-1 and B-11 respectively, it was shown that the samples B-1 and B-11 have more excellent properties for transportability and environmental suitability (accumulation in vivo). Also when the samples B-10 and B-20 were compared with B-1 and B-11 respectively, it was shown that the samples B-1 and B-11 has more excellent property for the image storage stability in storage at high temperature.

ADVANTAGE OF THE INVENTION

The photothermographic imaging materials of the invention are high density and excellent in silver color tone and light radiated image stability, and furthermore, excellent in transportability and environmental suitability (accumulation in vivo) and image storage stability in storage at high temperature.

The entire disclosure of JP Tokugan-2003-89350 filed on Mar. 27, 2003 including specification, claims, drawings and summary and JP Tokugan-2003-89351 filed on Mar. 27, 2003 including specification, claims, drawings and summary is incorporated herein by reference in its entirety.

The invention claimed is:

1. A photothermographic imaging material comprising a organic silver salt, a silver halide, a binder, a reducing agent, a cyan leuco dye, and a yellow coloring leuco dye represented by the following Formula (YA); and Formula (YA)

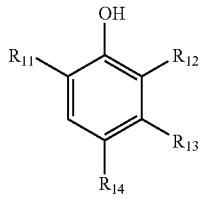

wherein the $R_{11}$ represents a substituted or unsubstituted alkyl group, the $R_{12}$ represents hydrogen atom or substituted or unsubstituted alkyl or acylamino groups, the $R_{11}$ and the $R_{12}$ are not 2-hydroxyphenylmethyl group, the $R_{13}$ represents hydrogen atom or substituted or unsubstituted alkyl group, and the $R_{14}$ represents a group capable of being substituent on a benzene ring; and wherein the reducing agent comprises a compound represented by the following Formula (1); and Formula (1)

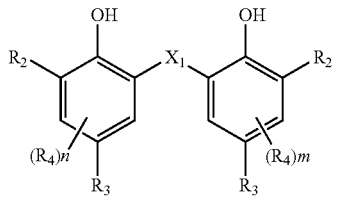

wherein the $X_1$ represents chalcogen atom or —$CHR_1$, the $R_1$ represents hydrogen, halogen, alkyl group, alkenyl group, aryl group or heterocyclic group, and the $R_2$ represents alkyl group, the two $R_2$s can be either same or different, and at least one of them is secondary or tertiary alkyl group, the $R_3$ represents hydrogen atom or a group which can be a substituent on a benzene ring, the $R_4$ represents a group which can be a substituent on a benzene ring, the m and the n represent integer of 0 to 2 respectively.

2. The material of claim 1, wherein the reducing agent further comprises a compound represented by the following Formula (2); and Formula (2)

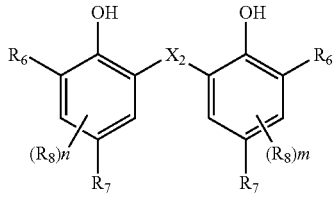

wherein the $X_2$ represents chalcogen atom or —$CHR_5$—, the $R_5$ represents hydrogen, halogen, alkyl group, alkenyl group, aryl group or heterocyclic group, and the $R_6$ represents alkyl group, the two $R_6$s can be either same or different, but are not secondary or tertiary alkyl group, the $R_7$ represents hydrogen atom or a group which can a substituent on a benzene ring, $R_8$ represents a group which can be a substituent on a benzene ring, and the m and the n represent integer of 0 to 2 respectively.

3. The material of claim 2, wherein mass ratio between the compound represented by the Formula (1) and the compound represented by the Formula (2) is 5:95 to 45:55.

4. The material of claim 1, wherein an image obtained by thermal development in developing temperature at 123° C. and developing time for 13.5 seconds has an average gradation of 2.0 to 4.0 at an optical density under diffused light in a range of 0.25 to 2.5 on a characteristic curve shown on rectangular coordinates where Y axis is diffuse density and X axis is common logarithm exposure amount and unit lengths of the X axis and the Y axis are equal.

5. The material of claim 1, comprising at least one silver saving agent selected from a vinyl compound, a hydrazine derivative, a silane compound and a quaternary onium salt in a side of a face having an image forming layer.

6. The material of claim 1, wherein the binder has a glass transition temperature (Tg) of 70 to 150° C.

7. The material of claim 1, further comprising a compound represented by the following Formula (SF); and $$(Rf\text{-}(L)_{n1}\text{-})_p\text{-}(Y)_{m1}\text{-}(A)_q \qquad SF)$$

wherein the Rf represents a substituent having fluorine atom, the L represents a bivalent linkage group containing no fluorine atom, the Y represents a linkage group having (p+q) valency, and the A represents an anion group or an anion salt group, the $m_1$ and the $n_1$ represent an integer of 0 or 1 respectively, the p and the q represent an integer of 1 to 3 respectively, and when the q is 1, at least one of the $n_1$ and the $m_1$ is not 0.

8. The material of claim 1, wherein the silver halide comprises silver halide particles having a mean particle size of 10 to 50 nm.

9. The material of claim 8, wherein the silver halide further comprises silver halide particles having the mean particle size of 55 to 100 nm.

10. The material of claim 1, wherein the silver halide comprises silver halide particles which are chemically sensitized by a chalcogen compound.

11. The material of claim 1, wherein a content of silver in an image forming layer is from 0.3 to 1.5 $g/m^2$.

* * * * *